US006807279B1

(12) United States Patent
Kyono

(10) Patent No.: US 6,807,279 B1
(45) Date of Patent: Oct. 19, 2004

(54) MFB SPEAKER SYSTEM WITH CONTROLLABLE SPEAKER VIBRATION CHARACTERISTIC

(75) Inventor: Noboru Kyono, Tokyo (JP)

(73) Assignee: Mitsubishi Electric Engineering Company Limited, Tokyo (JP)

( * ) Notice: Subject to any disclaimer, the term of this patent is extended or adjusted under 35 U.S.C. 154(b) by 0 days.

(21) Appl. No.: 09/384,579

(22) Filed: Aug. 27, 1999

(30) Foreign Application Priority Data

Sep. 21, 1998 (JP) ..... 10-266484
Mar. 12, 1999 (JP) ..... 11-067436
Mar. 31, 1999 (JP) ..... 11-092799

(51) Int. Cl.[7] ..... H04R 3/00
(52) U.S. Cl. ..... 381/96
(58) Field of Search ..... 381/83, 93, 96, 381/59, 111, 116, 117, 401, 402, 55, 89, 120–121

(56) References Cited

U.S. PATENT DOCUMENTS 3,047,661 A * 7/1962 Winker ..... 381/96
4,712,247 A * 12/1987 Swarte ..... 381/96
5,197,104 A * 3/1993 Padi ..... 381/192
5,588,065 A * 12/1996 Tanaka et al. ..... 381/96
5,748,753 A * 5/1998 Carver ..... 381/96

FOREIGN PATENT DOCUMENTS

| | | |
|---|---|---|
| DE | 2629605 | 1/1978 |
| DE | 31 37 747 | 3/1983 |
| DE | 41 11 884 C2 | 9/1993 |
| EP | 0150976 | 8/1985 |
| GB | 1348643 | 3/1974 |
| GB | 2010639 | 6/1979 |
| JP | 355153496 A * | 11/1980 ..... H04R/3/04 |

OTHER PUBLICATIONS

Yamomoto, Takeo, "Speaker System (in 2 volumes)", Radio Technology Publishing, Jul. 15, 1977, pp. 405–411.

* cited by examiner

*Primary Examiner*—Curtis Kuntz
*Assistant Examiner*—Lun-See Lao
(74) *Attorney, Agent, or Firm*—Rothwell, Figg, Ernst & Manbeck, p.c.

(57) ABSTRACT

An acoustic signal is input to a first voice coil of a speaker unit. A vibration information detecting unit comprised of a vibrational displacement detecting unit, a vibrational velocity detecting unit, a vibrational acceleration detecting unit, amplifiers, and an adder adds a signal indicating the vibrational displacement x, a signal indicating the vibrational velocity v and a signal indicating the vibrational acceleration α. A power amplifier inputs the sum signal to a second voice coil of the speaker unit using a positive feedback or negative feedback.

26 Claims, 29 Drawing Sheets

MFB SPEAKER SYSTEM WITH CONTROLLABLE SPEAKER VIBRATION CHARACTERISTIC

BACKGROUND OF THE INVENTION

1. Field of the Invention

The present invention generally relates to motional feedback (MFB) speaker systems and, more particularly, to a MFB speaker system in which the vibration characteristic of a speaker can be arbitrarily controlled and distortion is decreased.

2. Description of the Related Art

FIG. 1 shows a related-art MFB speaker system disclosed in "Speaker System (in 2 volumes)" (Takeo Yamamoto, Radio Technology Publishing, Jul. 15, 1977, p. 406). Referring to FIG. 1, numeral 100 indicates an input terminal of an acoustic signal, 110 indicates an amplifier having a gain of $G_A$, 120 indicates a feedback circuit having a gain of β, and 130 indicates a speaker having a voltage gain of $G_s$. $E_i$ indicates an input voltage at the terminal 100, $E_v$ indicates an input voltage supplied to the speaker 130 and $E_s$ indicates an output voltage from the speaker 130.

A description will now given of the operation.

The acoustic signal input via the input terminal 100 is amplified by the amplifier 110 and drives the speaker 130. The speaker 130 radiates sound as a result of vibration of a diaphragm. The vibration of the diaphragm is detected by a signal detecting means (not shown) provided in the speaker 130 and delivered to the feedback circuit 120. The signal thus fed back is synthesized with the acoustic signal from the input terminal 100 so as to drive the speaker 130.

In this MFB speaker system, the amplifier 110 is used to drive the speaker 130. The amplifier 110 operates in association with the feedback circuit 120 and the speaker 130 so that the entire speaker system operates as a whole. Therefore, it is not generally assumed that a user arbitrarily exchanges the amplifier 110. In the related-art MFB speaker system, the signal returned to the feedback circuit 120 has a negative polarity with respect to the input acoustic signal. Distortion is decreased and the characteristic is improved as a result of the negative feedback.

In the related-art MFB system, the signal detected by the signal detecting means of the speaker 130 may be proportional to the velocity of the diaphragm, to the acceleration of the diaphragm or to the displacement of the diaphragm. FIGS. 2A–2C show characteristic of the systems that operate on a velocity signal, an acceleration signal and a displacement signal, respectively, where the frequency is plotted horizontally and the sound pressure level is plotted vertically.

As shown in FIG. 2A, in the velocity system, when the feedback gain β of the signal proportional to the velocity of the diaphragm (feedback rate $D_1$) is increased, $Q_0$ of the speaker system decreases and the sound pressure level in the vicinity of the lowest resonance frequency $f_0$ is decreased. As shown in FIG. 2B, in the acceleration system, when the feedback gain of the signal proportional to the acceleration of the diaphragm (feedback rate $D_2$) is increased, the sound pressure level is decreased and $Q_0$ is increased, though the lowest resonance frequency $f_0$ of the speaker system is decreased and sound reproduction in the bass region becomes possible.

As shown in FIG. 2C, in the displacement system, the lowest resonance frequency $f_0$ is increased and $Q_0$ of the speaker system is increased, when the feedback gain β of the signal proportional to the displacement of the diaphragm (feedback rate $D_3$) is increased. For the reasons stated above, in the related-art MFB speaker system, an appropriate combination of the signals respectively proportional to the vibration velocity, vibrational acceleration and vibration displacement is often fed back.

Since the related-art MFB speaker system is constructed as described above, the amplifier 110, the speaker 130 and the feedback circuit 120 function as a single system as shown in FIG. 1. Therefore, a user of the speaker system cannot generally use an amplifier in his or her possession. When the amplifier 110 of the MFB speaker system is changed in an attempt to gain high performance, readjustment of the speaker 130 and the feedback circuit 120 is required. Thus, there was generally a problem in that a user cannot exchange an amplifier in the related-art MFB speaker system.

SUMMARY OF THE INVENTION

Accordingly, a general object of the present invention is to provide a MFB speaker system constructed such that a speaker unit having double voice coils is used, the amplifier in the speaker system is used only to amplify a signal from the speaker detected as a result of oscillation of the speaker, and an amplifier in the user's possession or the user's choice may be used as the unit-driving amplifier.

Another and more specific object of the present invention is to provide a MFB speaker system in which double voice-coil speaker unit, used conventionally for bass reproduction, is used, and in which an amplifier for amplifying oscillation information such as vibrational velocity, vibrational acceleration, and vibrational displacement is provided separately from an amplifier for driving the speaker unit with an acoustic signal, so that a user can use the amplifier in his or her possession or use an amplifier of his or her own choice.

The above objects can be achieved by a MFB speaker system comprising: a speaker unit provided with a first--voice coil for inputting an external acoustic signal and a second voice coil for inputting vibrational information obtained by outputting the acoustic signal; vibrational information detecting means for detecting the vibrational information of the speaker unit; and amplifying means for amplifying the vibrational information detected by the vibrational information detecting means and feeding back the vibrational information to the second voice coil with one of a positive and negative polarity with respect to the external acoustic signal.

The vibrational information of the speaker unit may be a signal proportional to a vibrational velocity of a diaphragm of the speaker unit.

The vibrational information of the speaker unit may be a signal proportional to a vibrational acceleration of a diaphragm of the speaker unit.

The vibrational information of the speaker unit may be a signal proportional to a vibrational displacement of a diaphragm of the speaker unit.

The amplifying means may at least include an amplifier for amplifying only the vibrational information of the speaker unit.

The vibrational information detecting means may retrieve, as the vibrational information, a signal proportional to a vibrational displacement of a diaphragm of the speaker unit and a signal proportional to a vibrational velocity of the diaphragm.

The vibrational information detecting means may retrieve, as the vibrational information, a signal proportional to a vibrational displacement of a diaphragm of the speaker unit and generate a signal proportional to a vibrational velocity of the diaphragm by differentiating the signal proportional to the vibrational displacement; and the amplifying means may amplify the signal proportional to the vibrational displacement and the signal proportional to the vibrational velocity and feed back the signals to the second voice coil.

The vibrational information detecting means may retrieve, as the vibrational information, a signal proportional to a vibrational velocity of a diaphragm of the speaker unit and generate a signal proportional to a vibrational displacement of the diaphragm by integrating the signal proportional to the vibrational velocity; and the amplifying means may amplify the signal proportional to the vibrational displacement and the signal proportional to the vibrational velocity and feed back the signals to the second voice coil.

The vibrational information detecting means may retrieve, as the vibrational information, a signal proportional to a vibrational displacement of a diaphragm of the speaker unit and a signal proportional to a vibrational acceleration of the diaphragm.

The vibrational information detecting means may retrieve, as the vibrational information, a signal proportional to a vibrational displacement of a diaphragm of the speaker unit and generate a signal proportional to a vibrational acceleration of the diaphragm by differentiating the signal proportional to the vibrational displacement; and the amplifying means may amplify the signal proportional to the vibrational displacement and the signal proportional to the vibrational acceleration and feed back the signals to the second voice coil.

The vibrational information detecting means may retrieve, as the vibrational information, a signal proportional to a vibrational acceleration of a diaphragm of the speaker unit and generate a signal proportional to a vibrational displacement of the diaphragm by integrating the signal proportional to the vibrational acceleration; and the amplifying means may amplify the signal proportional to the vibrational displacement and the signal proportional to the vibrational acceleration and feed back the signals to the second voice coil.

The vibrational information detecting means may retrieve, as the vibrational information, a signal proportional to a vibrational velocity of a diaphragm of the speaker unit and a signal proportional to a vibrational acceleration of the diaphragm.

The vibrational information detecting means may retrieve, as the vibrational information, a signal proportional to a vibrational velocity of a diaphragm of the speaker unit and generate a signal proportional to a vibrational acceleration of the diaphragm by differentiating the signal proportional to the vibrational velocity; and the amplifying means may amplify the signal proportional to the vibrational velocity and the signal proportional to the vibrational acceleration and feed back the signals to the second voice-coil.

The vibrational information detecting means may retrieve, as the vibrational information, a signal proportional to a vibrational acceleration of a diaphragm of the speaker unit and generate a signal proportional to a vibrational velocity of the diaphragm by integrating the signal proportional to the vibrational acceleration; and the amplifying means may amplify the signal proportional to the vibrational velocity and the signal proportional to the vibrational acceleration and feed back the signals to the second voice coil.

The vibrational information detecting means may detect, as the vibrational information, a vibrational displacement, vibrational velocity and vibrational acceleration of a diaphragm of the speaker unit, so as to output a sum signal obtained by adding a signal indicating the vibrational displacement, a signal indicating the vibrational velocity and a signal indicating the vibrational acceleration.

The vibrational information detecting means may detect, as the vibrational information, a vibrational displacement and vibrational acceleration of a diaphragm of the speaker unit and generate a signal indicating a vibrational velocity by differentiating a signal indicating the vibrational displacement so as to output a sum signal obtained by adding the signal indicating the vibrational displacement, the signal indicating the vibrational velocity and a signal indicating the vibrational acceleration.

The vibrational information detecting means may detect, as the vibrational information, a vibrational displacement and vibrational acceleration of a diaphragm of the speaker unit and generate a signal indicating a vibrational velocity by integrating a signal indicating the vibrational acceleration so as to output a sum signal obtained by adding the signal indicating a vibrational displacement, the signal indicating the vibrational velocity and the signal indicating the vibrational acceleration.

The vibrational information detecting means may detect, as the vibrational information, a vibrational displacement and vibrational velocity of a diaphragm of the speaker unit and generate a signal indicating a vibrational acceleration by differentiating a signal indicating the vibrational velocity so as to output a sum signal obtained by adding the signal indicating a vibrational displacement, the signal indicating the vibrational velocity and the signal indicating the vibrational acceleration.

The vibrational information detecting means may detect, as the vibrational information, a vibrational displacement and vibrational velocity of a diaphragm of the speaker unit and generate a signal indicating a vibrational acceleration by differentiating a signal indicating the vibrational displacement so as to output a sum signal obtained by adding the signal indicating the vibrational displacement, a signal indicating the vibrational velocity and the signal indicating the vibrational acceleration.

The vibrational information detecting means may detect, as the vibrational information, a vibrational velocity and vibrational acceleration of a diaphragm of the speaker unit and generate a signal indicating a vibrational displacement by integrating a signal indicating the vibrational velocity so as to output a sum signal obtained by adding the signal indicating the vibrational displacement, the signal indicating the vibrational velocity and a signal indicating the vibrational acceleration.

The vibrational information detecting means may detect, as the vibrational information, a vibrational velocity and vibrational acceleration of a diaphragm of the speaker unit and generates a signal indicating a vibrational displacement by integrating a signal indicating the vibrational acceleration so as to output a sum signal obtained by adding the signal indicating the vibrational displacement, a signal indicating the vibrational velocity and the signal indicating the vibrational acceleration.

The vibrational information detecting means may detect, as the vibrational information, a vibrational displacement of a diaphragm of the speaker unit and generate a signal indicating a vibrational velocity and a signal indicating a vibrational acceleration by integrating a signal indicating the vibrational displacement so as to output a sum signal obtained by adding the signal indicating the vibrational displacement, the signal indicating the vibrational velocity and the signal indicating the vibrational acceleration.

The vibrational information detecting means may detect, as the vibrational information, a vibrational velocity of a diaphragm of the speaker unit, generate a signal indicating a vibrational displacement by integrating a signal indicating the vibrational velocity and generate a signal indicating a vibrational acceleration by differentiating a signal indicating the vibrational displacement so as to output a sum signal obtained by adding the signal indicating the vibrational displacement, the signal indicating the vibrational velocity and the signal indicating the vibrational acceleration.

The vibrational information detecting means may detect, as the vibrational information, a vibrational acceleration of a diaphragm of the speaker unit and generate a signal indicating a vibrational displacement and a signal indicating a vibrational velocity by integrating a signal indicating the vibrational acceleration so as to output a sum signal obtained by adding the signal indicating the vibrational displacement, the signal indicating the vibrational velocity and a signal indicating the vibrational acceleration.

The vibration information detecting means may adjust the level of a signal indicating the vibrational displacement.

The vibration information detecting means may adjust the level of a signal indicating the vibrational velocity.

The vibration information detecting means may adjust the level of a signal indicating the vibrational acceleration.

BRIEF DESCRIPTION OF THE DRAWINGS

Other objects and further features of the present invention will be apparent from the following detailed description when read in conjunction with the accompanying drawings, in which.

DETAILED DESCRIPTION OF THE PREFERRED EMBODIMENTS

Embodiment 1

Figure 1:
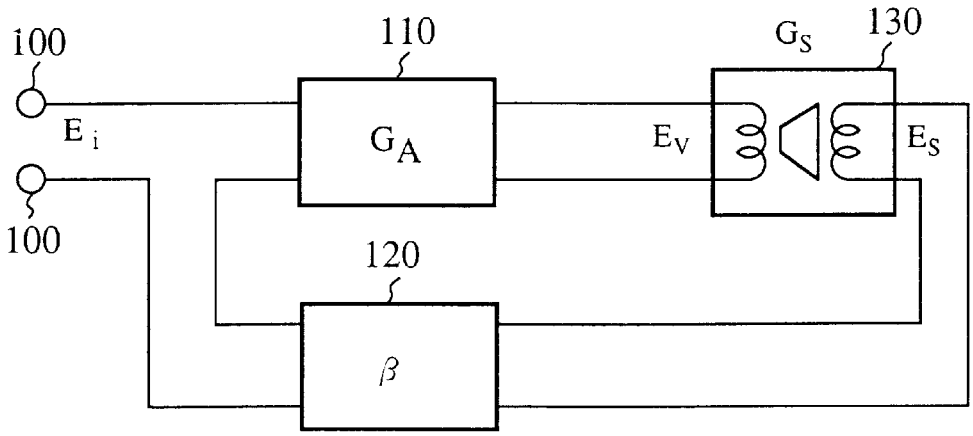
FIG.1 (PRIOR ART)
FIG. 1 shows the construction of the related-art MFB speaker system.
Figure 3:
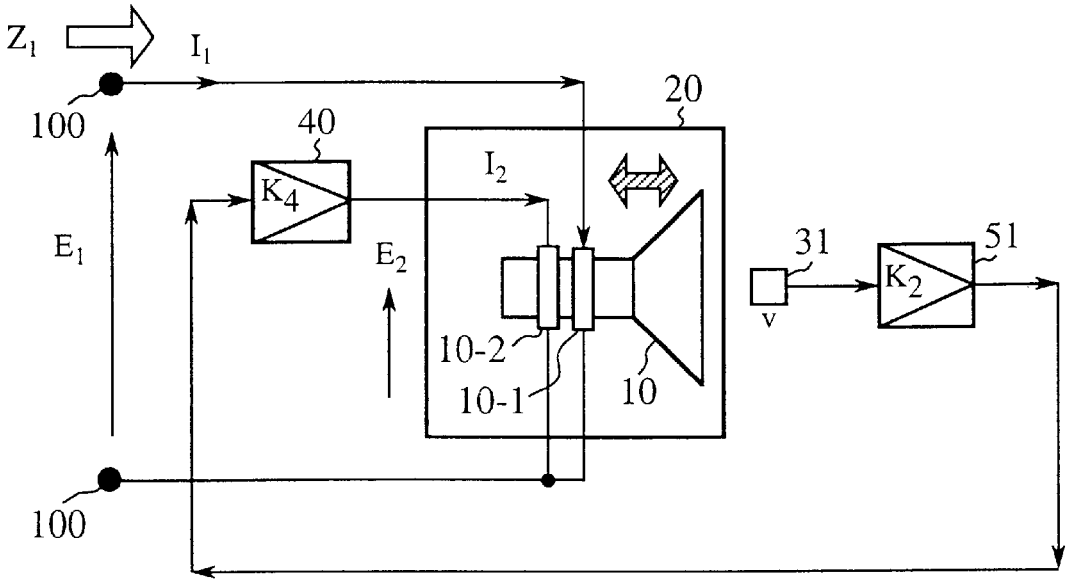
FIG. 3 shows the construction of the MFB speaker system according to a first embodiment.
Figure 2A:
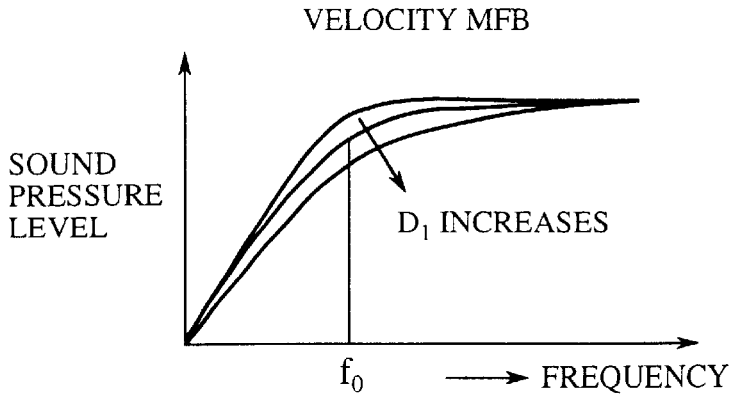
FIG.2A (PRIOR ART)
FIGS. 2A–2C are graphs showing the characteristics of the related-art speaker system.
Figure 2B:
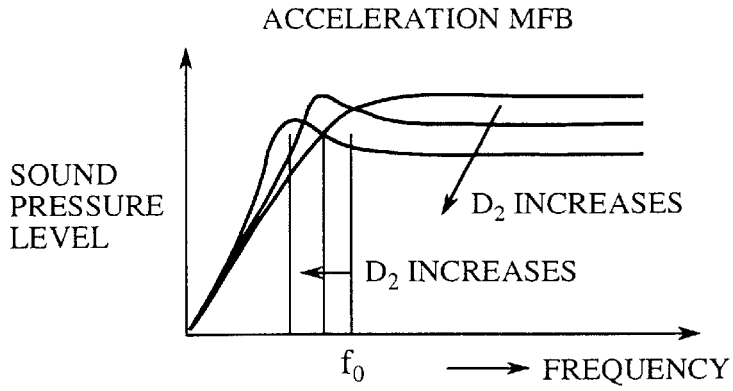
FIG.2B (PRIOR ART)
Figure 2C:
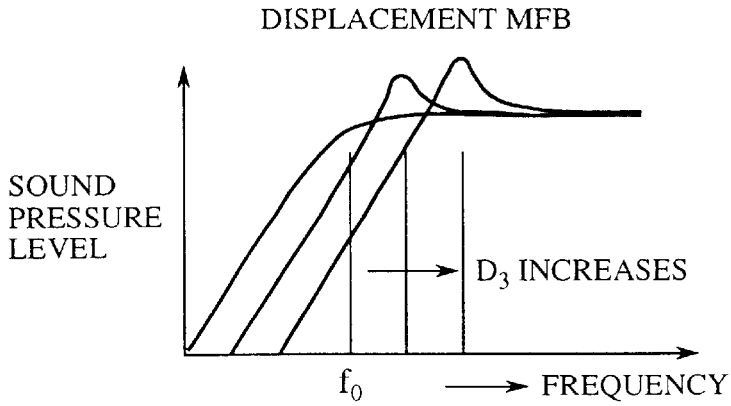
FIG.2C (PRIOR ART)

FIG. 3 shows the construction of the MFB speaker system according to the first embodiment.

In FIG. 3, numeral 10 indicates a speaker unit, 10-1 indicates a first voice coil of the speaker unit 10 and 10-2 indicates a second voice coil of the speaker unit 10. The speaker unit 10 is of the double voice coil type in which one unit has two voice coils.

Numeral 20 indicates a cabinet, 31 indicates a detecting means for detecting the vibrational velocity v of the speaker unit 10, 51 indicates an amplifier for amplifying a signal proportional to the vibrational velocity v, 40 indicates a power amplifier for driving the second voice coil 10-2 and 100 indicates an input terminal. Symbols $E_1$, $I_1$ and $Z_1$ indicate an input voltage of the speaker, an input current of the speaker and input impedance of the speaker, respectively. Symbols $E_2$ and $I_2$ indicate an input voltage applied to the second voice coil and an input current applied thereto, respectively. Symbol v indicates vibrational velocity of the speaker unit 10. Symbols $K_2$ and $K_4$ indicate the gain of the respective amplifiers. The amplifier 51 and the power amplifier 40 constitute amplifying means as claimed.

A description will now be given of the operation.

It is assumed that an externally input acoustic signal is directly applied to the first voice coil 10-1 of the speaker unit 10. That is, it is assumed, for instance, that the signal is input from the amplifier in the user's possession. When this signal is input, the diaphragm of the speaker unit 10 vibrates and vibration information including vibrational velocity v is generated. The vibrational velocity v is detected by the detecting means 31, and the signal proportional to the detected vibrational velocity v is amplified by the amplifiers 51 and 40 before being supplied to the second voice coil 10-2 with a positive or negative polarity with respect to the first voice coil 10-1.

When the signal is supplied with a positive polarity (positive feedback), a voltage proportional to the vibrational velocity v is supplied to the second voice coil 10-2. This is equivalent to a decrease of the mechanical resistance of the mechanical equivalent circuit from the perspective of the first voice coil 10-1. In case of a negative polarity (negative feedback), the voltage proportional to the vibrational velocity v is supplied to the second voice coil 10-2 with a negative polarity. This is equivalent to an increase of the mechanical resistance of the mechanical equivalent circuit from the perspective of the first voice coil 10-1.

Figure 4:
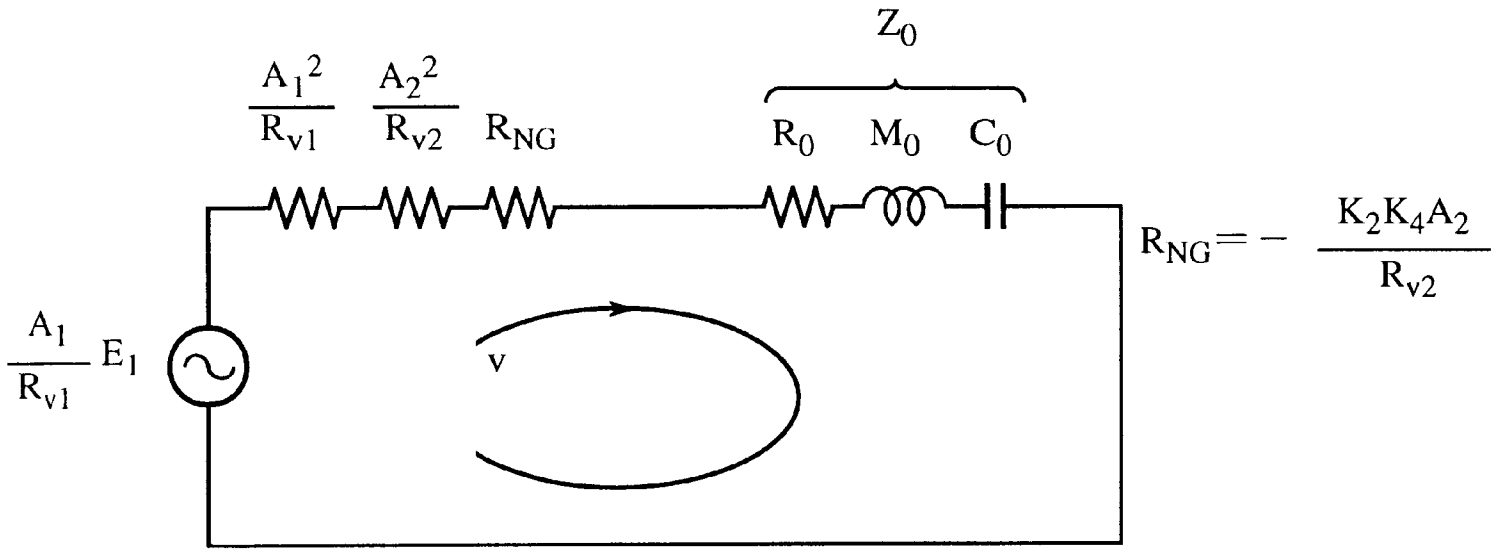
FIG. 4 is a circuit diagram showing a mechanical equivalent circuit from the perspective of a first voice coil when the speaker system according to the first embodiment is used in a positive feedback setup.

FIG. 4 is a circuit diagram showing a mechanical equivalent circuit from the perspective of the first voice coil 10-1 when the speaker system with the construction shown in FIG. 3 is used in a positive feedback setup. Referring to FIG. 4, $R_{v1}$ and $R_{v2}$ indicate resistance of the first and second voice coils, respectively. $A_1$ and $A_2$ indicate a force factor of the first and second voice coils,-respectively. $Z_0$ indicates mechanical impedance of the speaker unit 10. $R_o$, $M_o$, and $C_o$ indicate equivalent mechanical resistance of the speaker unit, equivalent mass thereof and equivalent mechanical compliance thereof, respectively. $R_{NG}$ indicates negative equivalent mechanical resistance generated as a result of introducing the second voice coil. Referring to FIG. 4, the negative mechanical resistance $R_{NG}$ varies with the gains $K_2$ and $K_4$ of the respective amplifiers. That is, when the feedback rate for the second voice coil is increased, the negative mechanical resistance $R_{NG}$ is increased in a negative direction so that the mechanical resistance of the speaker system is decreased. When the mechanical resistance is decreased, $Q_0$ of the mechanical equivalent circuit of the series resonance type is increased.

Although FIG. 4 shows the mechanical equivalent circuit for a positive feedback, the same circuit construction applies to a negative feedback. In a negative feedback, however, the negative equivalent mechanical resistance $R_{NG}$ changes to a positive value and the speaker system operates in the same manner as the related-art velocity MFB system.

Thus, in the MFB speaker system according to the first embodiment, a double voice coil speaker unit is used and a dedicated amplifier which amplifies only the vibrational velocity v is used in the system so that the function to drive the speaker unit is separated from the speaker system. Therefore, the user may couple an amplifier in his or her possession directly with the MFB speaker system and use any amplifier to drive the speaker unit.

Embodiment 2

Figure 5:
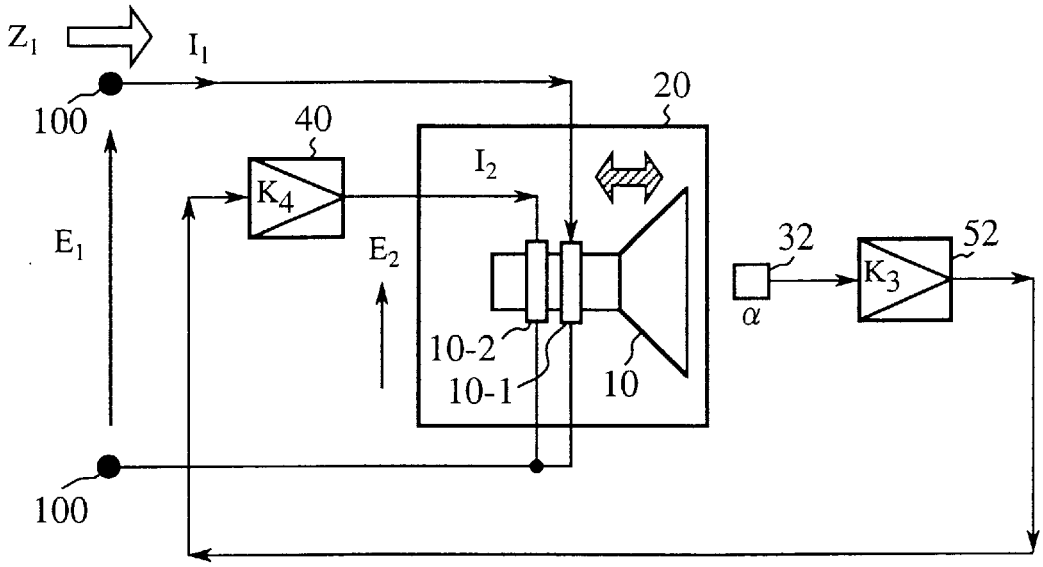
FIG. 5 shows the construction of the MFB speaker system according to a second embodiment.

FIG. 5 shows the construction of the MFB speaker system according to the second embodiment. Referring to FIG. 5, numeral 32 indicates a detecting means for detecting the vibrational acceleration $\alpha$ of the speaker unit 10, 52 indicates an amplifier for amplifying a signal proportional to the vibrational acceleration $\alpha$ and symbol $K_3$ indicates a gain of the amplifier. Like numerals and symbols represent like components in FIG. 3 and the description thereof is omitted. The amplifier 52 and the power amplifier 40 constitute amplifying means as claimed.

A description will now be given of the operation.

It is assumed that a signal is applied from a user's amplifier to the first voice coil 10-1 of the speaker unit 10. When this signal is input, the diaphragm of the speaker unit 10 vibrates and vibration information including vibrational acceleration $\alpha$ is generated. The vibrational acceleration $\alpha$ is detected by the detecting means 32, and the signal proportional to the detected vibrational acceleration $\alpha$ is amplified by the amplifiers 52 and 40 before being supplied to the second voice coil 10-2 with a positive or negative polarity with respect to the first voice coil 10-1. When the signal is supplied using a positive feedback, the voltage proportional to the vibrational acceleration $\alpha$ is supplied to the second voice coil 10-2. This is equivalent to a decrease of the equivalent mass of the mechanical equivalent circuit from the perspective of the first voice coil 10-1.

In case of a negative feedback, the voltage proportional to the vibrational acceleration $\alpha$ is supplied to the second voice coil 10-2 with a negative polarity. This is equivalent to an increase of the mechanical resistance of the mechanical equivalent circuit from the perspective of the first voice coil 10-1.

Figure 6:
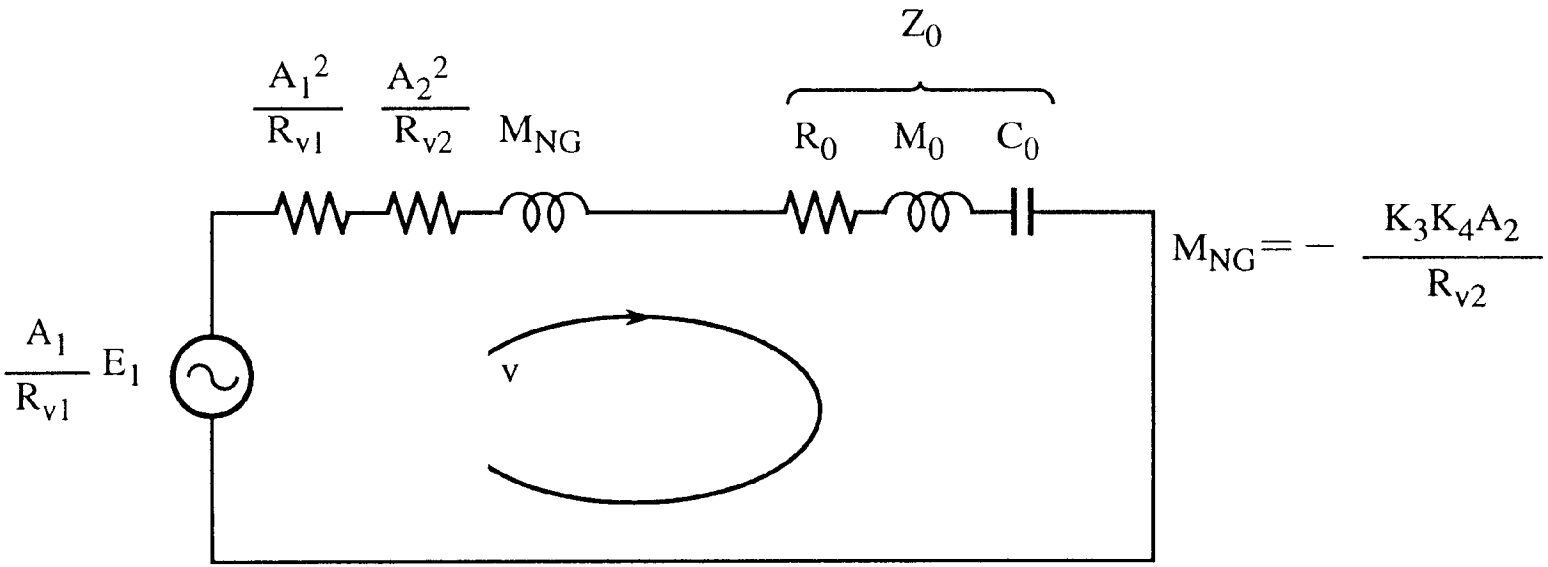
FIG. 6 is a circuit diagram showing a mechanical equivalent circuit from the perspective of a first voice coil when the speaker system according to the second embodiment is used in a positive feedback setup.

FIG. 6 is a circuit diagram showing a mechanical equivalent circuit from the perspective of the first voice coil 10-1 when the speaker system with the construction shown in FIG. 5 is used in a positive feedback setup.

Referring to FIG. 6, $M_{NG}$ indicates negative equivalent mass generated as a result of introducing the second voice coil. Like numerals and symbols represent like components of FIG. 4 and the description thereof is omitted.

Referring to FIG. 6, the negative equivalent mass $M_{NG}$ varies with the gains $K_3$ and $K_4$ of the respective amplifiers. That is, when the feedback rate for the second voice coil 10-2 is increased, the negative equivalent mass $M_{NG}$ is increased in a negative direction so that the equivalent mass of the speaker system is decreased. When the equivalent mass is decreased, $Q_0$ of the mechanical equivalent circuit of the series resonance type shown in FIG. 5 is decreased so that the sound pressure of the speaker is increased.

Although FIG. 6 shows the mechanical equivalent circuit for a positive feedback, the same circuit construction applies to a negative feedback. In a negative feedback, however, the negative equivalent mass MNC changes to a positive value and the speaker system operates in the same manner as the related-art acceleration MFB system. Thus, in the MFB speaker system according to the second embodiment, a double voice coil speaker unit is used and a dedicated amplifier which amplifies only the vibrational acceleration $\alpha$ is used in the system so that the function to drive the speaker unit is separated from the speaker system.

Therefore, the user may couple an amplifier in his or her possession directly with the MFB speaker system and use any amplifier to drive the speaker unit.

Embodiment 3

Figure 7:
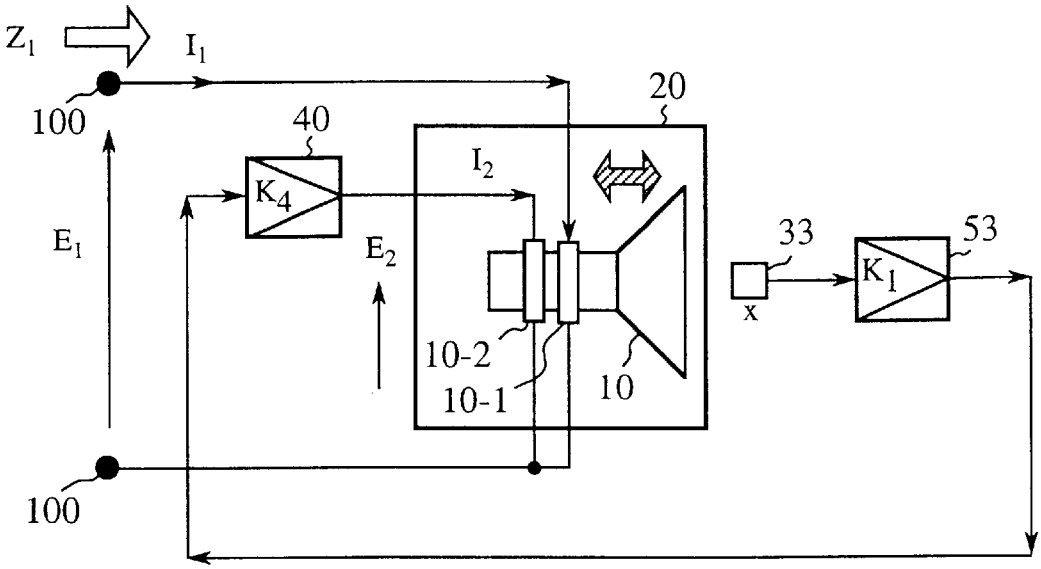
FIG. 7 shows the construction of the MFB speaker system according to a third embodiment.

FIG. 7 shows the construction of the MFB speaker system according to the third embodiment.

Referring to FIG. 7, numeral 33 indicates a detecting means for detecting the vibrational displacement x of the speaker unit 10, 53 indicates an amplifier for amplifying a signal proportional to the vibrational displacement x and symbol $k_1$ indicates a gain of the amplifier. Like numerals and symbols represent like components in FIG. 3 and the description thereof is omitted. The amplifier 53 and the power amplifier 40 constitute amplifying means as claimed.

A description will now be given of the operation.

It is assumed that a signal is applied from a user's amplifier to the first voice coil 10-1 of the speaker unit 10. When this signal is input, the diaphragm of the speaker unit 10 vibrates and vibration information including vibrational displacement x is generated. The vibrational displacement x is detected by the detecting means 33, and the signal proportional to the detected vibrational displacement x is amplified by the amplifiers 53 and 40 before being supplied to the second voice coil 10-2 with a positive or negative polarity with respect to the first voice coil 10-1. When the signal is supplied using a positive feedback, the voltage proportional to the vibrational displacement x is supplied to the second voice coil 10-2. This is equivalent to an increase of the equivalent compliance of the mechanical equivalent circuit from the perspective of the first voice coil 10-1.

In case of a negative feedback, the voltage proportional to the vibrational displacement x is supplied to the second voice coil 10-2 with a negative polarity. This is equivalent to a decrease of the equivalent compliance of the mechanical equivalent circuit from the perspective of the first voice coil 10-1.

Figure 8:
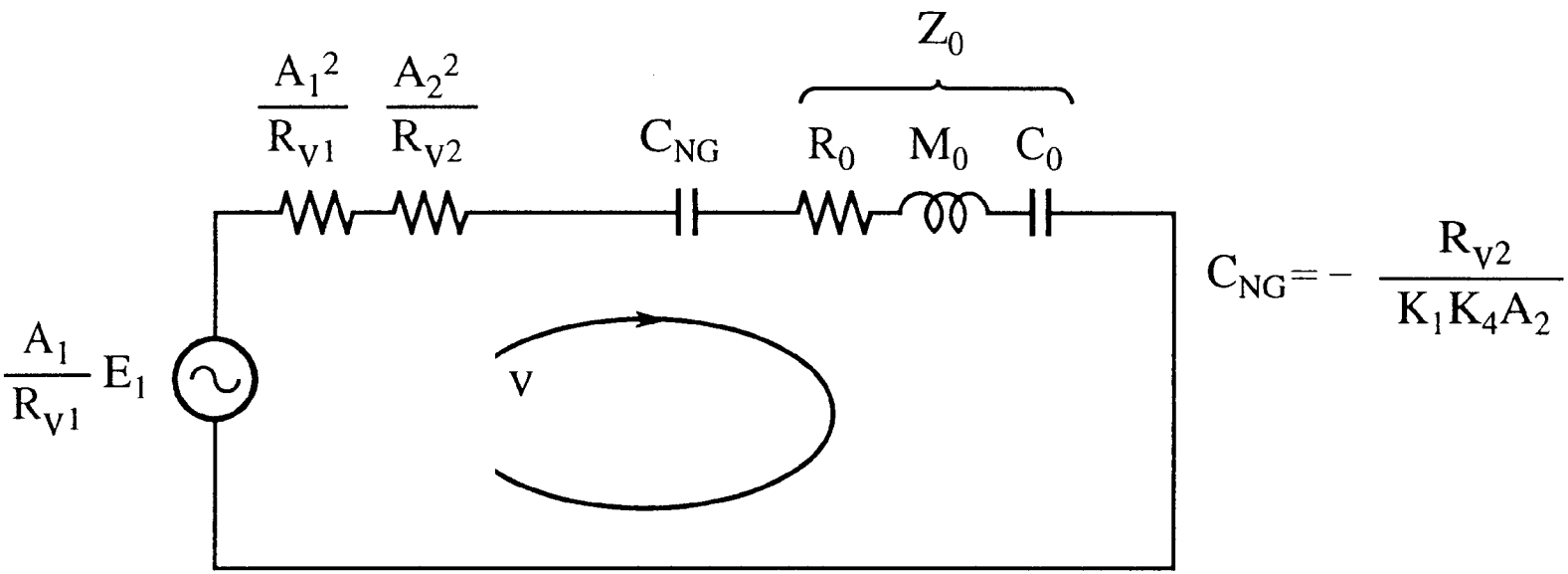
FIG. 8 is a circuit diagram showing a mechanical equivalent circuit from the perspective of a first voice coil when the speaker system according to the third embodiment is used in a positive feedback setup.

FIG. 8 is a circuit diagram showing a mechanical equivalent circuit from the perspective of the first voice coil 10-1 when the speaker system with the construction shown in FIG. 7 is used in a positive feedback setup. Referring to FIG. 8, $C_{NG}$ indicates negative equivalent compliance generated as a result of introducing the second voice coil 10-2. Like numerals and symbols represent like components of FIG. 4 and the description thereof is omitted.

Referring to FIG. 8, the negative compliance $C_{NG}$ varies with the gains $k_1$ and $K_4$ of the respective amplifiers. That is, when the feedback rate for the second voice coil 10-2 is increased, the negative equivalent compliance $C_{NG}$ approaches zero from negative infinity so that the equivalent compliance of the speaker system is increased. When the equivalent mass is decreased, $Q_0$ of the mechanical equivalent circuit of the series resonance type shown in FIG. 8 is decreased so that the lowest resonance frequency of the speaker is increased.

Although FIG. 8 shows the mechanical equivalent circuit for a positive feedback, the same circuit construction applies to a negative feedback. In a negative feedback, however, the negative equivalent compliance $C_{NG}$ changes to a positive value and the speaker system operates in the same manner as the related-art acceleration MFB system.

Thus, in the MFB speaker system according to the third embodiment, a double voice coil speaker unit is used and a dedicated amplifier which amplifies only the vibrational displacement x is used in the system so that the function to drive the speaker unit is separated from the speaker system. Therefore, the user may couple an amplifier in his or her possession directly with the MFB speaker system and use any amplifier to drive the speaker unit.

Embodiment 4

Figure 9:
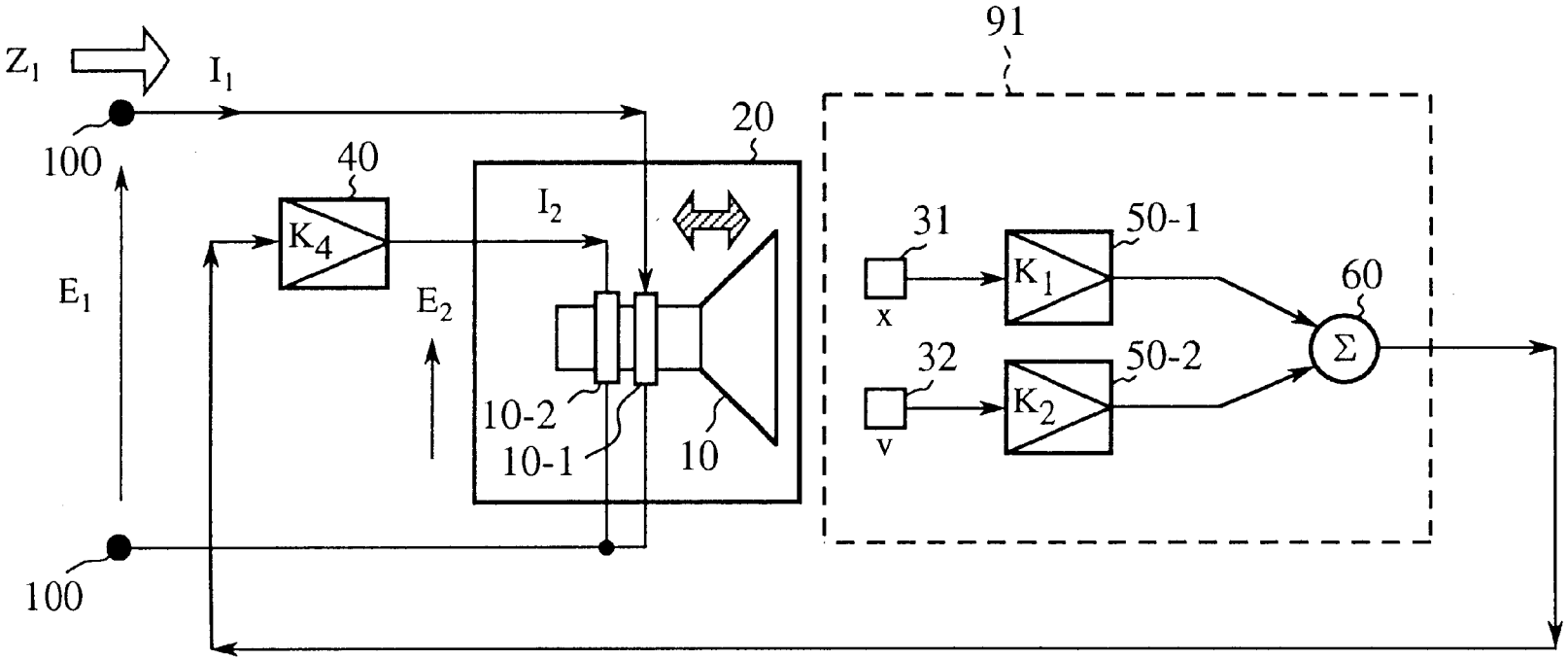
FIG. 9 shows the construction of the MFB speaker system according to a fourth embodiment.

FIG. 9 shows the construction of the MFB speaker system according to the fourth embodiment. In FIG. 9, numeral 10 indicates a speaker unit, 10-1 indicates a first voice coil of the speaker unit 10 and 10-2 indicates a second voice coil of the speaker unit 10. The speaker unit 10 is of the double voice coil type in which one unit has two voice coils.

Referring to FIG. 9, numeral 20 indicates a cabinet, 31 indicates a vibrational displacement detecting means for detecting the vibrational displacement x of the speaker unit 10, 32 indicates a vibrational velocity detecting means for detecting the vibrational velocity v of the speaker unit 10, 50-1 indicates an amplifier with a gain of $k_1$ for amplifying the signal indicating the vibration displacement x from the vibrational displacement detecting means 31, 50-2 indicates an amplifier with a gain of $K_2$ for amplifying the signal indicating the vibrational velocity v from the vibrational velocity detecting means 32 and 60 indicates an adder for generating a sum signal in which the signals from the amplifiers 50-1 and 50-2 are added.

In this embodiment, the vibrational displacement detecting means 31, the vibrational velocity detecting means 32, the amplifiers 50-1, 50-2 and the adder 60 constitute a vibration information detecting means 91 of the speaker unit 10.

Referring to FIG. 9, numeral 40 indicates a power amplifier (amplifying means) with a gain $K_4$ for amplifying the sum signal from adder 60 and driving the second voice coil 10-2, 100 indicates an input terminal for inputting an acoustic signal, $E_1$ and $I_1$ indicate an input voltage and an input current, respectively, of the speaker unit 10, $Z_1$ indicates an input impedance of the speaker unit 10, and $E_2$ and $I_2$ indicate an input voltage and an input current supplied to the second voice coil 10-2.

A description will now be given of the operation.

For example, when an acoustic signal amplified using the power amplifier in the user's possession is input directly, via the input terminal 100, to the first voice coil 10-1 of the speaker unit 10 with the input voltage $E_1$, the diaphragm of the speaker unit 10 vibrates, the vibrational displacement detecting means 31 outputs the signal indicating the vibrational displacement x as vibration information, and the vibrational velocity detecting means 32 outputs the signal indicating the vibrational velocity v as vibration information.

The signal indicating the vibrational displacement x and the signal indicating the vibrational velocity v are amplified by the amplifier 50-1 and the amplifier 50-2, respectively, to an appropriate level and are added by the adder 60. That is, the signal proportional to the vibrational displacement x and the signal proportional to the vibrational velocity v are added and output from the vibration information detecting means 91 as a sum signal. After being amplified by the power amplifier 40, the sum signal is supplied to the second voice coil 10-2 with a positive or negative polarity with respect-to the first voice coil 10-1.

When the signal is supplied with a positive polarity, a positive feedback is set up so that the input voltage $E_2$ proportional to the vibrational displacement x and the vibrational velocity v is supplied to the second voice coil 10-2. From the perspective of the first voice coil 10-1, this is equivalent to an increase of the equivalent compliance and a decrease of the equivalent mechanical resistance in the mechanical equivalent circuit of the entire system.

When the signal is supplied with a negative polarity, a negative feedback is set up so that the input voltage $E_2$ proportional to the vibrational displacement x and vibrational velocity v is supplied to the second voice coil 10-2 with a negative polarity. From the perspective of the first voice coil 10-1, this is equivalent to a decrease of the equivalent compliance and an increase of the equivalent mechanical resistance in the mechanical equivalent circuit of the entire system.

Figure 10:
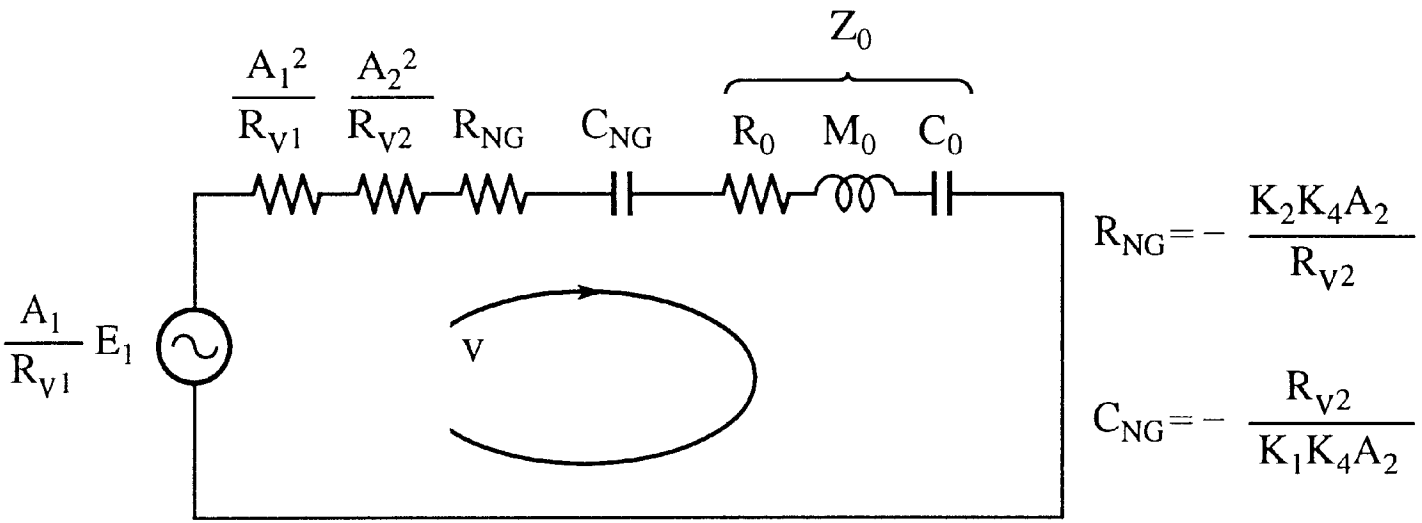
FIG. 10 is a circuit diagram showing a mechanical equivalent circuit of the MFB speaker system according to the fourth embodiment.

FIG. 10 is a circuit diagram showing a mechanical equivalent circuit of the MFB speaker system according to the fourth embodiment. Referring to FIG. 10, symbols $Rv_1$ and $R_{v2}$ respectively indicate resistance of the first and second voice coils, $A_1$ and $A_2$ respectively indicate force factors of the first and second voice coils, $Z_o$ indicates mechanical impedance of the speaker unit 10, $R_0$, $M_0$ and $C_0$ indicate equivalent mechanical resistance, equivalent mechanical mass and equivalent mechanical compliance, respectively, of the speaker unit 10. $E_1$ indicates an input voltage of the first voice coil 10-1, v indicates vibrational velocity, $R_{NG}$ and $C_{NG}$ indicate negative equivalent mechanical resistance and negative mechanical compliance, respectively, generated as a result of introducing the second voice coil 10-2 and positively feeding back the signal proportional to the vibrational velocity v and the signal proportional to the vibration displacement x.

The negative equivalent mechanical resistance $R_{NG}$ and the negative equivalent mechanical compliance $C_{NG}$ are given by the following expressions (1) and (2).

$$R_{NG}=-(K_2K_4A_2)/R_{v2} \quad (1)$$

$$C_{NG}=-R_{v2}/(k_1K_4A_2) \quad (2)$$

As demonstrated by the expression (1) above, the negative equivalent mechanical resistance $R_{NG}$ varies with the gains $K_2$ and $K_4$ of the amplifiers for amplifying the signal indicating the vibrational velocity v. As demonstrated by the expression (1) above, the negative equivalent mechanical compliance $C_{NG}$ varies with the gains $k_1$ and $K_4$ of the amplifiers for amplifying the signal indicating the vibrational displacement x.

That is, if the feedback to the second voice coil 10-2 is increased, the negative equivalent mechanical resistance $R_{NG}$ is increased and the negative equivalent mechanical compliance $C_{NG}$ is decreased. Consequently, the equivalent mechanical resistance is decreased and the equivalent mechanical compliance is increased from the perspective of the entire speaker system. When the positive feedback is used, the feedback rate is adjusted in the mechanical equivalent circuit shown in FIG. 10 so that neither the entire equivalent mechanical resistance nor equivalent mechanical compliance becomes negative, thus preventing oscillation of the MFB speaker system.

When the positive feedback as shown in the FIG. 10 is used, $Q_0$ and the lowest resonance frequency $f_0$ are given by the following expressions (3) and (4).

$$f_0 = \frac{1}{2\pi}\sqrt{\frac{1}{M_0C}} = \frac{1}{2\pi}\sqrt{\frac{1}{M_0}\left(\frac{1}{C_{NG}}+\frac{1}{C_0}\right)} \quad (3)$$

$$Q_0=2\pi f_0M_0/R_{me} \quad (4)$$

where $R_{me}$ indicates the equivalent mechanical resistance of the mechanical equivalent circuit as a whole. If the feedback to the second voice coil 10-2 is increased, the negative equivalent mechanical compliance $C_{NG}$ is decreased so that the lowest resonance frequency $f_0$ in the expression (3) above drops. Since $Q_0$ in the expression (4) above varies with $f_0$ and $R_{me}$, it varies with the feedback rate of the signal indicating the vibrational displacement x and the signal indicating the vibrational velocity v.

Although FIG. 10 shows the mechanical equivalent circuit for a positive feedback, the same circuit construction applies to a negative feedback. In a negative feedback, the negative equivalent mechanical resistance $R_{NG}$ and the negative equivalent mechanical compliance $C_{NG}$ change to a positive value and the speaker system operates as a combination of the related-art velocity MFB system and acceleration MFB system.

Thus, according to the fourth embodiment, the speaker unit 10 of the double voice coil type having the first and second voice coils 10-1 and 10-2 is used, the sum signal composed of the signals respectively proportional to the vibrational displacement x and vibrational velocity v is amplified by the power amplifier 40 and is input to the second voice coil 10-2, while the acoustic signal is amplified by an external power amplifier and input directly to the first voice coil 10-1. Therefore, the user can use a power amplifier in his or her possession or use an amplifier of his or her own choice.

Embodiment 5

Figure 11:
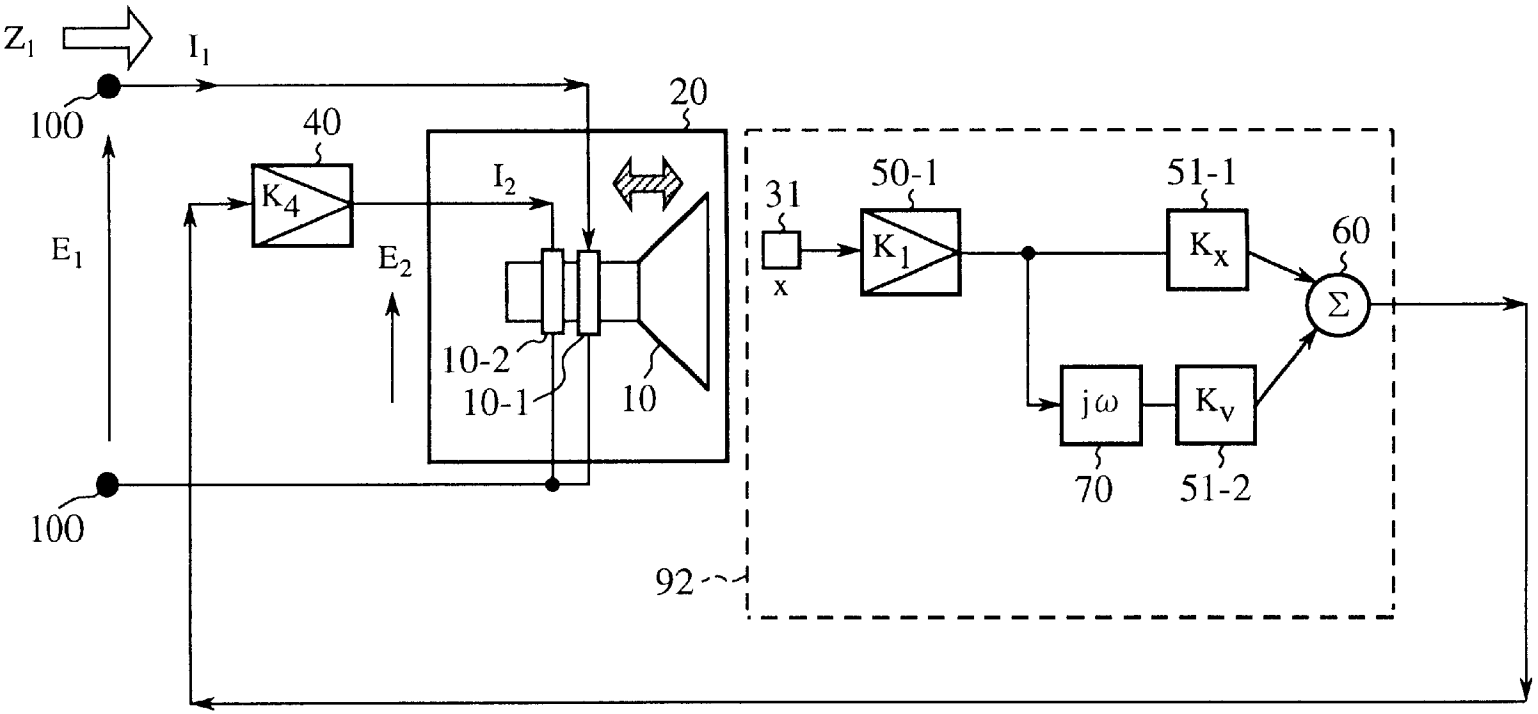
FIG. 11 shows the construction of the MFB speaker system according to a fifth embodiment.

FIG. 11 shows the construction of the MFB speaker system according to the fifth embodiment. Referring to FIG. 11, numeral 51-1 indicates a signal level adjusting means with a gain $k_x$ for adjusting the signal indicating the vibrational displacement x from the amplifier 50-1, 70 indicates a differentiator for differentiating the signal indicating the vibrational displacement x from the amplifier 50-1 and generating the signal indicating the vibrational velocity v, and 51-2 indicates a signal level adjusting means with a gain $k_v$ for adjusting the signal indicating the vibrational velocity v from the differentiator 70. The other aspects of the construction are identical to those shown in FIG. 9 of the fourth embodiment except that the vibrational velocity detecting means 32 and the amplifier 50-2 are eliminated.

In this embodiment, the vibrational displacement detecting means 31, the amplifier 50-1, the differentiator 70, the signal level adjusting means 51-1, 51-2 and the adder 60 constitute a vibration information detecting means 92 of the speaker unit 10.

A description will now be given of the operation.

For example, when an acoustic signal amplified using the power amplifier in the user's possession is input directly, via the input terminal 100, to the first voice coil 10-1 of the speaker unit 10 with the input voltage $E_1$, the diaphragm of the speaker unit 10 vibrates and the vibrational displacement detecting means 31 outputs the signal indicating the vibrational displacement x as vibration information. The signal is then amplified by the amplifier 50-1 to an appropriate level and diverged into two individual signals. One of the diverged vibrational displacement signals is subject to level adjustment by the signal level adjusting means 51-1 and input to the adder 60.

The other vibrational displacement signal is converted into the signal indicating the vibrational velocity v by the differentiator 70 and subject to level adjustment by the signal level adjusting means 51-2 before being input to the adder 60. The signal indicating the vibrational displacement x and the signal indicating the vibrational velocity v are added by the adder 60 and output therefrom. That is, the signal proportional to the vibrational displacement x and the signal proportional to the vibrational velocity v are added and output from the vibration information detecting means 92 as a sum signal. After being amplified by the power amplifier 40, the sum signal is supplied to the second voice coil 10-2 with a positive or negative polarity with respect to the first voice coil 10-1.

When the signal is supplied with a positive polarity, a positive feedback is set up so that the input voltage $E_2$ proportional to the vibrational displacement x and vibrational velocity v is supplied to the second voice coil 10-2. From the perspective of the first voice coil 10-1, this is equivalent to an increase of the equivalent compliance and a decrease of the equivalent mechanical resistance in the mechanical equivalent circuit of the entire system.

When the signal is supplied with a negative polarity, a negative feedback is set up so that the input voltage $E_2$ proportional to the vibrational displacement x and vibrational velocity v is supplied to the second voice coil 10-2 with a negative polarity. From the perspective of the first voice coil 10-1, this is equivalent to a decrease of the equivalent compliance and an increase of the equivalent mechanical resistance in the mechanical equivalent circuit of the entire system.

The mechanical equivalent circuit of the MFB speaker system of FIG. 11 and the operation thereof are generally the same as disclosed in FIG. 10 except that the gain k, of the amplifier is replaced by the product of $k_1$ and $k_x$ and the gain $K_2$ is replaced by the product of $k_1$ and $k_v$ in FIG. 10.

The negative equivalent mechanical compliance $C_{NG}$ changes with a change in the amplifier 50-1 for amplifying the signal indicating the vibrational displacement x and in the signal level adjusting means 51-1. Consequentially, the negative equivalent mechanical resistance $R_{NG}$ changes with a change in the amplifier 50-1 for amplifying the signal indicating the vibrational velocity v and in the signal level adjusting means 51-2.

That is, when the gain is adjusted so as to increase the feedback to the second voice coil 10-2, the negative equivalent mechanical resistance $R_{NG}$ is increased and the negative equivalent mechanical compliance $C_{NG}$ is decreased, as demonstrated by the expression (1) above. Consequently, the equivalent mechanical resistance is decreased and the equivalent mechanical compliance is increased from the perspective of the entire speaker system. When the positive feedback is used, the feedback rate is adjusted in the mechanical equivalent circuit shown in FIG. 10 so that neither the entire equivalent mechanical resistance nor equivalent mechanical compliance becomes negative, thus preventing oscillation of the MFB speaker system.

If the feedback to the second voice coil 10-2 is increased, the lowest resonance frequency $f_0$ drops as in the fourth embodiment and $Q_0$ varies with the feedback rate of the signal indicating the vibrational displacement x and the signal indicating the vibrational velocity v.

In the negative feedback, the mechanical equivalent circuit and the operation thereof are generally the same as disclosed in FIG. 10 except that the gain $k_1$ of the amplifier is replaced by the product of $k_1$ and $k_x$ and the gain $K_2$ is replaced by the product of $k_1$ and $k_v$. In the negative feedback, the negative equivalent mechanical resistance $R_{NG}$ and the negative equivalent mechanical compliance $C_{NG}$ change to a positive value and the speaker system operates as a combination of the related-art velocity MFB system and acceleration MFB system.

Thus, according to the fifth embodiment, the speaker unit 10 of the double voice coil type having the first and second voice coils 10-1 and 10-2 is used, the sum signal composed of the signals respectively proportional to the vibrational displacement x and vibrational velocity v is amplified by the power amplifier 40 and is input to the second voice coil 10-2, while the acoustic signal is amplified by an external power amplifier and input directly to the first voice coil 10-1. Therefore, the user can use a power amplifier in his or her possession or use an amplifier of his or her own choice.

Embodiment 6

Figure 12:
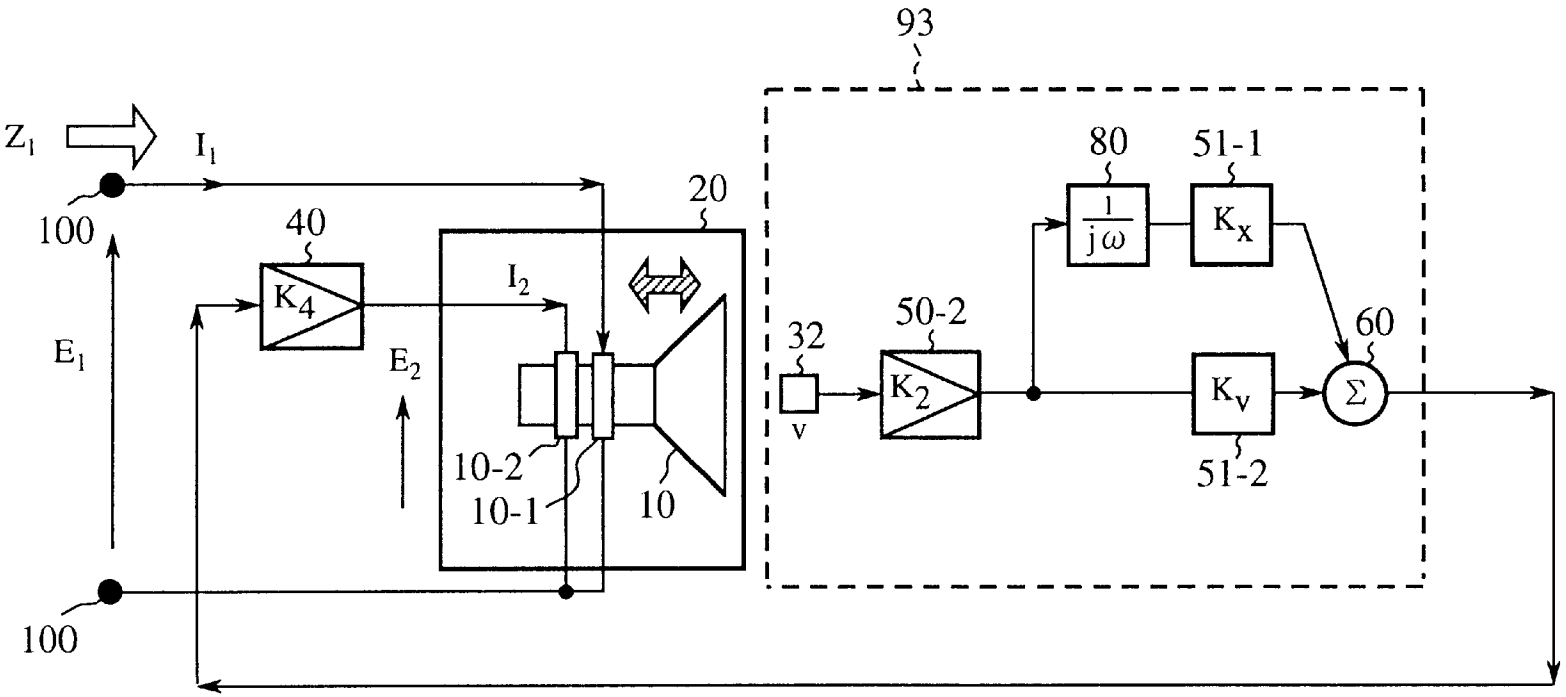
FIG. 12 shows the construction of the MFB speaker system according to a sixth embodiment.

FIG. 12 shows the construction of the MFB speaker system according to the sixth embodiment. Referring to FIG. 12, numeral 80 indicates an integrator for integrating the signal indicating the vibrational velocity v from the amplifier 50-2 and generating the signal indicating the vibrational displacement x, 51-1 indicates a signal level adjusting means with a gain $k_x$ for adjusting the signal indicating the vibrational displacement x from the integrator 80 and 51-2 indicates a signal level adjusting means with a gain $k_v$ for adjusting the signal indicating the vibrational velocity v from the amplifier 50-2. The other aspects of the construction are identical to those shown in FIG. 9 of the fourth embodiment except that the vibrational displacement detecting means 31 and the amplifier 50-1 are eliminated.

In this embodiment, the vibrational velocity detecting means 32, the amplifier 50-2, the integrator 80, the signal level adjusting means 51-1, 51-2 and the adder 60 constitute a vibration information detecting means 93 of the speaker unit 10.

A description will now be given of the operation.

For example, when an acoustic signal amplified using the power amplifier in the user's possession is input directly, via the input terminal 100, to the first voice coil 10-1 of the speaker unit 10 with the input voltage $E_1$, the diaphragm of the speaker unit 10 vibrates and the vibrational velocity detecting means 32 outputs the signal indicating the vibrational velocity v as vibration information. The signal is then amplified by the amplifier 50-2 to an appropriate level and diverged into two individual signals. One of the diverged vibrational velocity signals is subject to level adjustment by the signal level adjusting means 51-2 and input to the adder 60.

The other vibrational velocity signal is converted into the signal indicating the vibrational displacement x by the integrator 80 and subject to level adjustment by the signal level adjusting means 51-1 before being input to the adder 60. The signal indicating the vibrational displacement x and the signal indicating the vibrational velocity v are added by the adder 60 and output therefrom. That is, the signal proportional to the vibrational displacement x and the signal proportional to the vibrational velocity v are added and output from the vibration information detecting means 93 as a sum signal. After being amplified by the power amplifier 40, the sum signal is supplied to the second voice coil 10-2 with a positive or negative polarity with respect to the first voice coil 10-1.

When the signal is supplied with a positive polarity, a positive feedback is set up so that the input voltage $E_2$ proportional to the vibrational displacement x and vibrational velocity v is supplied to the second voice coil 10-2. From the perspective of the first voice coil 10-1, this is equivalent to an increase of the equivalent compliance and a decrease of the equivalent mechanical resistance in the mechanical equivalent circuit of the entire system.

When the signal is supplied with a negative polarity, a negative feedback is set up so that the input voltage $E_2$ proportional to the vibrational displacement x and vibrational velocity v is supplied to the second voice coil 10-2 with a negative polarity. From the perspective of the first voice coil 10-1, this is equivalent to a decrease of the equivalent compliance and an increase of the equivalent mechanical resistance in the mechanical equivalent circuit of the entire system.

The mechanical equivalent circuit of the MFB speaker system of FIG. 12 and the operation thereof are generally the same as disclosed in FIG. 10 except that the gain $k_1$ of the amplifier is replaced by the product of $K_2$ and $k_x$ and the gain $K_2$ is replaced by the product of $K_2$ and $k_v$ in FIG. 10.

The negative equivalent mechanical resistance $R_{NG}$ changes with a change in the amplifier 50-2 for amplifying the signal indicating the vibrational velocity v, in the signal level adjusting means 51-2 and in the power amplifier 40. Consequentially, the negative equivalent mechanical compliance $C_{NG}$ changes with a change in the amplifier 50-2 for amplifying the signal indicating the vibrational displacement x, in the signal level adjusting means 51-1 and in the power amplifier 40.

That is, when the gain is adjusted so as to increase the feedback to the second voice coil 10-2, the negative equivalent mechanical resistance $R_{NG}$ is increased, as demonstrated by the expression (1) above and the negative equivalent mechanical compliance $C_{NG}$ is decreased, as demonstrated by the expression (2) above. Consequently, the equivalent mechanical resistance is decreased and the equivalent mechanical compliance is increased from the perspective of the entire speaker system. When the positive feedback is used, the feedback rate is adjusted in the mechanical equivalent circuit shown in FIG. 10 so that neither the entire equivalent mechanical resistance nor equivalent mechanical compliance becomes negative, thus preventing oscillation of the MFB speaker system.

If the feedback to the second voice coil 10-2 is increased, the lowest resonance frequency $f_0$ drops as in the fourth embodiment and $Q_0$ varies with the feedback rate of the signal indicating the vibrational displacement x and the signal indicating the vibrational velocity v.

In the negative feedback, the mechanical equivalent circuit and the operation thereof are generally the same as disclosed in FIG. 10 except that the gain $k_1$ of the amplifier is replaced by the product of $K_2$ and $k_x$ and the gain $K_2$ is replaced by the product of $K_2$ and $k_v$. In the negative feedback, the negative equivalent mechanical resistance $R_{NG}$ and the negative equivalent mechanical compliance $C_{NG}$ change to a positive value and the speaker system operates as a combination of the related-art velocity MFB system and displacement MFB system.

Thus, according to the sixth embodiment, the speaker unit 10 of the double voice coil type having the first and second voice coils 10-1 and 10-2 is used, the sum signal composed of the signals respectively proportional to the vibrational displacement x and vibrational velocity v is amplified by the power amplifier 40 and is input to the second voice coil 10-2, while the acoustic signal is amplified by an external power amplifier and input directly to the first voice coil 10-1. Therefore, the user can use a power amplifier in his or her possession or use an amplifier of his or her own choice.

Embodiment 7

Figure 13:
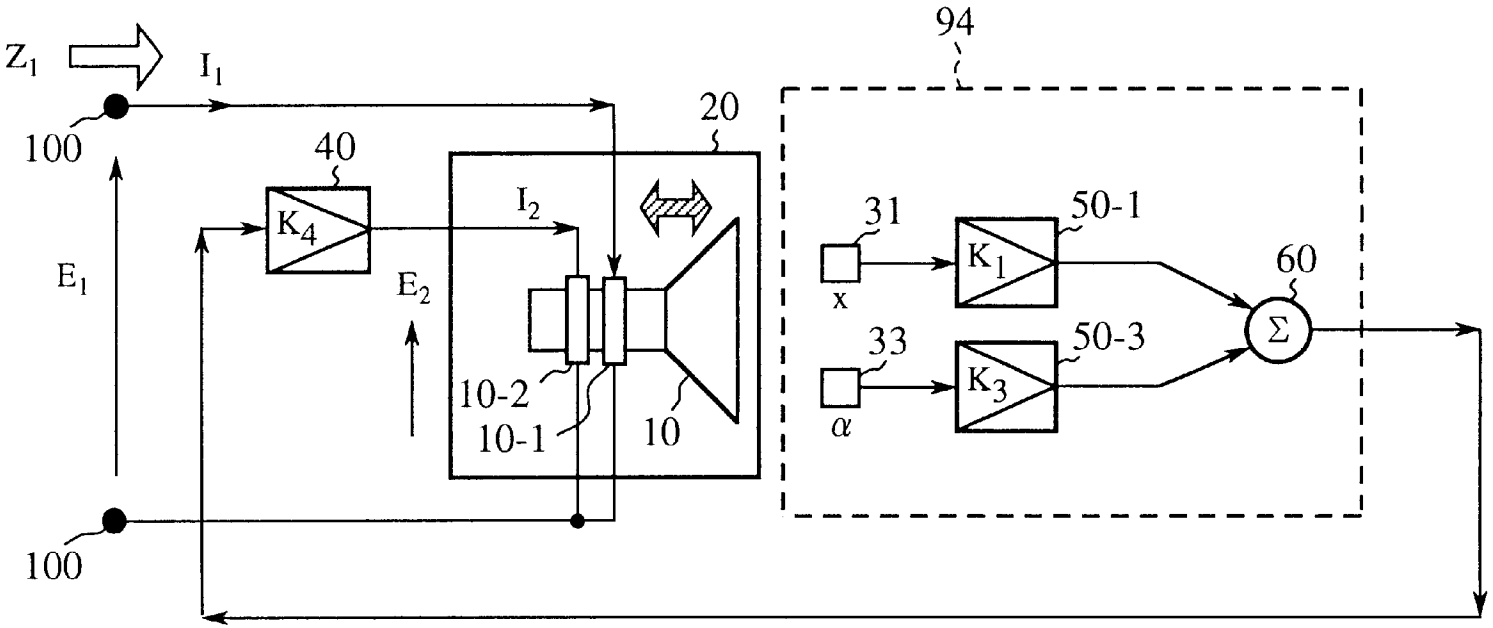
FIG. 13 shows the construction of the MFB speaker system according to a seventh embodiment.

FIG. 13 shows the construction of the MFB speaker system according to the seventh embodiment. Referring to FIG. 13, numeral 33 indicates a vibrational acceleration detecting means for detecting the vibrational acceleration α of the speaker unit 10 and 50-3 indicates an amplifier with a gain $K_3$ for amplifying the signal indicating the vibrational acceleration α from the vibrational acceleration detecting means 33. The other aspects of the construction are identical to those shown in FIG. 9 of the fourth embodiment except that the vibrational velocity detecting means 32 and the amplifier 50-2 are eliminated.

In this embodiment, the vibrational displacement detecting means 31, the vibrational acceleration detecting means 33, the amplifiers 50-1, 50-3 and the adder 60 constitute a vibration information detecting means 94 of the speaker unit 10.

A description will now be given of the operation.

For example, when an acoustic signal amplified using the power amplifier in the user's possession is input directly, via the input terminal 100, to the first voice coil 10-1 of the speaker unit 10 with the input voltage $E_1$, the diaphragm of the speaker unit 10 vibrates. The vibrational information available in this construction includes the signal indicating the vibrational displacement x output from the vibrational displacement detecting means 31 and the signal indicating the vibrational acceleration a output from the vibrational acceleration detecting means 33.

The signals are then amplified by the amplifiers 50-1 and 50-3 to an appropriate level and added by the adder 60 and output therefrom. That is, the signal proportional to the vibrational displacement x and the signal proportional to the vibrational acceleration α are added and output from the vibration information detecting means 94 as a sum signal. After being amplified by the power amplifier 40, the sum signal is supplied to the second voice coil 10-2 with a positive or negative polarity with respect to the first voice coil 10-1.

When the signal is supplied with a positive polarity, a positive feedback is set up so that the input voltage $E_2$ proportional to the vibrational displacement x and vibrational acceleration α is supplied to the second voice coil 10-2. From the perspective of the first voice coil 10-1, this is equivalent to an increase of the equivalent compliance and a decrease of the equivalent mechanical mass in the mechanical equivalent circuit of the entire system.

When the signal is supplied with a negative polarity, a negative feedback is set up so that the input voltage E2 proportional to the vibrational displacement x and vibrational acceleration α is supplied to the second voice coil 10-2 with a negative polarity. From the perspective of the first voice coil 10-1, this is equivalent to a decrease of the equivalent compliance and an increase of the equivalent mechanical mass in the mechanical equivalent circuit of the entire system.

Figure 14:
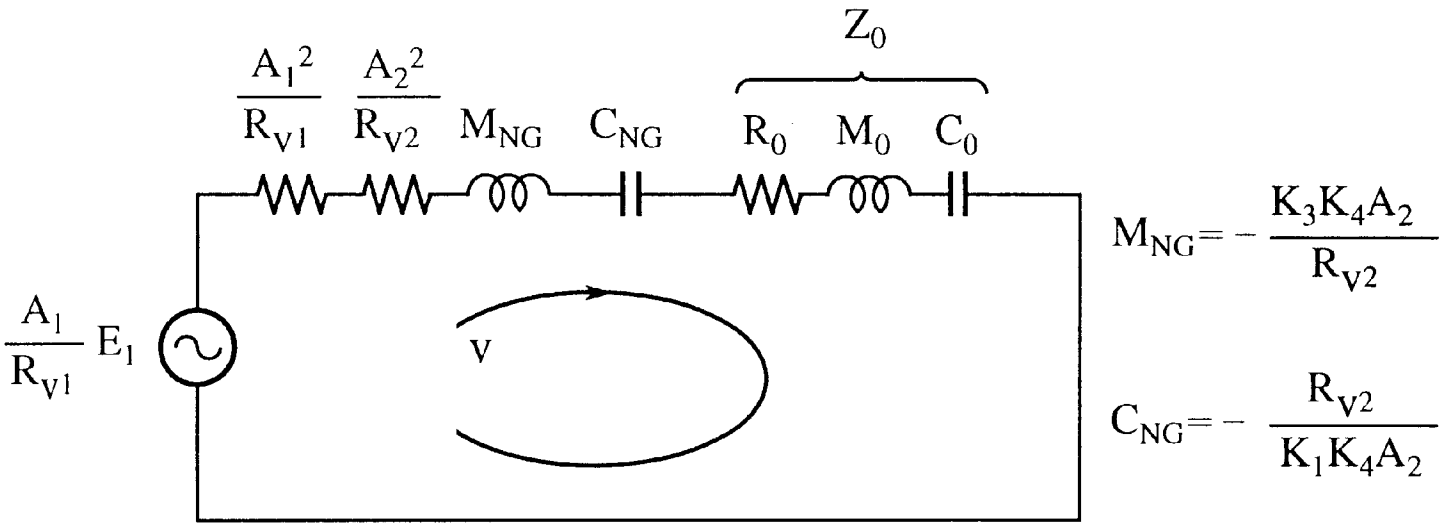
FIG. 14 is a circuit diagram showing a mechanical equivalent circuit of the MFB speaker system according to the seventh embodiment.

FIG. 14 is a circuit diagram showing a mechanical equivalent circuit from the perspective of the first voice coil 10-1 when the MFB speaker system with the construction shown in FIG. 13 is used in a positive feedback setup. Referring to FIG. 14, $M_{NG}$ and $C_{NG}$ indicate negative equivalent mechanical mass and negative equivalent mechanical compliance, respectively, generated as a result of positively feeding back the signal proportional to the vibrational acceleration α and the signal proportional to the vibrational displacement x. Like numerals and symbols represent like components in FIG. 10 and the description thereof is omitted.

The negative equivalent mechanical mass $M_{NG}$ is given by the expression (5) below and the negative equivalent mechanical compliance $C_{NG}$ is given by the expression (2) above.

$$M_{NG}=-(K_3K_4A_2)/R_{v2} \tag{5}$$

As demonstrated by the expression (5) above, the negative equivalent mechanical mass $M_{NG}$ varies with the gains $K_3$ and $K_4$ of the amplifiers for amplifying the signal indicating the vibrational acceleration α. As demonstrated by the equation (2) above, the negative equivalent mechanical compliance $C_{NG}$ varies with the gains $k_1$ and $K_4$ of the amplifiers for amplifying the signal indicating the vibrational displacement x.

That is, if the feedback to the second voice coil 10-2 is increased, the negative equivalent mechanical mass $M_{NG}$ is increased, as demonstrated by the expression (5) above, and the negative equivalent mechanical compliance $C_{NG}$ is decreased, as demonstrated by the expression (2) above. Consequently, the equivalent mechanical mass is decreased and the equivalent mechanical compliance is increased from the perspective of the entire speaker system. When the positive feedback is used, the feedback rate is adjusted in the mechanical equivalent circuit shown in FIG. 14 so that neither the entire equivalent mechanical mass nor equivalent mechanical compliance becomes negative, thus preventing oscillation of the MFB speaker system.

If the feedback to the second voice coil 10-2 is increased in the circuit of FIG. 14, the lowest resonance frequency $f_0$ drops and $Q_0$ varies with the feedback rate of the signal indicating the vibrational displacement x and the signal indicating the vibrational acceleration $\alpha$.

Although FIG. 10 shows the mechanical equivalent circuit for a positive feedback, the same circuit construction applies to a negative feedback. In a negative feedback, the negative equivalent mechanical resistance $R_{NG}$ and the negative equivalent mechanical compliance $C_{NG}$ change to a positive value and the speaker system operates as a combination of the related-art velocity MFB system and acceleration MFB system.

Thus, according to the seventh embodiment, the speaker unit 10 of the double voice coil type having the first and second voice coils 10-1 and 10-2 is used, the sum signal composed of the signals respectively proportional to the vibrational displacement x and vibrational acceleration $\alpha$ is amplified by the power amplifier 40 and is input to the second voice coil 10-2, while the acoustic signal is amplified by an external power amplifier and input directly to the first voice coil 10-1. Therefore, the user can use a power amplifier in his or her possession or use an amplifier of his or her own choice.

Embodiment 8

Figure 15:
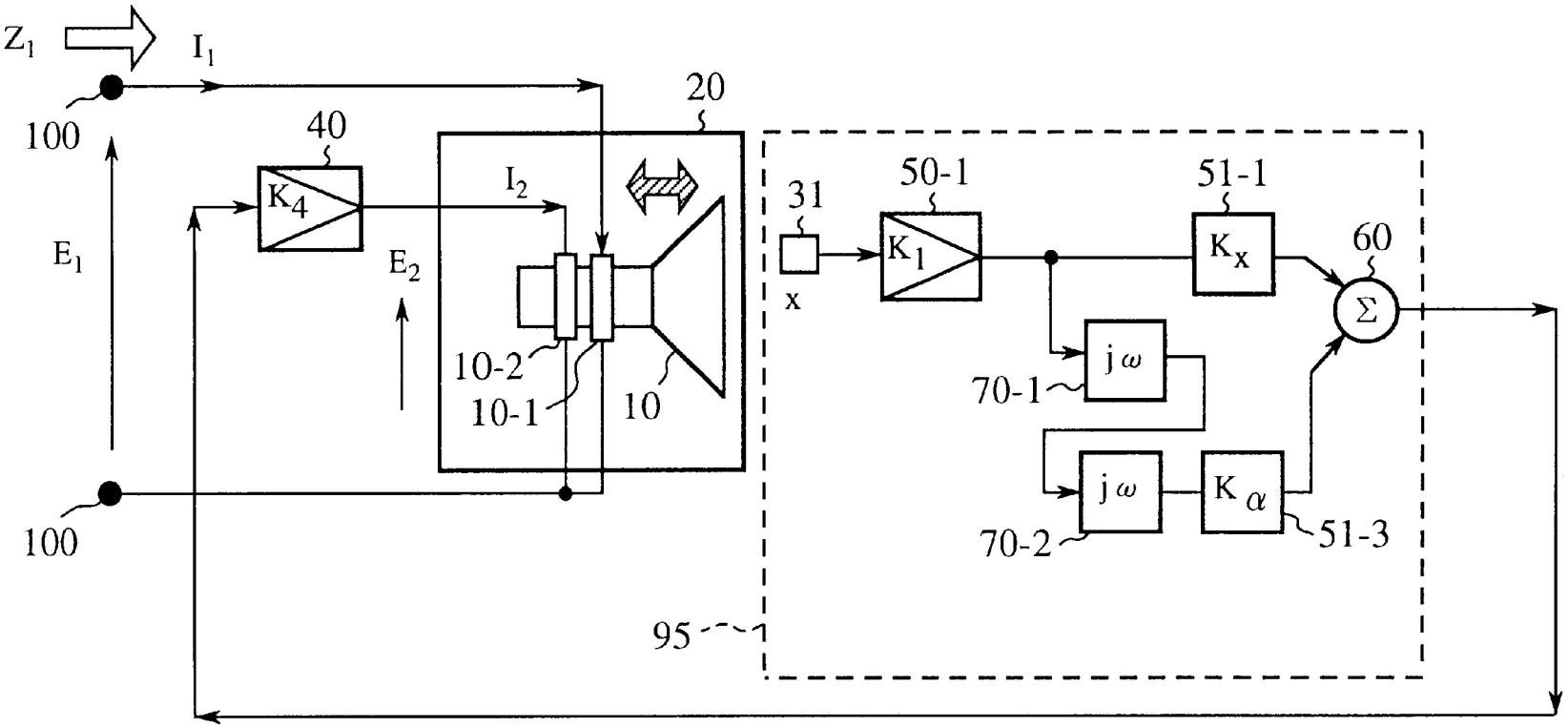
FIG. 15 shows the construction of the MFB speaker system according to an eighth embodiment.

FIG. 15 shows the construction of the MFB speaker system according to an eighth embodiment. Referring to FIG. 15, numeral 51-1 indicates a signal level adjusting means with a gain $k_x$ for adjusting the level of the signal indicating the vibrational displacement x from amplifier the 50-1 and 70-1 indicates a differentiator for differentiating the signal indicating the vibrational displacement x from the amplifier 50-1 and generating the signal indicating the vibrational velocity v. Numeral 70-2 indicates a differentiator for further differentiating the signal indicating the vibrational velocity v from the differentiator 70-1 and generating the signal indicating the vibrational acceleration $\alpha$ and 51-3 indicates a signal level adjusting means with a gain $k\alpha$ for adjusting the signal indicating the vibrational acceleration $\alpha$ from the differentiator 70-2. The other aspects of the construction are identical to those shown in FIG. 13 of the seventh embodiment except that the vibrational acceleration detecting means 33 and the amplifier 50-3 are eliminated.

In this embodiment, the vibrational displacement detecting means 31, the amplifier 50-1, the differentiators 70-1, 70-2, the signal level adjusting means 51-1, 51-3, and the adder 60 constitute a vibration information detecting means 95 of the speaker unit 10.

A description will now be given of the operation.

For example, when an acoustic signal amplified using the power amplifier in the user's possession is input directly, via the input terminal 100, to the first voice coil 10-1 of the speaker unit 10 with the input voltage E1, the diaphragm of the speaker unit 10 vibrates. The vibration information is available from the vibrational displacement detecting means 31 as the vibrational displacement x. The signal is then amplified by the amplifier 50-1 to an appropriate level and diverged into two individual signals. One of the diverged vibrational displacement signals is subject to level adjustment by the signal level adjusting means 51-1 and input to the adder 60.

The other vibrational displacement signal is converted into the signal indicating the vibrational acceleration $\alpha$ by the differentiators 70-1 and 70-2 and subject to level adjustment by the signal level adjusting means 51-3 before being input to the adder 60. The signal indicating the vibrational displacement x and the signal indicating the vibrational acceleration $\alpha$ are added by the adder 60 and output therefrom. That is, the signal proportional to the vibrational displacement x and the signal proportional to the vibrational acceleration $\alpha$ are added and output from the vibration information detecting means 95 as a sum signal. After being amplified by the power amplifier 40, the sum signal is supplied to the second voice coil 10-2 with a positive or negative polarity with respect to the first voice coil 10-1.

When the signal is supplied with a positive polarity, a positive feedback is set up so that the input voltage $E_2$ proportional to the vibrational displacement x and vibrational acceleration $\alpha$ is supplied to the second voice coil 10-2. From the perspective of the first voice coil 10-1, this is equivalent to an increase of the equivalent compliance and a decrease of the equivalent mechanical mass in the mechanical equivalent circuit of the entire system.

When the signal is supplied with a negative polarity, a negative feedback is set up so that the input voltage $E_2$ proportional to the vibrational displacement x and vibrational acceleration $\alpha$ is supplied to the second voice coil 10-2 with a negative polarity. From the perspective of the first voice coil 10-1, this is equivalent to a decrease of the equivalent compliance and an increase of the equivalent mechanical mass in the mechanical equivalent circuit of the entire system.

The mechanical equivalent circuit of the MFB speaker system of FIG. 15 and the operation thereof are generally the same as disclosed in FIG. 14 except that the gain $k_1$ of the amplifier is replaced by the product of $k_1$ and $k_x$ and the gain $K_3$ is replaced by the product of $k_1$ and $k\alpha$ in FIG. 10.

The negative equivalent mechanical compliance $C_{NG}$ changes with a change in the amplifier 50-1 for amplifying the signal indicating the vibrational displacement x, in the signal level adjusting means 51-1 and in the power amplifier 40. Consequentially, the negative equivalent mechanical mass $M_{NG}$ changes with a change in the amplifier 50-1 for amplifying the signal indicating the vibrational acceleration $\alpha$, in the signal level adjusting means 51-3 and in the power amplifier 40.

That is, when the gain is adjusted so as to increase the feedback to the second voice coil 10-2, the negative equivalent mechanical mass $M_{NG}$ is increased, as demonstrated by the expression (5) above, and the negative equivalent mechanical compliance $C_{NG}$ is decreased, as demonstrated by the expression (2) above. Consequently, the equivalent mechanical resistance is decreased and the equivalent mechanical compliance is increased from the perspective of the entire speaker system. When the positive feedback is used, the feedback rate is adjusted in the mechanical equivalent circuit shown in FIG. 14 so that neither the entire equivalent mechanical mass nor equivalent mechanical compliance becomes negative, thus preventing oscillation of the MFB speaker system.

If the feedback to the second voice coil 10-2 is increased, the lowest resonance frequency $f_0$ drops as in the seventh embodiment and $Q_0$ varies with the feedback rate of the signal indicating the vibrational displacement x and the signal indicating the vibrational acceleration $\alpha$.

In the negative feedback, the mechanical equivalent circuit and the operation thereof are generally the same as disclosed in FIG. 14 except that the gain $k_1$ of the amplifier is replaced by the product of $k_1$ and $k_x$ and the gain $K_3$ is replaced by the product of $k_1$ and $k\alpha$. In the negative feedback, the negative equivalent mechanical mass $M_{NG}$ and the negative equivalent mechanical compliance $C_{NG}$ change to a positive value and the speaker system operates as a combination of the related-art acceleration MFB system and displacement MFB system.

Thus, according to the eighth embodiment, the speaker unit 10 of the double voice coil type having the first and second voice coils 10-1 and 10-2 is used, the sum signal composed of the signals respectively proportional to the vibrational displacement x and vibrational acceleration α is amplified by the power amplifier 40 and is input to the second voice coil 10-2, while the acoustic signal is amplified by an external power amplifier and input directly to the first voice coil 10-1. Therefore, the user can use a power amplifier in his or her possession or use an amplifier of his or her own choice.

Embodiment 9

Figure 16:
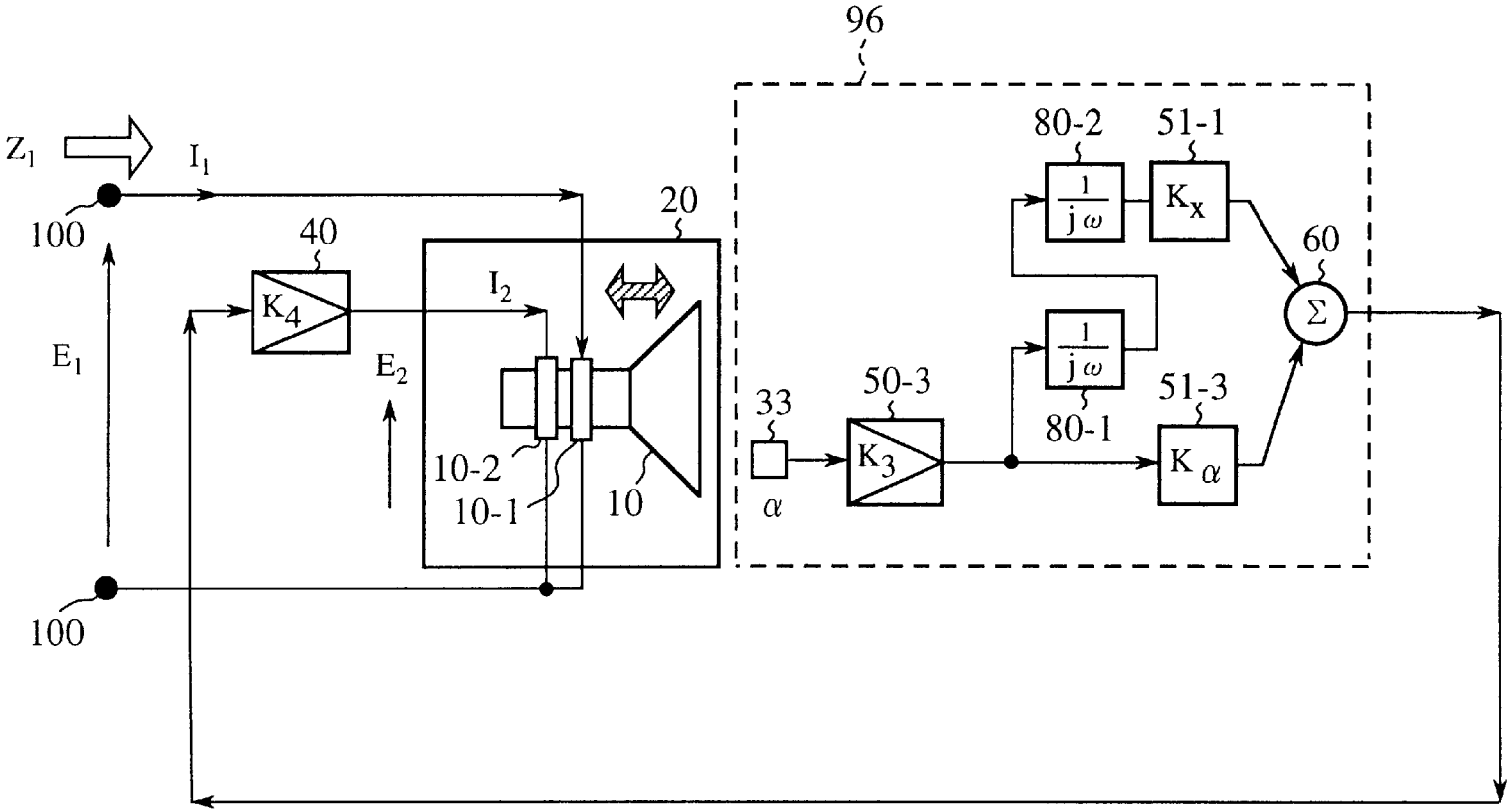
FIG. 16 shows the construction of the MFB speaker system according to a ninth embodiment.

FIG. 16 shows the construction of the MFB speaker system according to a ninth embodiment. Referring to FIG. 16, numeral 51-3 indicates a signal level adjusting means with a gain kα for adjusting the level of the signal indicating the vibrational acceleration α from the amplifier 50-3, 80-1 indicates an integrator for integrating the signal indicating the vibrational acceleration α from the amplifier 50-3 and generating the signal indicating the vibrational velocity v. 80-2 indicates an integrator for further integrating the signal indicating the vibrational velocity v from the integrator 80-1 and generating the signal indicating the vibrational displacement x and 51-1 indicates a signal level adjusting means with a gain $k_x$ for adjusting the signal indicating the vibrational displacement x from the integrator 80-2. The other aspects of the construction are identical to those shown in FIG. 13 of the seventh embodiment except that the vibrational displacement detecting means 31 and the amplifier 50-1 are eliminated.

That is, the vibrational acceleration detecting means 33, the amplifier 50-3, the integrators 80-1, 80-2, the signal level adjusting means 51-1, 51-3 and the adder 60 constitute a vibration information detecting means 96 of the speaker unit 10 in this embodiment.

A description will now be given of the operation.

For example, when an acoustic signal amplified using the power amplifier in the user's possession is input directly, via the input terminal 100, to the first voice coil 10-1 of the speaker unit 10 with the input voltage $E_1$, the diaphragm of the speaker unit 10 vibrates. The vibration information is available from the vibrational displacement detecting means 33 as the vibrational acceleration α. The signal is then amplified by the amplifier 50-3 to an appropriate level and diverged into two individual signals. One of the diverged vibrational acceleration signals is subject to level adjustment by the signal level adjusting means 51-3 and input to the adder 60.

The other vibrational acceleration signal is converted into the signal indicating the vibrational displacement x by being integrated by the integrators 80-1 and 80-2 and subject to level adjustment by the signal level adjusting means 51-1 before being input to the adder 60. The signal indicating the vibrational displacement x and the signal indicating the vibrational acceleration α are added by the adder 60 and output therefrom. That is, the signal proportional to the vibrational displacement x and the signal proportional to the vibrational acceleration α are added and output from the vibration information detecting means 96 as a sum signal. After being amplified by the power amplifier 40, the sum signal is supplied to the second voice coil 10-2 with a positive or negative polarity with respect to the first voice coil 10-1.

When the signal is supplied with a positive polarity, a positive feedback is set up so that the input voltage $E_2$ proportional to the vibrational displacement x and vibrational acceleration α is supplied to the second voice coil 10-2. From the perspective of the first voice coil 10-1, this is equivalent to an increase of the equivalent compliance and a decrease of the equivalent mechanical mass in the mechanical equivalent circuit of the entire system.

When the signal is supplied with a negative polarity, a negative feedback is set up so that the input voltage $E_2$ proportional to the vibrational displacement x and vibrational acceleration α is supplied to the second voice coil 10-2 with a negative polarity. From the perspective of the first voice coil 10-1, this is equivalent to a decrease of the equivalent compliance and an increase of the equivalent mechanical mass in the mechanical equivalent circuit of the entire system.

The mechanical equivalent circuit of the MFB speaker system of FIG. 16 and the operation thereof are generally the same as disclosed in FIG. 14 except that the gain $k_1$ of the amplifier is replaced by the product of $K_3$ and $k_x$ and the gain $K_3$ is replaced by the product of $K_3$ and kα in FIG. 14.

The negative equivalent mechanical mass $M_{NG}$ changes with a change in the amplifier 50-3 for amplifying the signal indicating the vibrational acceleration α, in the signal level adjusting means 51-3 and in the power amplifier 40. Consequentially, the negative equivalent mechanical compliance $C_{NG}$ changes with a change in the amplifier 50-3 for amplifying the signal indicating the vibrational displacement x, in the signal level adjusting means 51-1 and in the power amplifier 40.

That is, when the gain is adjusted so as to increase the feedback to the second voice coil 10-2, the negative equivalent mechanical mass $M_{NG}$ is increased, as demonstrated by the expression (5) above, and the negative equivalent mechanical compliance $C_{NG}$ is decreased, as demonstrated by the expression (2) above. Consequently, the equivalent mechanical mass is decreased and the equivalent mechanical compliance is increased from the perspective of the entire speaker system. When the positive feedback is used, the feedback rate is adjusted in the mechanical equivalent circuit shown in FIG. 14 so that neither the entire equivalent mechanical mass nor equivalent mechanical compliance becomes negative, thus preventing oscillation of the MFB speaker system.

If the feedback to the second voice coil 10-2 is increased, the lowest resonance frequency $f_0$ drops as in the seventh embodiment and $Q_0$ varies with the feedback rate of the signal indicating the vibrational displacement x and the signal indicating the vibrational acceleration α.

In the negative feedback, the mechanical equivalent circuit and the operation thereof are generally the same as disclosed in FIG. 14 except that the gain $k_1$ of the amplifier is replaced by the product of $K_3$ and $k_x$ and the gain $K_3$ is replaced by the product of $K_3$ and kα. In the negative feedback, the negative equivalent mechanical mass $M_{NG}$ and the negative equivalent mechanical compliance $C_{NG}$ change to a positive value and the speaker system operates as a combination of the related-art acceleration MFB system and displacement MFB system.

Thus, according to the ninth embodiment, the speaker unit 10 of the double voice coil type having the first and second voice coils 10-1 and 10-2 is used, the sum signal composed of the signals respectively proportional to the vibrational displacement x and vibrational acceleration α is amplified by the power amplifier 40 and is input to the second voice coil 10-2, while the acoustic signal is amplified by an external power amplifier and input directly to the first voice coil 10-1. Therefore, the user can use a power amplifier in his or her possession or use an amplifier of his or her own choice.

Embodiment 10

Figure 17:
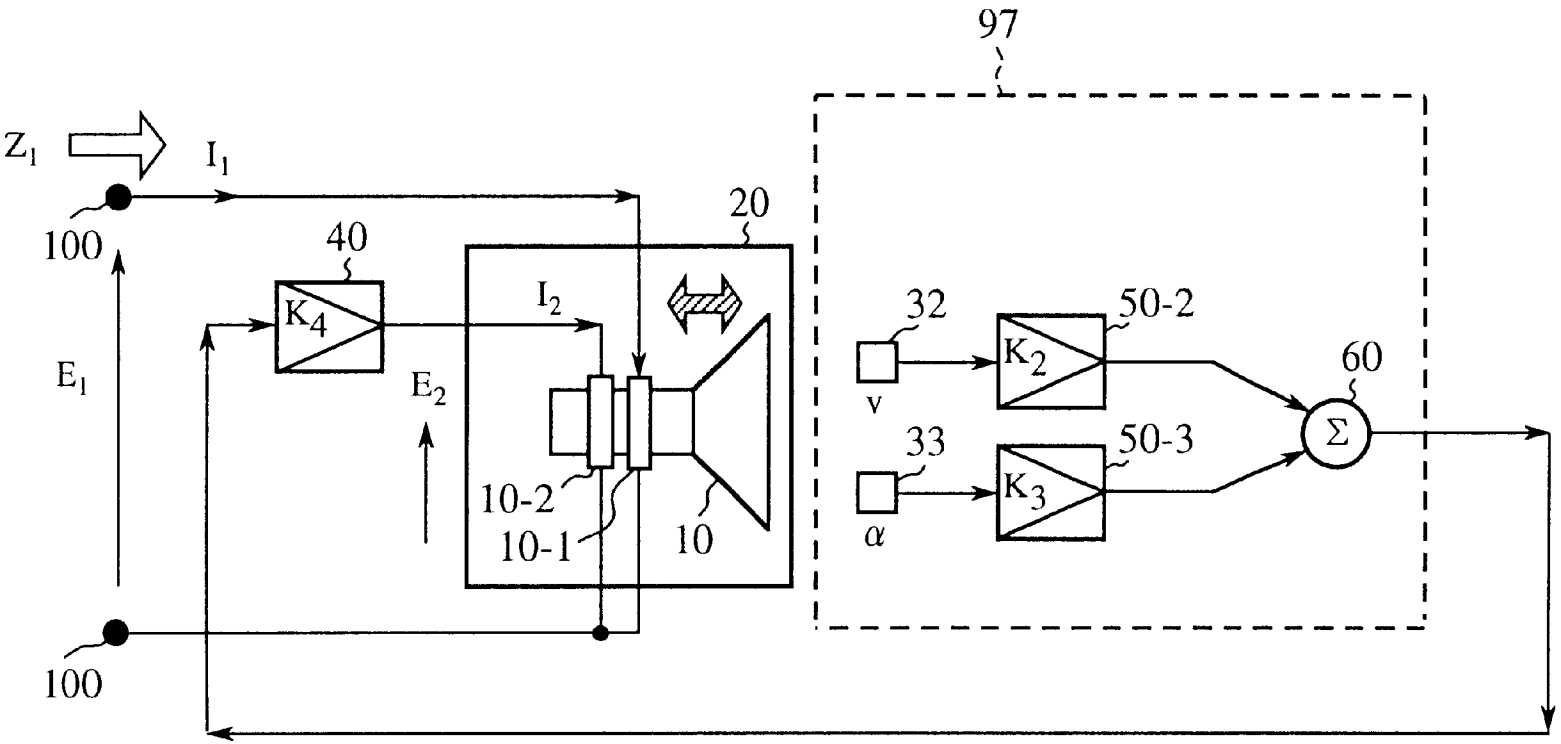
FIG. 17 shows the construction of the MFB speaker system according to a tenth embodiment.

FIG. 17 shows the construction of the MFB speaker system according to the tenth embodiment. Referring to FIG. 17, numeral 33 indicates a vibrational acceleration detecting means for detecting the vibrational acceleration $\alpha$ of the speaker unit 10 and 50-3 indicates an amplifier with a gain $K_3$ for amplifying the signal indicating the vibrational acceleration $\alpha$ from the vibrational acceleration detecting means 33. The other aspects of the construction are identical to those shown in FIG. 9 of the fourth embodiment except that the vibrational displacement detecting means 31 and the amplifier 50-1 are eliminated.

That is, the vibrational velocity detecting means 32, the vibrational acceleration detecting means 33, the amplifiers 50-2, 50-3 and the adder 60 constitute a vibration information detecting means 97 of the speaker unit 10 in this embodiment.

A description will now be given of the operation.

For example, when an acoustic signal amplified using the power amplifier in the user's possession is input directly, via the input terminal 100, to the first voice coil 10-1 of the speaker unit 10 with the input voltage $E_1$, the diaphragm of the speaker unit 10 vibrates. The vibrational information available in this construction includes the signal indicating the vibrational velocity v output from the vibrational velocity detecting means 32 and the signal indicating the vibrational acceleration $\alpha$ output from the vibrational acceleration detecting means 33.

The signals are then amplified by the amplifiers 50-2 and 50-3 to an appropriate level and added by the adder 60 and output therefrom. That is, the signal proportional to the vibrational velocity v and the signal proportional to the vibrational acceleration $\alpha$ are added and output from the vibration information detecting means 97 as a sum signal. After being amplified by the power amplifier 40, the sum signal is supplied to the second voice coil 10-2 with a positive or negative polarity with respect to the first voice coil 10-1.

When the signal is supplied with a positive polarity, a positive feedback is set up so that the input voltage $E_2$ proportional to the vibrational velocity v and vibrational acceleration $\alpha$ is supplied to the second voice coil 10-2. From the perspective of the first voice coil 10-1, this is equivalent to a decrease of the equivalent mechanical resistance and equivalent mechanical mass in the mechanical equivalent circuit of the entire system.

When the signal is supplied with a negative polarity, a negative feedback is set up so that the input voltage E2 proportional to the vibrational velocity v and vibrational acceleration $\alpha$ is supplied to the second voice coil 10-2 with a negative polarity. From the perspective of the first voice coil 10-1, this is equivalent to an increase of the equivalent resistance and equivalent mechanical mass in the mechanical equivalent circuit of the entire system.

Figure 18:
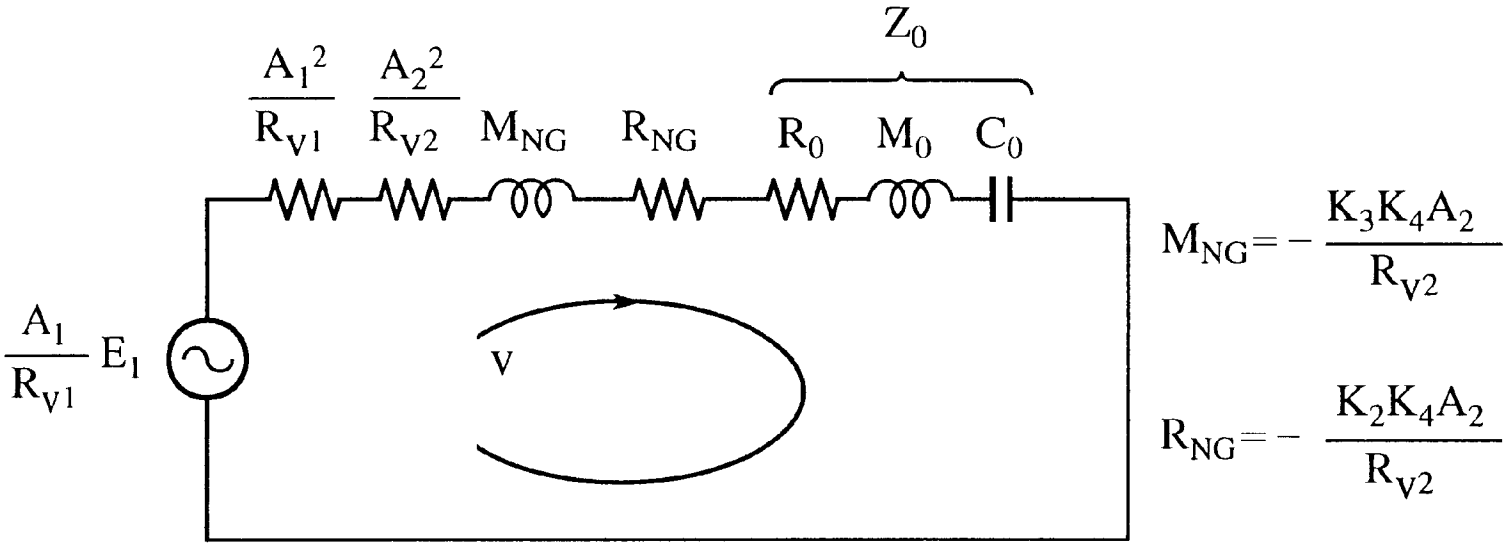
FIG. 18 is a circuit diagram showing a mechanical equivalent circuit of the MFB speaker system according to the tenth embodiment.

FIG. 18 is a circuit diagram showing a mechanical equivalent circuit from the perspective of the first voice coil 10-1 when the MFB speaker system with the construction shown in FIG. 17 is used in a positive feedback setup. Referring to FIG. 18, $R_{NG}$ and $M_{NG}$ indicate negative equivalent mechanical resistance and negative equivalent mechanical mass, respectively, generated as a result of positively feeding back the signal proportional to the vibrational velocity v and the signal proportional to the vibrational acceleration $\alpha$.

The negative equivalent mechanical resistance $R_{NG}$ is given by the expression (1) above and the negative equivalent mechanical mass $M_{NG}$ is given by the expression (5) above. The negative equivalent mechanical resistance $R_{NG}$ varies with the gains $K_2$ and $K_4$ of the amplifiers for amplifying the signal indicating the vibrational velocity v. The negative equivalent mechanical mass $M_{NG}$ varies with the gains $K_3$ and $K_4$ of the amplifiers for amplifying the signal indicating the vibrational acceleration $\alpha$.

That is, if the feedback to the second voice coil 10-2 is increased, the negative equivalent mechanical mass $M_{NG}$ is increased, as demonstrated by the expression (5) above, and the negative equivalent mechanical resistance $R_{NG}$ is increased, as demonstrated by the expression (1) above. Consequently, the equivalent mechanical mass and the equivalent mechanical resistance are decreased from the perspective of the entire speaker system. When the positive feedback is used, the feedback rate is adjusted in the mechanical equivalent circuit shown in FIG. 18 so that neither the entire equivalent mechanical mass nor equivalent mechanical resistance becomes negative, thus preventing oscillation of the MFB speaker system.

If the feedback to the second voice coil 10-2 is increased in the circuit of FIG. 18, the lowest resonance frequency $f_0$ rises and $Q_0$ varies with the feedback rate of the signal indicating the vibrational velocity v and the signal indicating the vibrational acceleration $\alpha$.

Although FIG. 18 shows the mechanical equivalent circuit for a positive feedback, the same circuit construction applies to a negative feedback. In the negative feedback, the negative equivalent mechanical resistance $R_{NG}$ and the negative equivalent mechanical mass $M_{NG}$ change to a positive value and the speaker system operates as a combination of the related-art velocity MFB system and acceleration MFB system.

Thus, according to the tenth embodiment, the speaker unit 10 of the double voice coil type having the first and second voice coils 10-1 and 10-2 is used, the sum signal composed of the signals respectively proportional to the vibrational velocity v and vibrational acceleration $\alpha$ is amplified by the power amplifier 40 and is input to the second voice coil 10-2, while the acoustic signal is amplified by an external power amplifier and input directly to the first voice coil 10-1. Therefore, the user can use a power amplifier in his or her possession or use an amplifier of his or her own choice.

Embodiment 11

Figure 19:
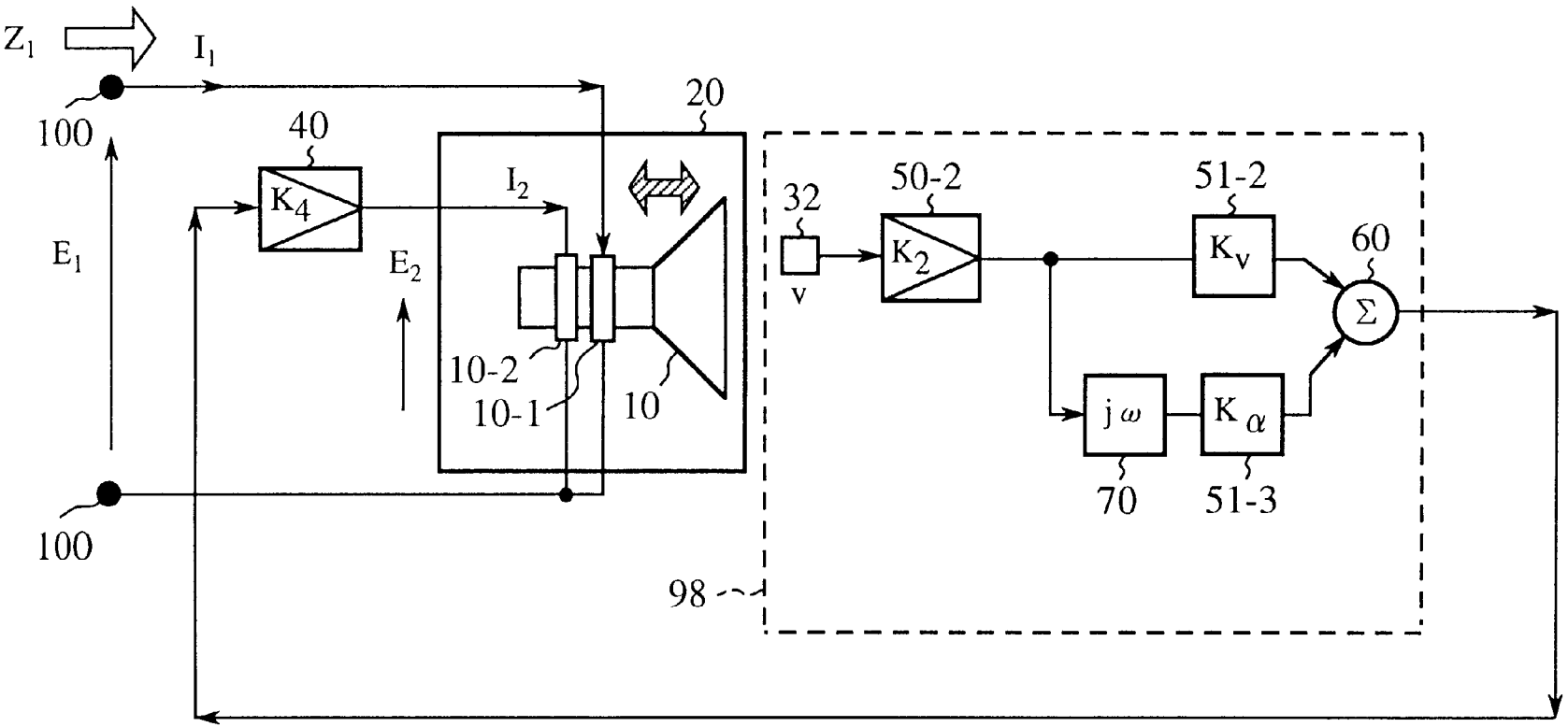
FIG. 19 shows the construction of the MFB speaker system according to an eleventh embodiment.

FIG. 19 shows the construction of the MFB speaker system according to the eleventh embodiment. Referring to FIG. 19, numeral 51-2 indicates a signal level adjusting means with a gain $k_v$ for adjusting the signal indicating the vibrational velocity v from the amplifier 50-2, 70 indicates a differentiator for differentiating the signal indicating the vibrational velocity v from the amplifier 50-2 and generating the signal indicating the vibrational acceleration $\alpha$ and 51-3 indicates a signal level adjusting means with a gain $k\alpha$ for adjusting the signal indicating the vibrational acceleration $\alpha$ from the differentiator 70. The other aspects of the construction are identical to those shown in FIG. 10 of the tenth embodiment except that the vibrational acceleration detecting means 33 and the amplifier 50-3 are eliminated.

That is, in this embodiment, the vibrational velocity detecting means 32, the amplifier 50-2, the differentiator 70, the signal level adjusting means 51-2, 51-3 and the adder 60 constitute a vibration information detecting means 98 of the speaker unit 10.

A description will now be given of the operation.

For example, when an acoustic signal amplified using the power amplifier in the user's possession is input directly, via the input terminal 100, to the first voice coil 10-1 of the speaker unit 10 with the input voltage E1, the diaphragm of the speaker unit 10 vibrates and the vibrational velocity detecting means 32 outputs the signal indicating the vibrational velocity v as vibration information. The signal is then amplified by the amplifier 50-2 to an appropriate level and diverged into two individual signals. One of the diverged vibrational velocity signals is subject to level adjustment by the signal level adjusting means 51-2 and input to the adder 60.

The other vibrational velocity signal is converted into the signal indicating the vibrational acceleration $\alpha$ by the differentiator 70 and subject to level adjustment by the signal level adjusting means 51-3 before being input to the adder 60. The signal indicating the vibrational velocity v and the signal indicating the vibrational acceleration $\alpha$ are added by the adder 60 and output therefrom. That is, the signal proportional to the vibrational velocity v and the signal proportional to the vibrational acceleration $\alpha$ are added and output from the vibration information detecting means 98 as a sum signal. After being amplified by the power amplifier 40, the sum signal is supplied to the second voice coil 10-2 with a positive or negative polarity with respect to the first voice coil 10-1.

When the signal is supplied with a positive polarity, a positive feedback is set up so that the input voltage $E_2$ proportional to the vibrational velocity v and vibrational acceleration $\alpha$ is supplied to the second voice coil 10-2. From the perspective of the first voice coil 10-1, this is equivalent to a decrease of the equivalent mechanical resistance and equivalent mechanical mass in the mechanical equivalent circuit of the entire system.

When the signal is supplied with a negative polarity, a negative feedback is set up so that the input voltage $E_2$ proportional to the vibrational velocity v and vibrational acceleration $\alpha$ is supplied to the second voice coil 10-2 with a negative polarity. From the perspective of the first voice coil 10-1, this is equivalent to an increase of the equivalent mechanical resistance and equivalent mechanical mass in the mechanical equivalent circuit of the entire system. The mechanical equivalent circuit of the MFB speaker system of FIG. 19 and the operation thereof are generally the same as disclosed in FIG. 18 except that the gain $K_2$ of the amplifier is replaced by the product of $K_2$ and $k_v$ and the gain $K_3$ is replaced by the product of $K_2$ and $k\alpha$ in FIG. 18.

The negative equivalent mechanical resistance $R_{NG}$ changes with a change in the amplifier 50-2 for amplifying the signal indicating the vibrational velocity v, in the signal level adjusting means 51-2 and in the power amplifier 40. Consequentially, the negative equivalent mechanical mass $M_{NG}$ changes with a change in the amplifier 50-2 for amplifying the signal indicating the vibrational acceleration $\alpha$, in the signal level adjusting means 51-3 and in the power amplifier 40.

That is, when the gain is adjusted so as to increase the feedback to the second voice coil 10-2, the negative equivalent mechanical resistance $R_{NG}$ and the negative equivalent mechanical mass $M_{NG}$ are increased, as demonstrated by the expressions (1) and (5) above. Consequently, the equivalent mechanical resistance and equivalent mechanical mass are decreased from the perspective of the entire speaker system. When the positive feedback is used, the feedback rate is adjusted in the mechanical equivalent circuit shown in FIG. 18 so that neither the entire equivalent mechanical mass nor equivalent mechanical resistance becomes negative, thus preventing oscillation of the MFB speaker system.

If the feedback to the second voice coil 10-2 is increased, the lowest resonance frequency $f_0$ rises as in the tenth embodiment and $Q_0$ varies with the feedback rate of the signal indicating the vibrational velocity v and the signal indicating the vibrational acceleration $\alpha$.

In the negative feedback, the mechanical equivalent circuit and the operation thereof are generally the same as disclosed in FIG. 17 except that the gain $k_2$ of the amplifier is replaced by the product of $K_2$ and $k_v$ and the gain $K_3$ is replaced by the product of $K_2$ and $k\alpha$. In the negative feedback, the negative equivalent mechanical resistance $R_{NG}$ and the negative equivalent mechanical mass $M_{NG}$ change to a positive value and the speaker system operates as a combination of the related-art velocity MFB system and acceleration MFB system.

Thus, according to the eleventh embodiment, the speaker unit 10 of the double voice coil type having the first and second voice coils 10-1 and 10-2 is used, the sum signal composed of the signals respectively proportional to the vibrational velocity v and vibrational acceleration $\alpha$ is amplified by the power amplifier 40 and is input to the second voice coil 10-2, while the acoustic signal is amplified by an external power amplifier and input directly to the first voice coil 10-1. Therefore, the user can use a power amplifier in his or her possession or use an amplifier of his or her own choice.

Embodiment 12

Figure 20:
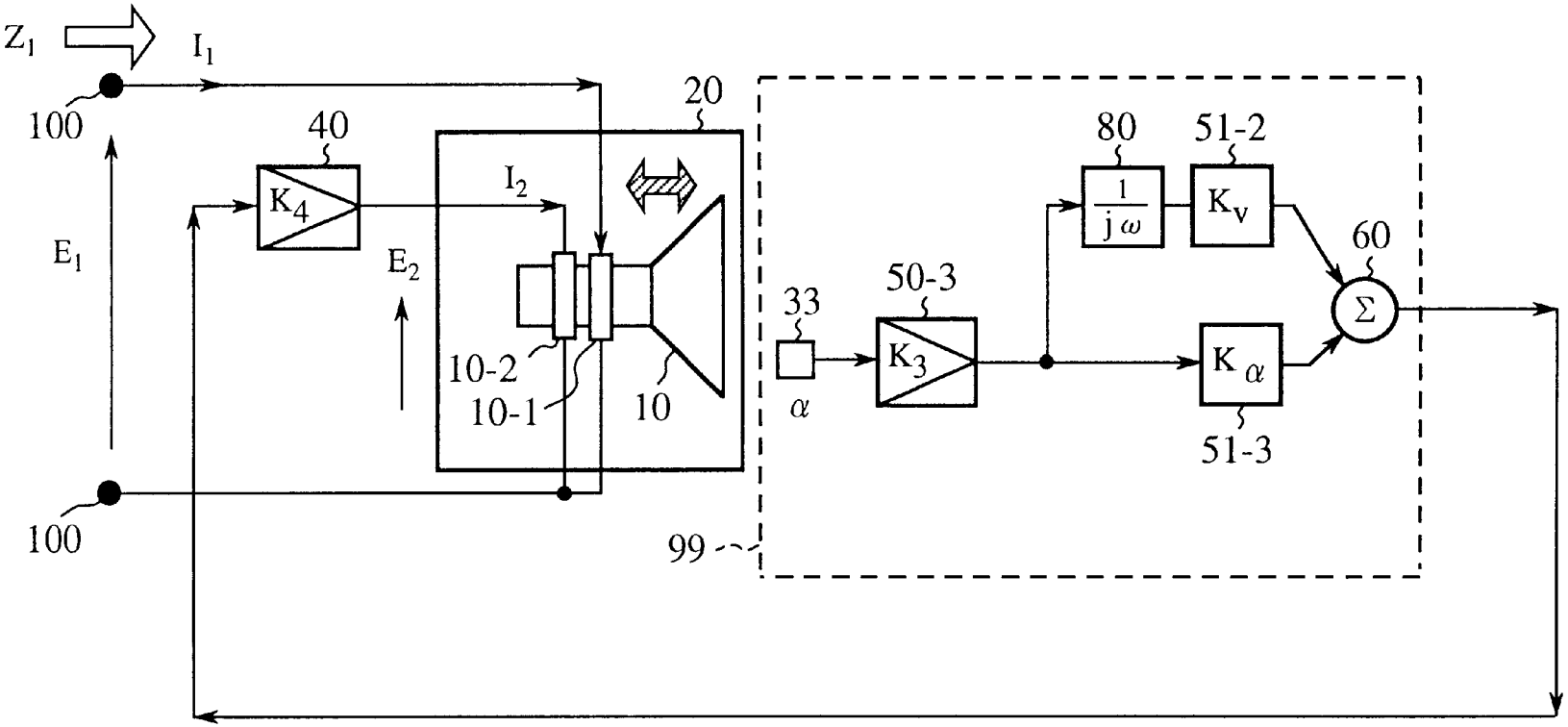
FIG. 20 shows the construction of the MFB speaker system according to a twelfth embodiment.

FIG. 20 shows the construction of the MFB speaker system according to the twelfth embodiment. Referring to FIG. 20, numeral 51-3 indicates a signal level adjusting means with a gain $k\alpha$ for adjusting the signal indicating the vibrational acceleration $\alpha$ from the amplifier 50-3, 80 indicates an integrator for integrating the signal indicating the vibrational acceleration $\alpha$ from the amplifier 50-3 and generating the signal indicating the vibrational velocity v and 51-2 is signal level adjusting means with a gain $k_v$ for adjusting the signal indicating the vibrational velocity v from the integrator 80 is adjusted. The other aspects of the construction are identical to those shown in FIG. 17 of the tenth embodiment except that the vibrational velocity detecting means 32 and the amplifier 50-2 are eliminated.

That is, in this embodiment, the vibrational acceleration detecting means 33, the amplifier 50-3, the integrator 80, the signal level adjusting means 51-2, 51-3, and the adder 60 constitute a vibration information detecting means 99 of the speaker unit 10.

A description will now be given of the operation.

For example, when an acoustic signal amplified using the power amplifier in the user's possession is input directly, via the input terminal 100, to the first voice coil 10-1 of the speaker unit 10 with the input voltage $E_1$, the diaphragm of the speaker unit 10 vibrates and the vibrational acceleration detecting means 33 outputs the signal indicating the vibrational acceleration $\alpha$ as vibration information The signal is then amplified by the amplifier 50-3 to an appropriate level and diverged into two individual signals. One of the diverged vibrational acceleration signals is subject to level adjustment by the signal level adjusting means 51-3 and input to the adder 60.

The other vibrational acceleration signal is converted into the signal indicating the vibrational velocity v by the integrator 80 and subject to level adjustment by the signal level adjusting means 51-2 before being input to the adder 60. The signal indicating the vibrational velocity v and the signal indicating the vibrational acceleration $\alpha$ are added by the adder 60 and output therefrom. That is, the signal proportional to the vibrational velocity v and the signal proportional to the vibrational acceleration $\alpha$ are added and output from the vibration information detecting means 99 as a sum signal. After being amplified by the power amplifier 40, the sum signal is supplied to the second voice coil 10-2 with a positive or negative polarity with respect to the first voice coil 10-1.

When the signal is supplied with a positive polarity, a positive feedback is set up so that the input voltage $E_2$ proportional to the vibrational velocity v and vibrational acceleration $\alpha$ is supplied to the second voice coil 10-2. From the perspective of the first voice coil 10-1, this is equivalent to a decrease of the equivalent mechanical resistance and equivalent mechanical mass in the mechanical equivalent circuit of the entire system.

When the signal is supplied with a negative polarity, a negative feedback is set up so that the input voltage $E_2$ proportional to the vibrational velocity v and vibrational acceleration $\alpha$ is supplied to the second voice coil 10-2 with a negative polarity. From the perspective of the first voice coil 10-1, this is equivalent to an increase of the equivalent mechanical resistance and equivalent mechanical mass in the mechanical equivalent circuit of the entire system.

The mechanical equivalent circuit of the MFB speaker system of FIG. 20 and the operation thereof are generally the same as disclosed in FIG. 18 except that the gain $K_2$ of the amplifier is replaced by the product of $K_3$ and $k_v$ and the gain $K_3$ is replaced by the product of $K_3$ and $k\alpha$ in FIG. 18. The negative equivalent mechanical resistance $R_{NG}$ changes with a change in the amplifier 50-3 for amplifying the signal indicating the vibrational acceleration $\alpha$, in the signal level adjusting means 51-3 and in the power amplifier 40. Consequentially, the negative equivalent mechanical resistance $R_{NG}$ changes with a change in the amplifier 50-3 for amplifying the signal indicating the vibrational velocity v, in the signal level adjusting means 51-2 and in the power amplifier 40.

That is, when the gain is adjusted so as to increase the feedback to the second voice coil 10-2, the negative equivalent mechanical resistance $R_{NG}$ and the negative equivalent mechanical mass $M_{NG}$ are increased, as demonstrated by the expressions (1) and (5) above. Consequently, the equivalent mechanical resistance and equivalent mechanical mass are decreased from the perspective of the entire speaker system. When the positive feedback is used, the feedback rate is adjusted in the mechanical equivalent circuit shown in FIG. 18 so that neither the entire equivalent mechanical mass nor equivalent mechanical resistance becomes negative, thus preventing oscillation of the MFB speaker system.

If the feedback to the second voice coil 10-2 is increased, the lowest resonance frequency $f_0$ rises as in the seventh embodiment and $Q_0$ varies with the feedback rate of the signal indicating the vibrational velocity v and the signal indicating the vibrational acceleration $\alpha$.

In the negative feedback, the mechanical equivalent circuit and the operation thereof are generally the same as disclosed in FIG. 17 except that the gain $K_2$ of the amplifier is replaced by the product of $K_3$ and $k_v$ and the gain $K_3$ is replaced by the product of $K_3$ and $k\alpha$. In the negative feedback, the negative equivalent mechanical resistance $R_{NG}$ and the negative equivalent mechanical mass $M_{NG}$ change to a positive value and the speaker system operates as a combination of the related-art velocity MFB system and acceleration MFB system.

Thus, according to the twelfth embodiment, the speaker unit 10 of the double voice coil type having the first and second voice coils 10-1 and 10-2 is used, the sum signal composed of the signals respectively proportional to the vibrational velocity v and vibrational acceleration $\alpha$ is amplified by the power amplifier 40 and is input to the second voice coil 10-2, while the acoustic signal is amplified by an external power amplifier and input directly to the first voice coil 10-1. Therefore, the user can use a power amplifier in his or her possession or use an amplifier of his or her own choice.

Embodiment 13

Figure 21:
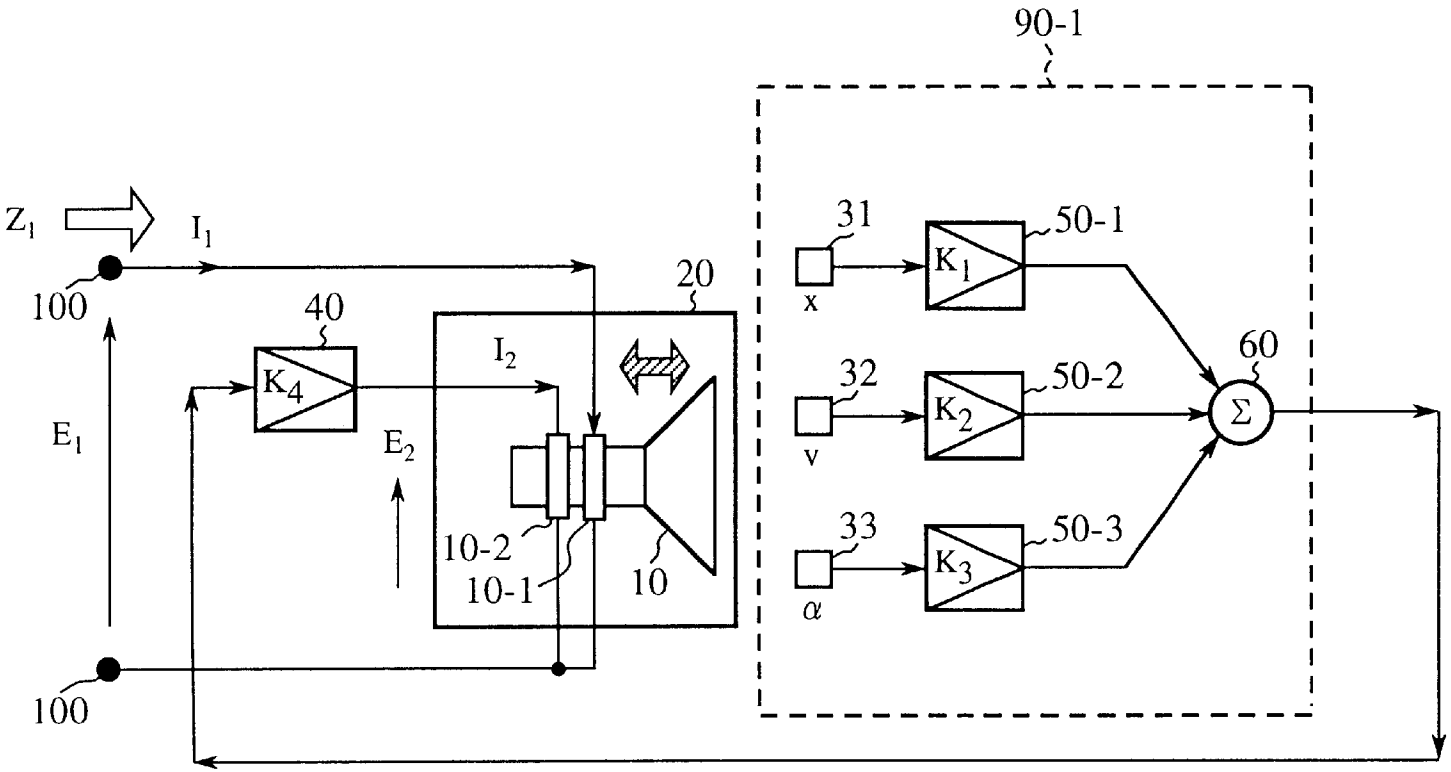
FIG. 21 shows the construction of the MFB speaker system according to a thirteenth embodiment.

FIG. 21 shows the construction of the MFB speaker system according to the thirteenth embodiment. In FIG. 21, numeral 10 indicates a speaker unit, 10-1 indicates a first voice coil of the speaker unit 10 and 10-2 indicates a second voice coil of the speaker unit 10. The speaker unit 10 is of the double voice coil type in which one unit has two voice coils.

Referring to FIG. 21, numeral 20 indicates a cabinet, 31 indicates a vibrational displacement-detecting means for detecting the vibrational displacement x of the speaker unit 10, 32 indicates a vibrational velocity detecting means for detecting the vibrational velocity v of the speaker unit 10 and 33 indicates a vibrational acceleration detecting means for detecting the vibrational acceleration $\alpha$ of the speaker unit 10. Numeral 50-1 indicates an amplifier with a gain $k_1$ for amplifying the signal indicating the vibrational displacement x from the vibrational displacement detecting means 31, 50-2 indicates an amplifier for amplifying the signal indicating the vibrational velocity v from the vibrational velocity detecting means 32, 50-3 indicates an amplifier for amplifying the signal indicating the vibrational acceleration $\alpha$ from the vibrational acceleration detecting means 33 and 60 indicates an adder for generating the sum signal composed of the signals from the amplifiers 50-1, 50-2 50-3.

That is, in this embodiment, the vibrational displacement detecting means 31, the vibrational velocity detecting means 32, the vibrational acceleration detecting means 33, the amplifiers 50-1, 50-2 and 50-3, and the adder 60 constitute a vibration information detecting means 90-1 of the speaker unit 10.

Referring to FIG. 21, 40 indicates a power amplifier (amplifying means) with a gain $K_4$ for amplifying the sum signal from the adder 60 and driving the second voice coil 10-2, 100 indicates an-input terminal for inputting the acoustic signal, $E_1$ and $I_1$ indicate an input voltage and an input current, respectively, supplied to the speaker unit 10, $Z_1$ indicates an input impedance of the speaker unit 10 and $E_2$ and $I_2$ indicate an input voltage and an input current, respectively, supplied to the second voice coil 10-2.

A description will now be given of the operation.

For example, when an acoustic signal amplified using the power amplifier in the user's possession is input directly, via the input terminal 100, to the first voice coil 10-1 of the speaker unit 10 with the input voltage $E_1$, the diaphragm of the speaker unit 10 vibrates. The vibrational information available in this construction includes the signal indicating the vibrational displacement x output from the vibrational displacement detecting means 31, the signal indicating the vibrational velocity v output from the vibrational velocity detecting means 32 and the signal indicating the vibrational acceleration $\alpha$ output from the vibrational acceleration detecting means 33.

The signals are then amplified by the amplifiers 50-1, 50-2 and 50-3, respectively, to an appropriate level and added by the adder 60 and output therefrom. That is, the signal proportional to the vibrational displacement x, the signal proportional to the vibrational velocity v and the signal proportional to the vibrational acceleration $\alpha$ are added and output from the vibration information detecting means 90-1 as a sum signal. After being amplified by the power amplifier 40, the sum signal is supplied to the second voice coil 10-2 with a positive or negative polarity with respect to the first voice coil 10-1.

When the signal is supplied with a positive polarity, a positive feedback is set up so that the input voltage E2 proportional to the vibrational displacement x, vibrational velocity v and vibrational acceleration α is supplied to the second voice coil 10-2. From the perspective of the first voice coil 10-1, this is equivalent to an increase of the equivalent mechanical compliance and a decrease of the equivalent mechanical resistance and equivalent mechanical mass in the mechanical equivalent circuit of the entire system.

When the signal is supplied with a negative polarity, a negative feedback is set up so that the input voltage $E_2$ proportional to the vibrational displacement x, vibrational velocity v and vibrational acceleration α is supplied to the second voice coil 10-2 with a negative polarity. From the perspective of the first voice coil 10-1, this is equivalent to a decrease of the equivalent compliance and an increase in equivalent mechanical resistance and equivalent mechanical mass in the mechanical equivalent circuit of the entire system.

Figure 22:
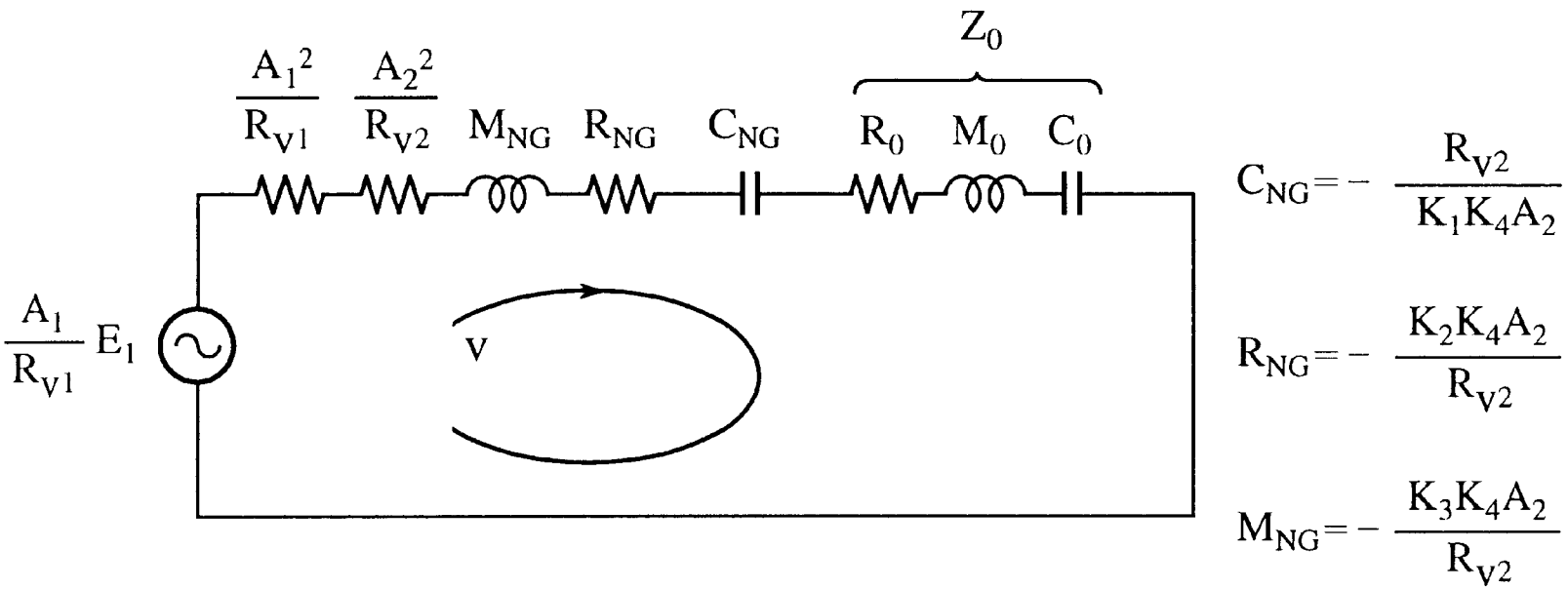
FIG. 22 is a circuit diagram showing a mechanical equivalent circuit of the MFB speaker system according to the thirteenth embodiment.

FIG. 22 is a circuit diagram showing a mechanical equivalent circuit from the perspective of the first voice coil 10-1 when the MFB speaker system with the construction shown in FIG. 21 is used in a positive feedback setup. Referring to FIG. 22, symbols $R_{v1}$ and $R_{v2}$ indicate the resistance of first and second voice coils, $A_1$ and $A_2$ indicate the force factors of first and second voice coils, $Z_0$ indicates the mechanical impedance of the speaker unit 10, $R_0$, $M_0$ and $C_0$ indicate the equivalent mechanical resistance, equivalent mechanical mass and equivalent mechanical compliance of the speaker unit 10. Symbol $E_1$ indicates an input voltage supplied to the first voice coil 10-1, v indicates the vibrational velocity, $C_{NG}$, $R_{NG}$ and $M_{NG}$ indicate the negative equivalent mechanical compliance, the negative equivalent mechanical resistance, the negative equivalent mechanical mass generated as a result of introducing the second voice coil 10-2 and positively feeding back the signals respectively proportional to the vibrational displacement x, vibrational velocity v and vibrational acceleration α.

The negative equivalent mechanical compliance $C_{NG}$, the negative equivalent mechanical resistance $R_{NG}$ and the negative equivalent mechanical mass $M_{NG}$ are given by the following expressions (6), (7) and (8).

$$C_{NG}=-R_{v2}/(k_1K_4A_2) \tag{6}$$

$$R_{NG}=-K_2K_4A_2/R_{v2} \tag{7}$$

$$M_{NG}=-K_3K_4A_2/R_{v2} \tag{8}$$

As demonstrated by the expression (6) above, the negative equivalent mechanical compliance $C_{NG}$ varies with the gains $k_1$ and $K_4$ of the amplifiers. As demonstrated by the expressions (7) and (8) above, the negative equivalent mechanical resistance $R_{NG}$ and the negative mechanical mass $M_{NG}$ vary with the gains $K_2$ and $K_4$ of the amplifiers and with the gains $K_3$ and $K_4$ of the amplifiers.

That is, if the feedback to the second voice coil 10-2 is increased, the negative equivalent mechanical compliance $C_{NG}$ is decreased, and the negative equivalent mechanical resistance $R_{NG}$ and the negative mechanical mass $M_{NG}$ are increased. Consequently, the equivalent mechanical compliance is increased, and the equivalent mechanical resistance and the negative mechanical mass are decreased from the perspective of the entire speaker system. When the positive feedback is used, the feedback rate is adjusted in the mechanical equivalent circuit shown in FIG. 22 so that none of the entire equivalent mechanical compliance, equivalent mechanical resistance and equivalent mechanical mass becomes negative, thus preventing oscillation of the MFB speaker system.

When the positive feedback as shown in the FIG. 22 is used, $Q_0$ and the lowest resonance frequency $f_0$ are given by the following expressions (9) and (10).

$$f_0 = \frac{1}{2\pi}\sqrt{\frac{1}{M_0}\left(\frac{1}{C_{NG}}+\frac{1}{C_0}\right)} \tag{4}$$

$$Q_0=2\pi f_0M_0/R_{me} \tag{10}$$

where $R_{me}$ indicates the equivalent mechanical resistance of the mechanical equivalent circuit as a whole. If the feedback to the second voice coil 10-2 is increased, the negative equivalent mechanical compliance $C_{NG}$ is decreased so that the lowest resonance frequency $f_0$ in the expression (9) above drops assuming that the equivalent mechanical mass $M_0$ remains constant. Since $Q_0$ in the expression (10) above varies with $f_0$, $M_0$ and $R_{me}$, it varies with the feedback rate of the signal indicating the vibrational displacement x, the signal indicating the vibrational velocity v and the signal indicating the vibrational acceleration α.

Although FIG. 22 shows the mechanical equivalent circuit for a positive feedback, the same circuit construction applies to a negative feedback. In a negative feedback, the negative equivalent mechanical compliance $C_{NG}$, the negative equivalent mechanical resistance $R_{NG}$ and the negative mechanical mass $M_{NG}$ change to a positive value, and the speaker system operates as a combination of the related-art displacement MFB system, velocity MFB system and acceleration MFB system.

Thus, according to the thirteenth embodiment, the speaker unit 10 of the double voice coil type having the first and second voice coils 10-1 and 10-2 is used, the sum signal composed of the signals respectively proportional to the vibrational displacement x, vibrational velocity v and vibrational acceleration α is amplified by the power amplifier 40 and is input to the second voice coil 10-2, while the acoustic signal is amplified by an external power amplifier and input directly to the first voice coil 10-1. Therefore, the user can use a power amplifier in his or her possession or use an amplifier of his or her own choice.

Embodiment 14

Figure 23:
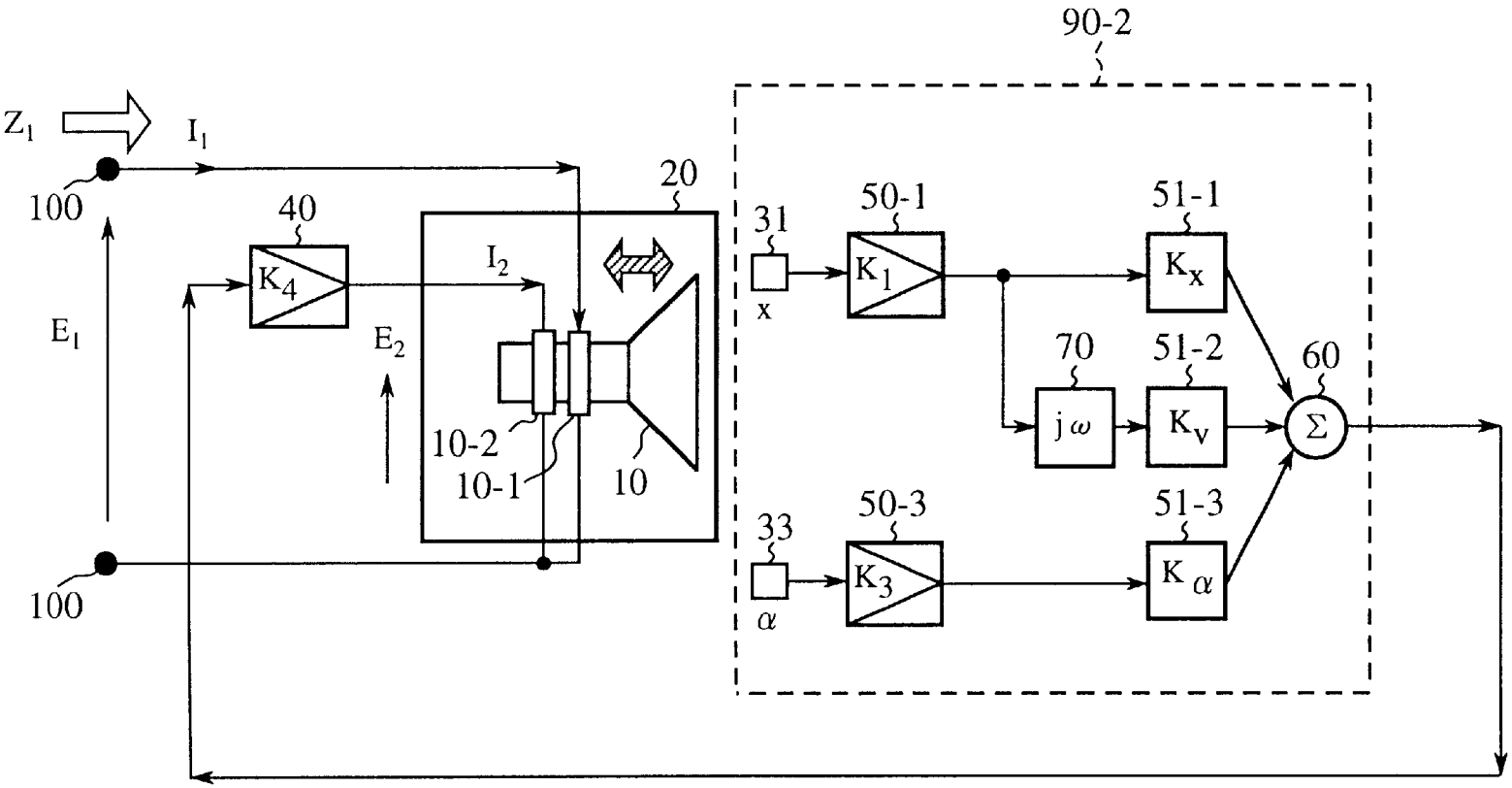
FIG. 23 shows the construction of the MFB speaker system according to a fourteenth embodiment.

FIG. 23 shows the construction of the MFB speaker system according to the fourteenth embodiment. Referring to FIG. 23, numeral 51-1 indicates a signal level adjusting means with a gain $k_x$ for adjusting the level of the signal indicating the vibrational displacement x from the amplifier 50-1, 70 indicates a differentiator for differentiating the signal indicating the vibrational displacement x from the amplifier 50-1 and generating the signal indicating the vibrational velocity v. Numeral 51-2 indicates a signal level adjusting means with a gain $k_v$ for adjusting the level of the signal indicating the vibrational velocity v from the differentiator 70, 51-3 indicates a signal level adjusting means with a gain kα for adjusting the level of the signal indicating the vibrational acceleration α from the amplifier 50-3. The other aspects of the construction are identical to those shown in FIG. 21 of the thirteenth embodiment except that the vibrational velocity detecting means 32 and the amplifier 50-2 are eliminated.

That is, in this embodiment, the vibrational displacement detecting means 31, the vibrational acceleration detecting means 33, the amplifiers 50-1, 50-3, the differentiator 70, the signal level adjusting means 51-1, 51-2, 51-3 and the adder 60 constitute a vibration information detecting means 90-2 of the speaker unit 10.

A description will now be given of the operation.

For example, when an acoustic signal amplified using the power amplifier in the user's possession is input directly, via the input terminal 100, to the first voice coil 10-1 of the speaker unit 10 with the input voltage $E_1$, the diaphragm of the speaker unit 10 vibrates. The vibrational information available in this construction includes the signal indicating the vibrational displacement x output from the vibrational displacement detecting means 31 and the signal indicating the vibrational acceleration a output from the vibrational acceleration detecting means 33.

The signal indicating the vibrational displacement x is then amplified by the amplifier 50-1 to an appropriate level and diverged into two individual signals. One of the diverged vibrational displacement signals is subject to level adjustment by the signal level adjusting means 51-1 and input to the adder 60. The other vibrational displacement signal is converted into the signal indicating the vibrational velocity v by the differentiator 70 and subject to level adjustment by the signal level adjusting means 51-2 before being input to the adder 60.

The signal indicating the vibrational acceleration $\alpha$ from the vibrational acceleration detecting means 33 is amplified by the amplifier 50-3 to an appropriate level and subject to level adjustment by the signal level adjusting means 51-3 before being input to the adder 60.

The signal indicating the vibrational displacement x, the signal indicating the vibrational velocity v and the signal indicating the vibrational acceleration $\alpha$ are added by the adder 60 and output therefrom. That is, the signal proportional to the vibrational displacement x, the signal proportional to the vibrational velocity v and the signal proportional to the vibrational acceleration $\alpha$ are added and output from the vibration information detecting means 90-2 as a sum signal. After being amplified by the power amplifier 40, the sum signal is supplied to the second voice coil 10-2 with a positive or negative polarity with respect to the first voice coil 10-1.

When the signal is supplied with a positive polarity, a positive feedback is set up so that the input voltage $E_2$ proportional to the vibrational displacement x, vibrational velocity v and vibrational acceleration $\alpha$ is supplied to the second voice coil 10-2. From the perspective of the first voice coil 10-1, this is equivalent to an increase of the equivalent mechanical compliance and a decrease of the equivalent mechanical resistance and equivalent mechanical mass in the mechanical equivalent circuit of the entire system.

When the signal is supplied with a negative polarity, a negative feedback is set up so that the input voltage $E_2$ proportional to the vibrational displacement x, vibrational velocity v and vibrational acceleration $\alpha$ is supplied to the second voice coil 10-2 with a negative polarity. From the perspective of the first voice coil 10-1, this is equivalent to a decrease of the equivalent compliance and an increase of the equivalent mechanical resistance and equivalent mechanical mass in the mechanical equivalent circuit of the entire system.

The mechanical equivalent circuit of the MFB speaker system of FIG. 23 and the operation thereof are generally the same as disclosed in FIG. 22 except that the gain $k_1$ of the amplifier is replaced by the product of $k_1$ and $k_x$ and the gain $K_3$ is replaced by the product of $K_3$ and $k\alpha$ in FIG. 22. The negative equivalent mechanical compliance $C_{NG}$ changes with a change in the amplifier 50-1 for amplifying the signal indicating the vibrational displacement x and in the signal level adjusting means 51-1. Consequentially, the negative equivalent mechanical resistance $R_{NG}$ changes with a change in the amplifier 50-2 for amplifying the signal indicating the vibrational velocity v and in the signal level adjusting means 51-2, and the equivalent mechanical mass $M_{NG}$ changes with a change in the amplifier 50-3 for amplifying the signal indicating the vibrational acceleration $\alpha$ and in the signal level adjusting means 51-3.

That is, when the gain is adjusted so as to increase the feedback to the second voice coil 10-2, the negative equivalent mechanical compliance $C_{NG}$ is decreased, as demonstrated by the expression (6), and the negative mechanical resistance $R_{NG}$ and the negative equivalent mechanical mass $M_{NG}$ are increased, as demonstrated by the expressions (7) and (8) above. Consequently, the equivalent mechanical compliance is increased, and the equivalent mechanical resistance and equivalent mechanical mass are decreased from the perspective of the entire speaker system. When the positive feedback is used, the feedback rate is adjusted in the mechanical equivalent circuit shown in FIG. 22 so that none of the entire equivalent mechanical compliance, equivalent mechanical resistance and equivalent mechanical mass becomes negative, thus preventing oscillation of the MFB speaker system.

If the feedback to the second voice coil 10-2 is increased, the lowest resonance frequency $f_0$ drops assuming that the equivalent mechanical ass $M_0$ remains constant, as in the thirteenth embodiment. $Q_0$ varies with the feedback rate of the signal indicating the vibrational displacement x, the signal indicating the vibrational velocity v and the signal indicating the vibrational acceleration $\alpha$.

In the negative feedback, the mechanical equivalent circuit and the operation thereof are generally the same as disclosed in FIG. 22 except that the gain $k_1$ of the amplifier is replaced by the product of $k_1$ and $k_x$, the gain $K_2$ is replaced by the product of $k_1$ and $k_v$, and the gain $K_3$ is replaced by the product of $K_3$ and $k\alpha$. In the negative feedback, the negative equivalent mechanical compliance $C_{NG}$, the negative equivalent mechanical resistance $R_{NG}$ and the negative mechanical mass $M_{NG}$ change to a positive value, and the speaker system operates as a combination of the related-art displacement MFB system, velocity MFB system and acceleration MFB system.

Thus, according to the fourteenth embodiment, the speaker unit 10 of the double voice coil type having the first and second voice coils 10-1 and 10-2 is used, the sum signal composed of the signals respectively proportional to the vibrational displacement x, vibrational velocity v and vibrational acceleration $\alpha$ is amplified by the power amplifier 40 and is input to the second voice coil 10-2, while the acoustic signal is amplified by an external power amplifier and input directly to the first voice coil 10-1. Therefore, the user can use a power amplifier in his or her possession or use an amplifier of his or her own choice.

Embodiment 15

Figure 24:
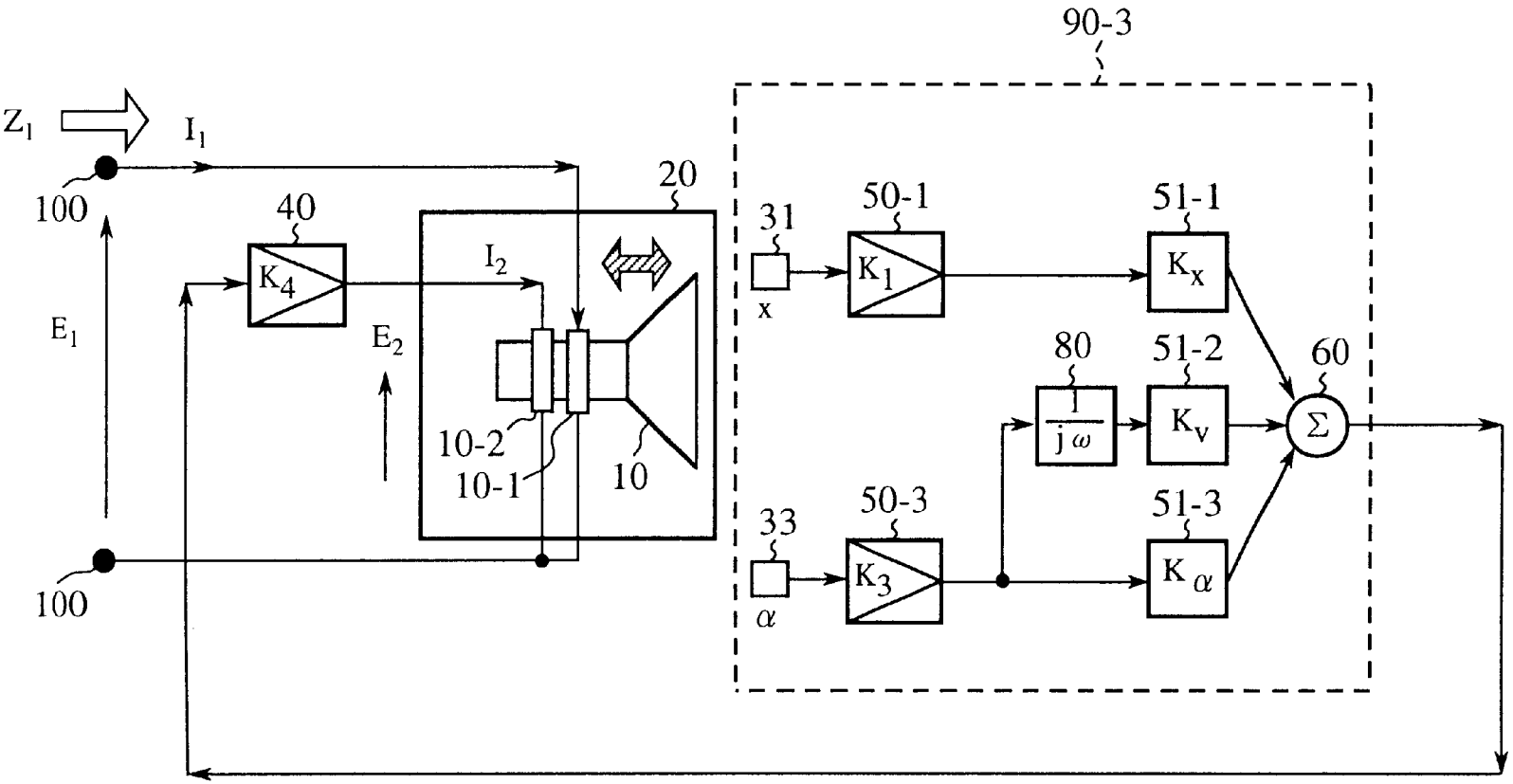
FIG. 24 shows the construction of the MFB speaker system according to a fifteenth embodiment.

FIG. 24 shows the construction of the MFB speaker system according to the fifteenth embodiment. Referring to FIG. 24, numeral 51-1 indicates a signal level adjusting means with a gain $k_x$ for adjusting the level of the signal indicating the vibrational displacement x from the amplifier 50-1, 80 indicates an integrator for integrating the signal indicating the vibrational acceleration $\alpha$ from the amplifier 50-3 and generating the signal indicating the vibrational velocity v. Numeral 51-2 is a signal level adjusting means with a gain $k_v$ for adjusting the level of the-signal indicating the vibrational velocity v from the integrator 80 and 51-3 indicates a signal level adjusting means with a gain $k\alpha$ for adjusting the level of the signal indicating the vibrational acceleration $\alpha$ from the amplifier 50-3. The other aspects of the construction are identical to those shown in FIG. 21 of the thirteenth embodiment except that the vibrational velocity detecting means 32 and the amplifier 50-2 are eliminated.

That is, in this embodiment, the vibrational displacement detecting means 31, the vibrational acceleration detecting means 33, the amplifiers 50-1, 50-3, the integrator 80, the signal level adjusting means 51-1, 51-2, 51-3 and the adder 60 constitute a vibration information detecting means 90-3 of the speaker unit 10.

A description will now be given of the operation.

For example, when an acoustic signal amplified using the power amplifier in the user's possession is input directly, via the input terminal 100, to the first voice coil 10-1 of the speaker unit 10 with the input voltage $E_1$, the diaphragm of the speaker unit 10 vibrates. The vibrational information available in this construction includes the signal indicating the vibrational displacement x output from the vibrational displacement detecting means 31 and the signal indicating the vibrational acceleration $\alpha$ output from the vibrational acceleration detecting means 33.

The signal indicating the vibrational displacement x from the vibrational displacement detecting means 31 is then amplified by the amplifier 50-1 to an appropriate level and subject to level conversion by the signal level adjusting means 51-1.

The signal indicating the vibrational acceleration $\alpha$ from the vibrational acceleration detecting means 33 is amplified by the amplifier 50-3 to an appropriate level and diverged into two individual signals. One of the diverged vibrational acceleration signals is subject to level adjustment by the signal level adjusting means 51-3 and input to the adder 60. The other vibrational acceleration signal is converted into the signal indicating the vibrational velocity v by the integrator 80 and subject to level adjustment by the signal level adjusting means 51-2 before being input to the adder 60.

The signal indicating the vibrational displacement x, the signal indicating the vibrational velocity v and the signal indicating the vibrational acceleration $\alpha$ are added by the adder 60 and output therefrom. That is, the signal proportional to the vibrational displacement x, the signal proportional to the vibrational velocity v and the signal proportional to the vibrational acceleration $\alpha$ are added and output from the vibration information detecting means 90-3 as a sum signal. After being amplified by the power amplifier 40, the sum signal is supplied to the second voice coil 10-2 with a positive or negative polarity with respect to the first voice coil 10-1.

When the signal is supplied with a positive polarity, a positive feedback is set up so that the input voltage $E_2$ proportional to the vibrational displacement x, vibrational velocity v and vibrational acceleration $\alpha$ is supplied to the second voice coil 10-2. From the perspective of the first voice coil 10-1, this is equivalent to an increase of the equivalent mechanical compliance and a decrease of the equivalent mechanical resistance and equivalent mechanical mass in the mechanical equivalent circuit of the entire system.

When the signal is supplied with a negative polarity, a negative feedback is set up so that the input voltage $E_2$ proportional to the vibrational displacement x, vibrational velocity v and vibrational acceleration $\alpha$ is supplied to the second voice coil 10-2 with a negative polarity. From the perspective of the first voice coil 10-1, this is equivalent to a decrease of the equivalent compliance and an increase of the equivalent mechanical resistance and equivalent mechanical mass in the mechanical equivalent circuit of the entire system.

The mechanical equivalent circuit of the MFB speaker system of FIG. 24 and the operation thereof are generally the same as disclosed in FIG. 22 except that the gain $k_1$ of the amplifier is replaced by the product of $k_1$ and $k_x$, the gain $K_2$ is replaced by the product of $K_3$ and $k_x$ and the gain $K_3$ is replaced by the product of $K_3$ and $k\alpha$ in FIG. 22.

The negative equivalent mechanical compliance $C_{NG}$ changes with a change in the amplifier 50-1 for amplifying the signal indicating the vibrational displacement x and in the signal level adjusting means 51-1. Consequentially, the negative equivalent mechanical resistance $R_{NG}$ changes with a change in the amplifier 50-2 for amplifying the signal indicating the vibrational velocity v and in the signal level adjusting means 51-2, and the equivalent mechanical mass $M_{NG}$ changes with a change in the amplifier 50-3 for amplifying the signal indicating the vibrational acceleration $\alpha$ and in the signal level adjusting means 51-3.

That is, when the gain is adjusted so as to increase the feedback to the second voice coil 10-2, the negative equivalent mechanical compliance $C_{NG}$ is decreased, as demonstrated by the expression (6), and the negative mechanical resistance $R_{NG}$ and the negative equivalent mechanical mass $M_{NG}$ are increased, as demonstrated by the expressions (7) and (8) above. Consequently, the equivalent mechanical compliance is increased, and the equivalent mechanical resistance and. equivalent mechanical mass are decreased from the perspective of the entire speaker system. When the positive feedback is used, the feedback rate is adjusted in the mechanical equivalent circuit shown in FIG. 22 so that none of the entire equivalent mechanical compliance, equivalent mechanical resistance and equivalent mechanical mass becomes negative, thus preventing oscillation of the MFB speaker system.

If the feedback to the second voice coil 10-2 is increased, the lowest resonance frequency $f_0$ drops assuming that the equivalent mechanical mass $M_0$ remains constant, as in the thirteenth embodiment. $Q_0$ varies with the feedback rate of the signal indicating the vibrational displacement x, the signal indicating the vibrational velocity v and the signal indicating the vibrational acceleration $\alpha$.

In the negative feedback, the mechanical equivalent circuit and the operation thereof are generally the same as disclosed in FIG. 22 except that the gain $k_1$ of the amplifier is replaced by the product of $k_1$ and $k_x$, the gain $K_2$ is replaced by the product of $K_3$ and $k_v$, and the gain $K_3$ is replaced by the product of $K_3$ and $k\alpha$. In the negative feedback, the negative equivalent mechanical compliance $C_{NG}$, the negative equivalent mechanical resistance $R_{NG}$ and the negative mechanical mass $M_{NG}$ change to a positive value, and the speaker system operates as a combination of the related-art displacement MFB system, velocity MFB system and acceleration MFB system.

Thus, according to the fifteenth embodiment, the speaker unit 10 of the double voice coil type having the first and second voice coils 10-1 and 10-2 is used, the sum signal composed of the signal proportional to the vibrational displacement x, the signal indicating the vibrational velocity v obtained by integrating the signal indicating the vibrational acceleration $\alpha$, and the signal indicating the vibrational acceleration $\alpha$ is amplified by the power amplifier 40 and is input to the second voice coil 10-2, while the acoustic signal is amplified by an external power amplifier and input directly to the first voice coil 10-1. Therefore, the user can use a power amplifier in his or her possession or use an amplifier of his or her own choice.

Embodiment 16

Figure 25:
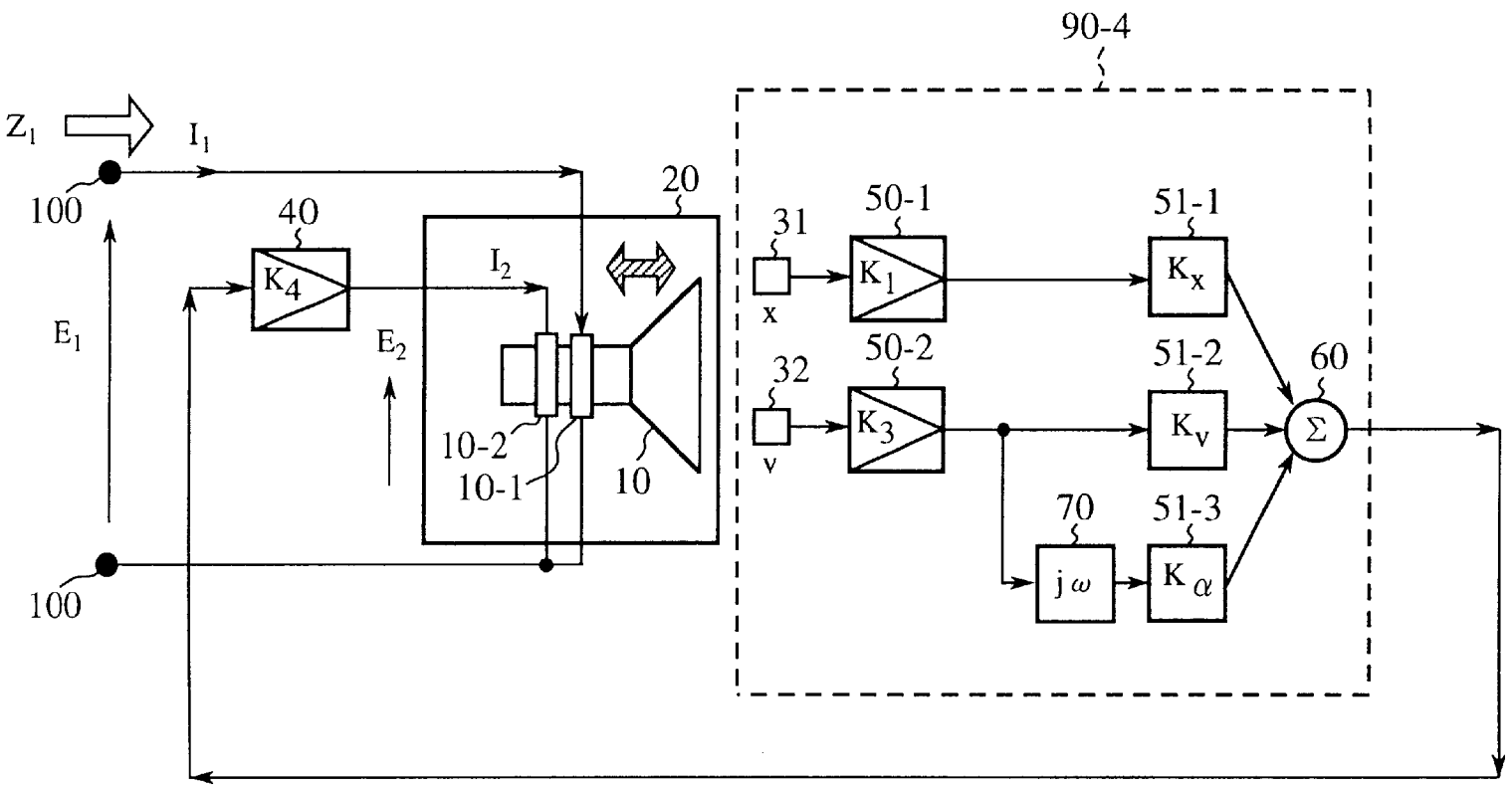
FIG. 25 shows the construction of the MFB speaker system according to a sixteenth embodiment.

FIG. 25 shows the construction of the MFB speaker system according to the sixteenth embodiment. Referring to FIG. 25, numeral 51-1 indicates a signal level adjusting means with a gain $k_x$ for adjusting the level of the signal indicating the vibrational displacement x from the amplifier 50-1 and 51-2 indicates a signal level adjusting means with a gain $k_v$ for adjusting the level of the signal indicating the vibrational velocity v from the amplifier 50-2. Numeral 70 indicates a differentiator for differentiating the signal indicating the vibrational velocity v from the amplifier 50-2 and generating the signal indicating the vibrational acceleration $\alpha$ and 51-3 indicates a signal level adjusting means with a gain $k\alpha$ for adjusting the level of the signal indicating the vibrational acceleration $\alpha$ from the differentiator 70. The other aspects of the construction are identical to those shown in FIG. 21 of the thirteenth embodiment except that the vibrational acceleration detecting means 33 and the amplifier 50-3 are eliminated.

That is, in this embodiment, the vibrational displacement detecting means 31, the vibrational velocity detecting means 32, the amplifiers 50-1, 50-2, the differentiator 70, the signal level adjusting means 51-1, 51-2, 51-3 and the adder 60 constitute a vibration information detecting means 90-4 of the speaker unit 10.

A description will now be given of the operation.

For example, when an acoustic signal amplified using the power amplifier in the user's possession is input directly, via the input terminal 100, to the first voice coil 10-1 of the speaker unit 10 with the input voltage $E_1$, the diaphragm of the speaker unit 10 vibrates. The vibrational information available in this construction includes the signal indicating the vibrational displacement x output from the vibrational displacement detecting means 31 and the signal indicating the vibrational velocity v output from the vibrational velocity detecting means 32.

The signal indicating the vibrational displacement x from the vibrational displacement detecting means 31 is amplified by the amplifier 50-1 to an appropriate level and subject to level conversion by the signal level adjusting means 51-1 before being input to the adder 60.

The signal indicating the vibrational velocity v from the vibrational velocity detecting means 33 is amplified by the amplifier 50-2 to an appropriate level and diverged into two individual signals. One of the diverged vibrational velocity signals is subject to level adjustment by the signal level adjusting means 51-2 and input to the adder 60. The other vibrational velocity signal is converted into the signal indicating the vibrational acceleration $\alpha$ by the differentiator 70 and subject to level adjustment by the signal level adjusting means 51-3 before being input to the adder 60.

The signal indicating the vibrational displacement x, the signal indicating the vibrational velocity v and the signal indicating the vibrational acceleration $\alpha$ are added by the adder 60 and output therefrom. That is, the signal proportional to the vibrational displacement x, the signal proportional to the vibrational velocity v and the signal proportional to the vibrational acceleration $\alpha$ are added and output from the vibration information detecting means 90-4 as a sum signal. After being amplified by the power amplifier 40, the sum signal is supplied to the second voice coil 10-2 with a positive or negative polarity with respect to the first voice coil 10-1.

When the signal is supplied with a positive polarity, a positive feedback is set up so that the input voltage $E_2$ proportional to the vibrational displacement x, vibrational velocity v and vibrational acceleration $\alpha$ is supplied to the second voice coil 10-2. From the perspective of the first voice coil 10-1, this is equivalent to an increase of the equivalent mechanical compliance and a decrease of the equivalent mechanical resistance and equivalent mechanical mass in the mechanical equivalent circuit of the entire system.

When the signal is supplied with a negative polarity, a negative feedback is set up so that the input voltage $E_2$ proportional to the vibrational displacement x, vibrational velocity v and vibrational acceleration $\alpha$ is supplied to the second voice coil 10-2 with a negative polarity. From the perspective of the first voice coil 10-1, this is equivalent to a decrease of the equivalent compliance and an increase of the equivalent mechanical resistance and equivalent mechanical mass in the mechanical equivalent circuit of the entire system.

The mechanical equivalent circuit of the MFB speaker system of FIG. 25 and the operation thereof are generally the same as disclosed in FIG. 22 except that the gain $k_1$ of the amplifier is replaced by the product of $k_1$ and $k_x$, the gain $K_2$ is replaced by the product of $K_2$ and $k_v$ and the gain $K_3$ is replaced by the product of $K_2$ and $k\alpha$ in FIG. 22.

The negative equivalent mechanical compliance $C_{NG}$ changes with a change in the amplifier 50-1 for amplifying the signal indicating the vibrational displacement x and in the signal level adjusting means 51-1. The negative equivalent mechanical resistance $R_{NG}$ changes with a change in the amplifier 50-2 for amplifying the signal indicating the vibrational velocity v and in the signal level adjusting means 51-2. Consequently, the equivalent mechanical mass v changes with a change in the amplifier 50-3 for amplifying the signal indicating the vibrational acceleration $\alpha$ and in the signal level adjusting means 51-3.

That is, when the gain is adjusted so as to increase the feedback to the second voice coil 10-2, the negative equivalent mechanical compliance $C_{NG}$ is decreased, as demonstrated by the expression (6), and the negative mechanical resistance $R_{NG}$ and the negative equivalent mechanical mass $M_{NG}$ are increased, as demonstrated by the expression's (7) and (8) above. Consequently, the equivalent mechanical compliance is increased, and the equivalent mechanical resistance and equivalent mechanical mass are decreased from the perspective of the entire speaker system. When the positive feedback is used, the feedback rate is adjusted in the mechanical equivalent circuit shown in FIG. 22 so that none of the entire equivalent mechanical compliance, equivalent mechanical resistance and equivalent mechanical mass becomes negative, thus preventing oscillation of the MFB speaker system.

If the feedback to the second voice coil 10-2 is increased, the lowest resonance frequency $f_0$ drops assuming that the equivalent mechanical mass $M_0$ remains constant, as in the thirteenth embodiment. $Q_0$ varies with the feedback rate of the signal indicating the vibrational displacement x, the signal indicating the vibrational velocity v and the signal indicating the vibrational acceleration $\alpha$.

In the negative feedback, the mechanical equivalent circuit and the operation thereof are generally the same as disclosed in FIG. 22 except that the gain $k_1$ of the amplifier is replaced by the product of $k_1$ and $k_x$, the gain $K_2$ is replaced by the product of $K_2$ and $k_v$, and the gain $K_3$ is replaced by the product of $K_2$ and $k\alpha$. In the negative feedback, the negative equivalent mechanical compliance $C_{NG}$, the negative equivalent mechanical resistance $R_{NG}$ and the negative mechanical mass $M_{NG}$ change to a positive value, and the speaker system operates as a combination of the related-art displacement MFB system, velocity MFB system and acceleration MFB system.

Thus, according to the sixth embodiment, the speaker unit 10 of the double voice coil type having the first and second voice coils 10-1 and 10-2 is used, the sum signal composed of the signal proportional to the vibrational displacement x, the signal indicating the vibrational velocity v and the signal indicating the vibrational acceleration $\alpha$ obtained by differentiating the signal indicating the vibrational velocity v is amplified by the power amplifier 40 and is input to the second voice coil 10-2, while the acoustic signal is amplified by an external power amplifier and input directly to the first voice coil 10-1. Therefore, the user can use a power amplifier in his or her possession or use an amplifier of his or her own choice.

Embodiment 17

Figure 26:
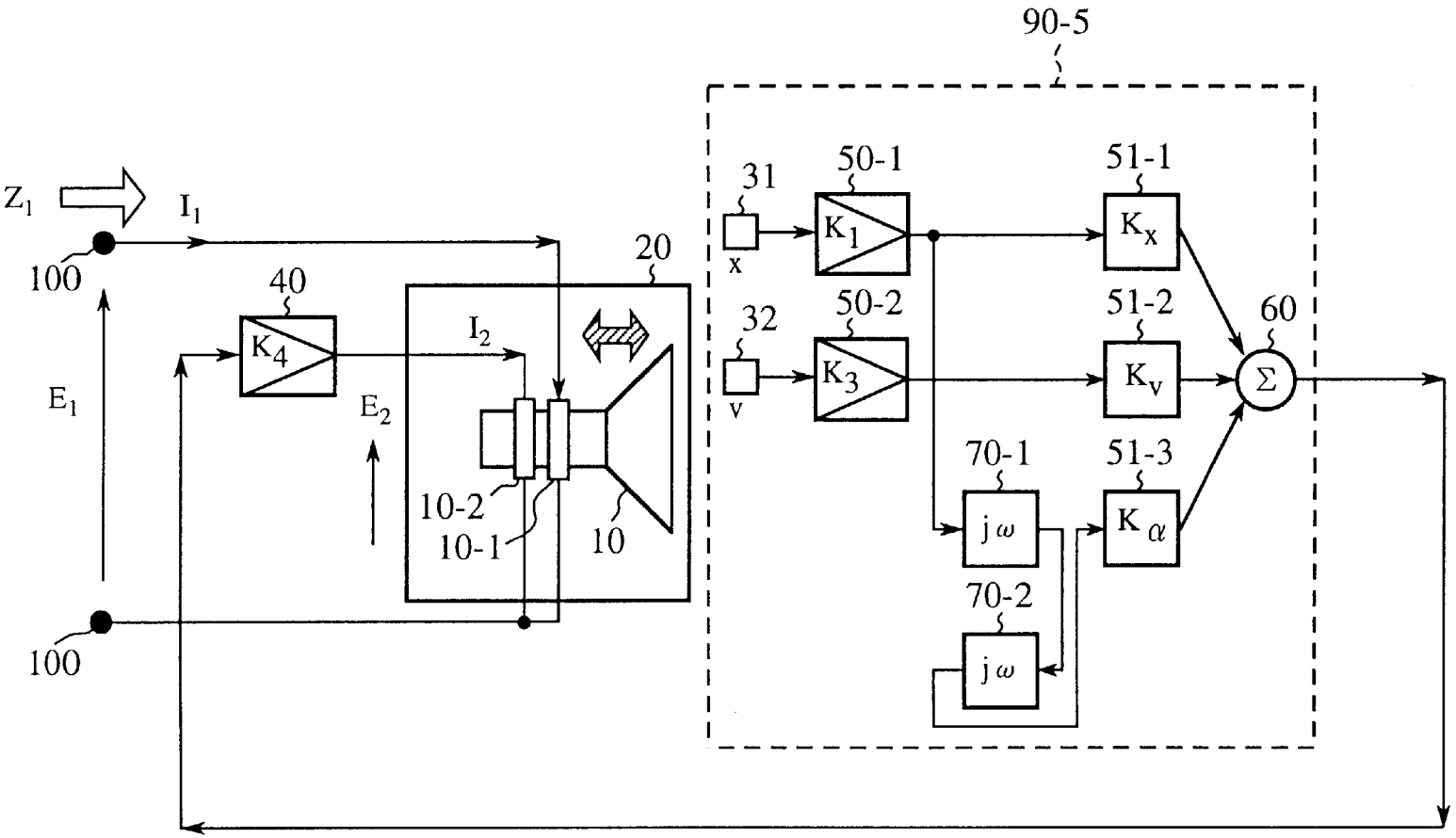
FIG. 26 shows the construction of the MFB speaker system according to a seventeenth embodiment.

FIG. 26 shows the construction of the MFB speaker system according to the seventeenth embodiment. Referring to FIG. 26, numerals 70-1 and 70-2 indicates differentiators for twice-differentiating the signal indicating the vibrational displacement x from the amplifier 50-1 and generating the signal indicating the vibrational acceleration $\alpha$ and 51-1 indicates a signal level adjusting means with a gain $k_x$ for adjusting the level of the signal indicating the vibrational displacement x from the amplifier 50-1.

Numeral 51-2 indicates a signal level adjusting means with a gain $k_v$ for adjusting the level of the signal indicating the vibrational velocity v from the amplifier 50-2 and 51-3 indicates a signal level adjusting means with a gain $k\alpha$ for adjusting the level of the signal indicating the vibrational acceleration $\alpha$ generated by the differentiators 70-1 and 70-2. The other aspects of the construction are identical to those shown in FIG. 21 of the thirteenth embodiment except that the vibrational acceleration detecting means 33 and the amplifier 50-3 are eliminated.

That is, in this embodiment, the vibrational displacement detecting means 31, the vibrational velocity detecting means 32, the amplifiers 50-1, 50-2, the differentiators 70-1, 70-2, the signal level adjusting means 51-1, 51-2, 51-3, and the adder 60 constitute a vibration information detecting means 90-5 of the speaker unit 10.

A description will now be given of the operation.

For example, when an acoustic signal amplified using the power amplifier in the user's possession is input directly, via the input terminal 100, to the first voice coil 10-1 of the speaker unit 10 with the input voltage $E_1$, the diaphragm of the speaker unit 10 vibrates. The vibrational information available in this construction includes the signal indicating the vibrational displacement x output from the vibrational displacement detecting means 31 and the signal indicating the vibrational velocity v output from the vibrational velocity detecting means 32.

The signal indicating the vibrational displacement x is then amplified by the amplifier 50-1 to an appropriate level and diverged into two individual signals. One of the diverged vibrational displacement signals is subject to level adjustment by the signal level adjusting means 51-1 and input to the adder 60.

The other vibrational displacement signal is converted into the signal indicating the vibrational acceleration $\alpha$ by being differentiated twice by the differentiators 70-1 and 70-2, and is then subject to level adjustment by the signal level adjusting means 51-3 before being input to the adder 60.

The signal indicating the vibrational velocity v from the vibrational velocity detecting means 32 is amplified by the amplifier 50-2 to an appropriate level and subject to level adjustment by the signal level adjusting means 51-2 before being input to the adder 60.

The signal indicating the vibrational displacement x, the signal indicating the vibrational velocity v and the signal indicating the vibrational acceleration $\alpha$ are added by the adder 60 and output therefrom. That is, the signal proportional to the vibrational displacement x, the signal proportional to the vibrational velocity v and the signal proportional to the vibrational acceleration $\alpha$ are added and output from the vibration information detecting means 90-6 as a sum signal. After being amplified by the power amplifier 40, the sum signal is supplied to the second voice coil 10-2 with a positive or negative polarity with respect to the first voice coil 10-1.

When the signal is supplied with a positive polarity, a positive feedback is set up so that the input voltage E2 proportional to the vibrational displacement x, vibrational velocity v and vibrational acceleration $\alpha$ is supplied to the second voice coil 10-2. From the perspective of the first voice coil 10-1, this is equivalent to an increase of the equivalent mechanical compliance and a decrease of the equivalent mechanical resistance and equivalent mechanical mass in the mechanical equivalent circuit of the entire system.

When the signal is supplied with a negative polarity, a negative feedback is set up so that the input voltage E2 proportional to the vibrational displacement x, vibrational velocity v and vibrational acceleration $\alpha$ is supplied to the second voice coil 10-2 with a negative polarity. From the perspective of the first voice coil 10-1, this is equivalent to a decrease of the equivalent compliance and an increase of the equivalent mechanical resistance and equivalent mechanical mass in the mechanical equivalent circuit of the entire system.

The mechanical equivalent circuit of the MFB speaker system of FIG. 26 and the operation thereof are generally the same as disclosed in FIG. 22 except that the gain $k_1$ of the amplifier is replaced by the product of $k_1$ and $k_x$, the gain $K_2$ is replaced by the product of $K_2$ and $k_v$ and the gain $K_3$ is replaced by the product of $k_1$ and $k\alpha$ in FIG. 22.

The negative equivalent mechanical compliance $C_{NG}$ changes with a change in the amplifier 50-1 for amplifying the signal indicating the vibrational displacement x and in the signal level adjusting means 51-1. The negative equivalent mechanical resistance $R_{NG}$ changes with a change in the amplifier 50-2 for amplifying the signal indicating the vibrational velocity v and in the signal level adjusting means 51-2. Consequently, the equivalent mechanical mass $M_{NG}$ changes with a change in the amplifier 50-3 for amplifying the signal indicating the vibrational acceleration $\alpha$ and in the signal level adjusting means 51-3.

That is, when the gain is adjusted so as to increase the feedback to the second voice coil 10-2, the negative equivalent mechanical compliance $C_{NG}$ is decreased, as demonstrated by the expression (6), and the negative mechanical resistance $R_{NG}$ and the negative equivalent mechanical mass v are increased, as demonstrated by the expressions (7) and (8) above. Consequently, the equivalent mechanical compliance is increased, and the equivalent mechanical resistance and equivalent mechanical mass are decreased from the perspective of the entire speaker system. When the positive feedback is used, the feedback rate is adjusted in the mechanical equivalent circuit shown in FIG. 22 so that none of the entire equivalent mechanical compliance, equivalent mechanical resistance and equivalent mechanical mass becomes negative, thus preventing oscillation of the MFB speaker system.

If the feedback to the second voice coil 10-2 is increased, the lowest resonance frequency $f_0$ drops assuming that the equivalent mechanical mass $M_0$ remains constant, as in the thirteenth embodiment. $Q_0$ varies with the feedback rate of the signal indicating the vibrational displacement x, the signal indicating the vibrational velocity v and the signal indicating the vibrational acceleration $\alpha$.

In the negative feedback, the mechanical equivalent circuit and the operation thereof are generally the same as disclosed in FIG. 22 except that the gain $k_1$ of the amplifier is replaced by the product of $k_1$ and $k_x$, the gain $K_2$ is replaced by the product of $K_2$ and $k_v$, and the gain $K_3$ is replaced by the product of $k_1$ and $k\alpha$. In the negative feedback, the negative equivalent mechanical compliance $C_{NG}$, the negative equivalent mechanical resistance $R_{NG}$ and the negative mechanical mass $M_{NG}$ change to a positive value, and the speaker system operates as a combination of the related-art displacement MFB system, velocity MFB system and acceleration MFB system.

Thus, according to the seventeenth embodiment, the speaker unit 10 of the double voice coil type having the first and second voice coils 10-1 and 10-2 is used, the sum signal composed of the signal indicating the vibrational displacement x, the signal indicating the vibrational velocity v and the signal indicating the vibrational acceleration $\alpha$ obtained by differentiating the signal indicating the vibrational displacement x twice is amplified by the power amplifier 40 and is input to the second voice coil 10-2, while the acoustic signal is amplified by an external power amplifier and input directly to the first voice coil 10-1. Therefore, the user can use a power amplifier in his or her possession or use an amplifier of his or her own choice.

Embodiment 18

Figure 27:
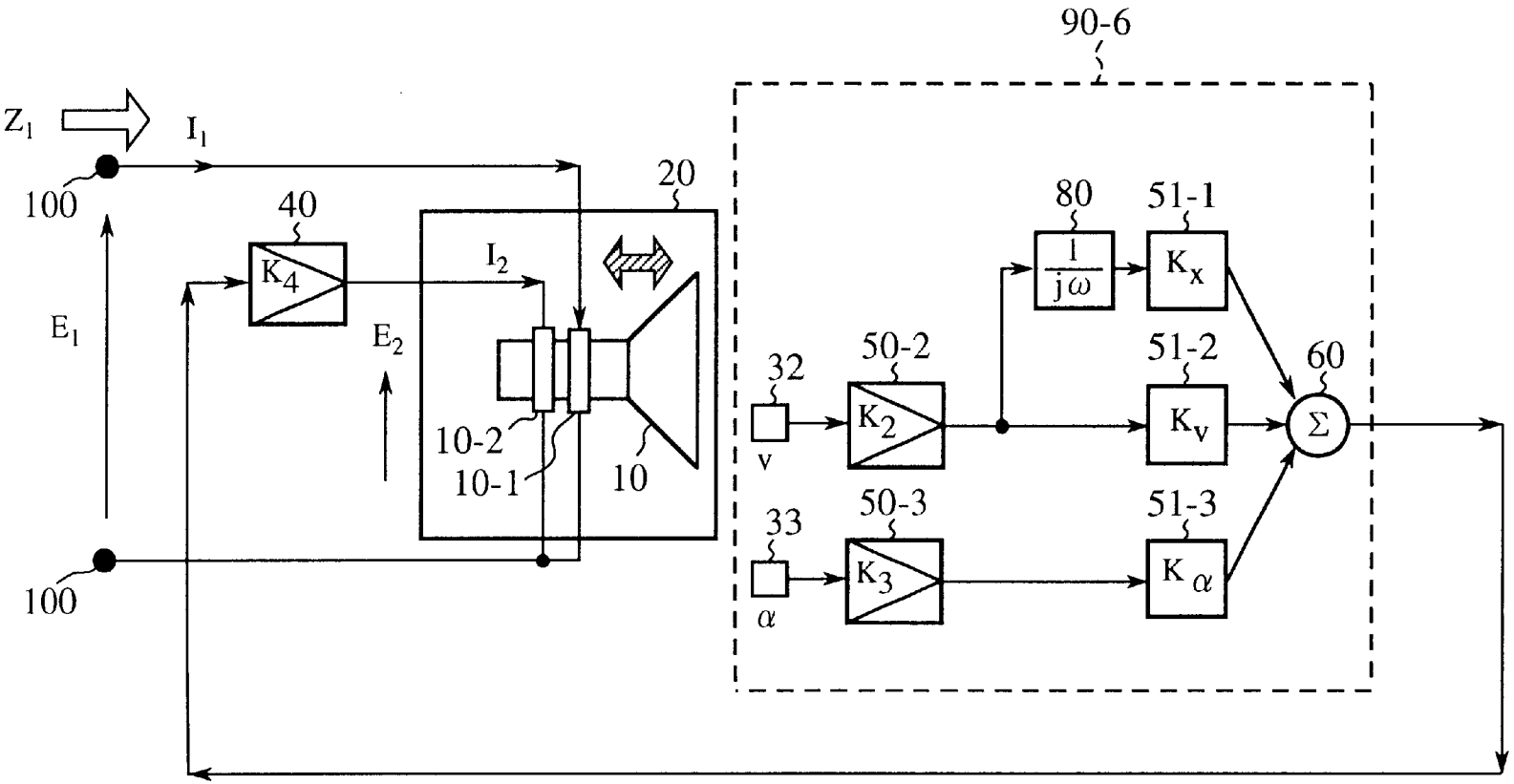
FIG. 27 shows the construction of the MFB speaker system according to an eighteenth embodiment.

FIG. 27 shows the construction of the MFB speaker system according to the eighteenth embodiment. Referring to FIG. 27, numeral 80 indicates an integrator for integrating the signal indicating the vibrational velocity v from the amplifier 50-2 and generating the signal indicating the vibrational displacement x and 51-1 indicates a signal level adjusting means with a gain $k_x$ for adjusting the level of the signal indicating the vibrational displacement x from the integrator 80. Numeral 51-2 indicates a signal level adjusting means with a gain $k_v$ for adjusting the level of the signal indicating the vibrational velocity v from the amplifier 50-2 and 51-3 indicates a signal level adjusting means with a gain $k\alpha$ for adjusting the level of the signal indicating the vibrational acceleration $\alpha$ from the amplifier 50-3. The other aspects of the construction are identical to those shown in FIG. 21 of the thirteenth embodiment except that the vibrational displacement detecting means 31 and the amplifier 50-1 are eliminated.

That is, in this embodiment, the vibrational velocity detecting means 32, the vibrational acceleration detecting means 33, the amplifiers 50-2, 50-3, the integrator 80, the signal level adjusting means 51-1, 51-2, 51-3, and the adder 60 constitute a vibration information detecting means 90-6 of the speaker unit 10.

A description will now be given of the operation.

For example, when an acoustic signal amplified using the power amplifier in the user's possession is input directly, via the input terminal 100, to the first voice coil 10-1 of the speaker unit 10 with the input voltage $E_1$, the diaphragm of the speaker unit 10 vibrates. The vibrational information available in this construction includes the signal indicating the vibrational velocity v output from the vibrational displacement detecting means 32 and the signal indicating the vibrational acceleration $\alpha$ output from the vibrational velocity detecting means 33.

The signal indicating the vibrational velocity v is then amplified by the amplifier 50-2 to an appropriate level and diverged into two individual signals. One of the diverged vibrational velocity signals is subject to level adjustment by the signal level adjusting means 51-2 and input to the adder 60. The other vibrational velocity signal is converted into the signal indicating the vibrational displacement x by being integrated by the integrator 80, and is then subject to level adjustment by the signal level adjusting means 51-1 before being input to the adder 60.

The signal indicating the vibrational acceleration $\alpha$ from the vibrational acceleration detecting means 33 is amplified by the amplifier 50-3 to an appropriate level and subject to level adjustment by the signal level adjusting means 51-3 before being input to the adder 60.

The signal indicating the vibrational displacement x, the signal indicating the vibrational velocity v and the signal indicating the vibrational acceleration $\alpha$ are added by the adder 60 and output therefrom. That is, the signal proportional to the vibrational displacement x, the signal proportional to the vibrational velocity v and the signal proportional to the vibrational acceleration $\alpha$ are added and output from the vibration information detecting means 90-6 as a sum signal. After being amplified by the power amplifier 40, the sum signal is supplied to the second voice coil 10-2 with a positive or negative polarity with respect to the first voice coil 10-1.

When the signal is supplied with a positive polarity, a positive feedback is set up so that the input voltage $E_2$ proportional to the vibrational displacement x, vibrational velocity v and vibrational acceleration $\alpha$ is supplied to the second voice coil 10-2. From the perspective of the first voice coil 10-1, this is equivalent to an increase of the equivalent mechanical compliance and a decrease of the equivalent mechanical resistance and equivalent mechanical mass in the mechanical equivalent circuit of the entire system.

When the signal is supplied with a negative polarity, a negative feedback is set up so that the input voltage $E_2$ proportional to the vibrational displacement x, vibrational velocity v and vibrational acceleration $\alpha$ is supplied to the second voice coil 10-2 with a negative polarity.

From the perspective of the first voice coil 10-1, this is equivalent to a decrease of the equivalent compliance and an increase of the equivalent mechanical resistance and equivalent mechanical mass in the mechanical equivalent circuit of the entire system.

The mechanical equivalent circuit of the MFB speaker system of FIG. 27 and the operation thereof are generally the same as disclosed in FIG. 22 except that the gain $k_1$ of the amplifier is replaced by the product of $K_2$ and $k_x$, the gain $K_2$ is replaced by the product of $K_2$ and $k_v$ and the gain $K_3$ is replaced by the product of $K_3$ and $k\alpha$ in FIG. 22.

The negative equivalent mechanical compliance $C_{NG}$ changes with a change in the amplifier 50-1 for amplifying the signal indicating the vibrational displacement x and in the signal level adjusting means 51-1, the negative equivalent mechanical resistance $R_{NG}$ changes with a change in the amplifier 50-2 for amplifying the signal indicating the vibrational velocity v and in the signal level adjusting means 51-2, and the equivalent mechanical mass $M_{NG}$ changes with a change in the amplifier 50-3 for amplifying the signal indicating the vibrational acceleration $\alpha$ and in the signal level adjusting means 51-3.

That is, when the gain is adjusted so as to increase the feedback to the second voice coil 10-2, the negative equivalent mechanical compliance $C_{NG}$ is decreased, as demonstrated by the expression (6), and the negative mechanical resistance $R_{NG}$ and the negative equivalent mechanical mass $M_{NG}$ are increased, as demonstrated by the expression's (7) and (8) above. Consequently, the equivalent mechanical compliance is increased, and the equivalent mechanical resistance and equivalent mechanical mass are decreased from the perspective of the entire speaker system. When the positive feedback is used, the feedback rate is adjusted in the mechanical equivalent circuit shown in FIG. 22 so that none of the entire equivalent mechanical compliance, equivalent mechanical resistance and equivalent mechanical mass becomes negative, thus preventing oscillation of the MFB speaker system.

If the feedback to the second voice coil 10-2 is increased, the lowest resonance frequency $f_0$ drops assuming that the equivalent mechanical mass $M_0$ remains constant, as in the thirteenth embodiment. $Q_0$ varies with the feedback rate of the signal indicating the vibrational displacement x, the signal indicating the vibrational velocity v and the signal indicating the vibrational acceleration α.

In the negative feedback, the mechanical equivalent circuit and the operation thereof are generally the same as disclosed in FIG. 22 except that the gain $k_1$ of the amplifier is replaced by the product of $K_2$ and $k_x$, the gain $K_2$ is replaced by the product of $K_2$ and $k_v$, and the gain $K_3$ is replaced by the product of $K_3$ and kα. In the negative feedback, the negative equivalent mechanical compliance $C_{NG}$, the negative equivalent mechanical resistance $R_{NG}$ and the negative mechanical mass $M_{NG}$ change to a positive value, and the speaker system operates as a combination of the related-art displacement MFB system, velocity MFB system and acceleration MFB system.

Thus, according to the eighteenth embodiment, the speaker unit 10 of the double voice coil type having the first and second voice coils 10-1 and 10-2 is used, the sum signal composed of the signal indicating the vibrational displacement x, the signal indicating the vibrational velocity v and the signal indicating the vibrational acceleration α is amplified by the power amplifier 40 and is input to the second voice coil 10-2, while the acoustic signal is amplified by an external power amplifier and input directly to the first voice coil 10-1. Therefore, the user can use a power amplifier in his or her possession or use an amplifier of his or her own choice.

Embodiment 19

Figure 28:
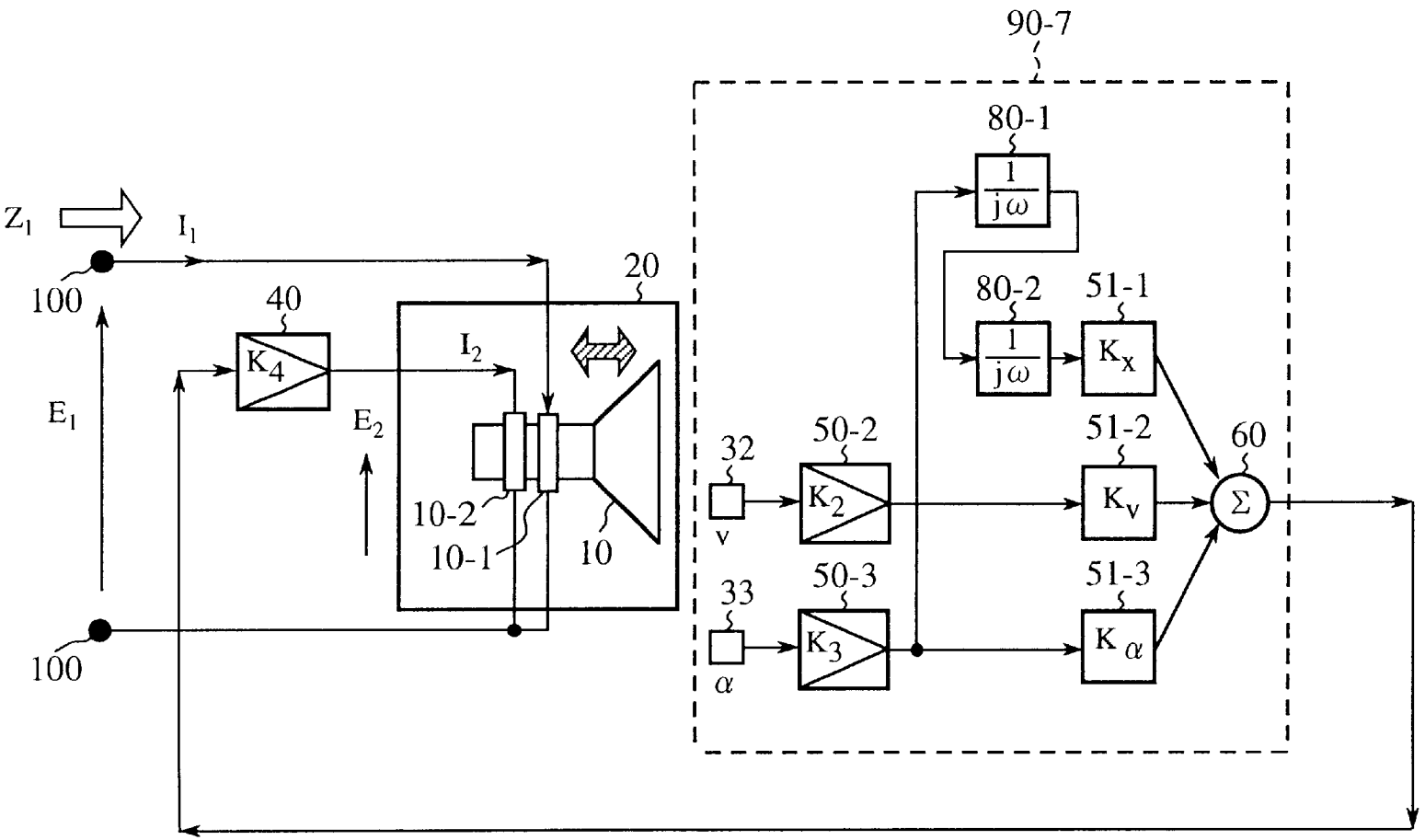
FIG. 28 shows the construction of the MFB speaker system according to a nineteenth embodiment.

FIG. 28 shows the construction of the MFB speaker system according to the nineteenth embodiment. Referring to FIG. 28, numerals 80-1 and 80-2 indicate integrators for integrating the signal indicating the vibrational acceleration α from the amplifier 50-3 twice and generating the signal indicating the vibrational displacement x and 51-1 indicates a signal level adjusting means with a gain $k_x$ for adjusting the level of the signal indicating the vibrational displacement x generated by the integrators 80-1 and 80-2. Numeral 51-2 indicates a signal level adjusting means with a gain $k_v$ for adjusting the level of the signal indicating the vibrational velocity v from the amplifier 50-2 and 51-3 indicates a signal level adjusting means with a gain kα for adjusting the level of the signal indicating the vibrational acceleration α from the amplifier 50-3. The other aspects of the construction are identical to those shown in FIG. 21 of the thirteenth embodiment except that the vibrational displacement detecting means 31 and the amplifier 50-1 are eliminated.

That is, in this embodiment, the vibrational velocity detecting means 32, the vibrational acceleration detecting means 33, the amplifiers 50-2, 50-3, the integrator 80-1, 80-2, the signal level adjusting means 51-1, 51-2, 51-3 and the adder 60 constitute a vibration information detecting means 90-7.

A description will now be given of the operation.

For example, when an acoustic signal amplified using the power amplifier in the user's possession is input directly, via the input terminal 100, to the first voice coil 10-1 of the speaker unit 10 with the input voltage $E_1$, the diaphragm of the speaker unit 10 vibrates. The vibrational information available in this construction includes the signal indicating the vibrational velocity v output from the vibrational displacement detecting means 32 and the signal indicating the vibrational acceleration α output from the vibrational velocity detecting means 33.

The signal indicating the vibrational velocity from the vibrational velocity detecting means 32 is amplified by the amplifier 50-2 to an appropriate level and subject to level conversion by the signal level adjusting means 51-2 before being input to the adder 60.

The signal indicating the vibrational acceleration α from the vibrational acceleration detecting means 33 is amplified by the amplifier 50-3 to an appropriate level and diverged into two individual signals. One of the diverged vibrational velocity signals is subject to level adjustment by the signal level adjusting means 51-3 and input to the adder 60. The other vibrational acceleration signal is converted into the signal indicating the vibrational displacement by being integrated twice by the integrators 80-1 and 80-2, and is subject to level adjustment by the signal level adjusting means 51-1 before being input to the adder 60.

The signal indicating the vibrational displacement x, the signal indicating the vibrational velocity v and the signal indicating the vibrational acceleration α are added by the adder 60 and output therefrom. That is, the signal proportional to the vibrational displacement x, the signal proportional to the vibrational velocity v and the signal proportional to the vibrational acceleration α are added and output from the vibration information detecting means 90-7 as a sum signal. After being amplified by the power amplifier 40, the sum signal is supplied to the second voice coil 10-2 with a positive or negative polarity with respect to the first voice coil 10-1.

When the signal is supplied with a positive polarity, a positive feedback is set up so that the input voltage E2 proportional to the vibrational displacement x, vibrational velocity v and vibrational acceleration α is supplied to the second voice coil 10-2. From the perspective of the first voice coil 10-1, this is equivalent to an increase of the equivalent mechanical compliance and a decrease of the equivalent mechanical resistance and equivalent mechanical mass in the mechanical equivalent circuit of the entire system.

When the signal is supplied with a negative polarity, a negative feedback is set up so that the input voltage $E_2$ proportional to the vibrational displacement x, vibrational velocity v and vibrational acceleration α is supplied to the second voice coil 10-2 with a negative polarity. From the perspective of the first voice coil 10-1, this is equivalent to a decrease of the equivalent compliance and an increase of the equivalent mechanical resistance and equivalent mechanical mass in the mechanical equivalent circuit of the entire system.

The mechanical equivalent circuit of the MFB speaker system of FIG. 28 and the operation thereof are generally the same as disclosed in FIG. 22 except that the gain $k_1$ of the amplifier is replaced by the product of $K_3$ and $k_x$, the gain $K_2$ is replaced by the product of $K_2$ and $k_v$ and the gain $K_3$ is replaced by the product of $K_3$ and kα in FIG. 22.

The negative equivalent mechanical compliance $C_{NG}$ changes with a change in the amplifier 50-1 for amplifying the signal indicating the vibrational displacement x and in the signal level adjusting means 51-1. The negative equivalent mechanical resistance $R_{NG}$ changes with a change in the amplifier 50-2 for amplifying the signal indicating the vibrational velocity v and in the signal level adjusting means 51-2. The equivalent mechanical mass $M_{NG}$ changes with a change in the amplifier 50-3 for amplifying the signal indicating the vibrational acceleration $\alpha$ and in the signal level adjusting means 51-3. That is, when the gain is adjusted so as to increase the feedback to the second voice coil 10-2, the negative equivalent mechanical compliance $C_{NG}$ is decreased, as demonstrated by the expression (6), and the negative mechanical resistance $R_{NG}$ and the negative equivalent mechanical mass $M_{NG}$ are increased, as demonstrated by the expression's (7) and (8) above. Consequently, the equivalent mechanical compliance is increased, and the equivalent mechanical resistance and equivalent mechanical mass are decreased from the perspective of the entire speaker system. When the positive feedback is used, the feedback rate is adjusted in the mechanical equivalent circuit shown in FIG. 22 so that none of the entire equivalent mechanical compliance, equivalent mechanical resistance and equivalent mechanical mass becomes negative, thus preventing oscillation of the MFB speaker system.

If the feedback to the second voice coil 10-2 is increased, the lowest resonance frequency $f_0$ drops assuming that the equivalent mechanical mass $M_0$ remains constant, as in the thirteenth embodiment. $Q_0$ varies with the feedback rate of the signal indicating the vibrational displacement x, the signal indicating the vibrational velocity v and the signal indicating the vibrational acceleration $\alpha$.

In the negative feedback, the mechanical equivalent circuit and the operation thereof are generally the same as disclosed in FIG. 22 except that the gain $k_1$ of the amplifier is replaced by the product of $K_3$ and $k_x$, the gain $K_2$ is replaced by the product of $K_2$ and $k_v$, and the gain $K_3$ is replaced by the product of $K_3$ and $k\alpha$. In the negative feedback, the negative equivalent mechanical compliance $C_{NG}$, the negative equivalent mechanical resistance $R_{NG}$ and the negative mechanical mass $M_{NG}$ change to a positive value, and the speaker system operates as a combination of the related-art displacement MFB system, velocity MFB system and acceleration MFB system.

Thus, according to the nineteenth embodiment, the speaker unit 10 of the double voice coil type having the first and second voice coils 10-1 and 10-2 is used, the sum signal composed of the signal proportional to the vibrational displacement x, the signal indicating the vibrational velocity v and the signal indicating the vibrational acceleration $\alpha$ obtained by differentiating the signal indicating the vibrational velocity v is amplified by the power amplifier 40 and is input to the second voice coil 10-2, while the acoustic signal is amplified by an external power amplifier and input directly to the first voice coil 10-1. Therefore, the user can use a power amplifier in his or her possession or use an amplifier of his or her own choice.

Embodiment 20

Figure 29:
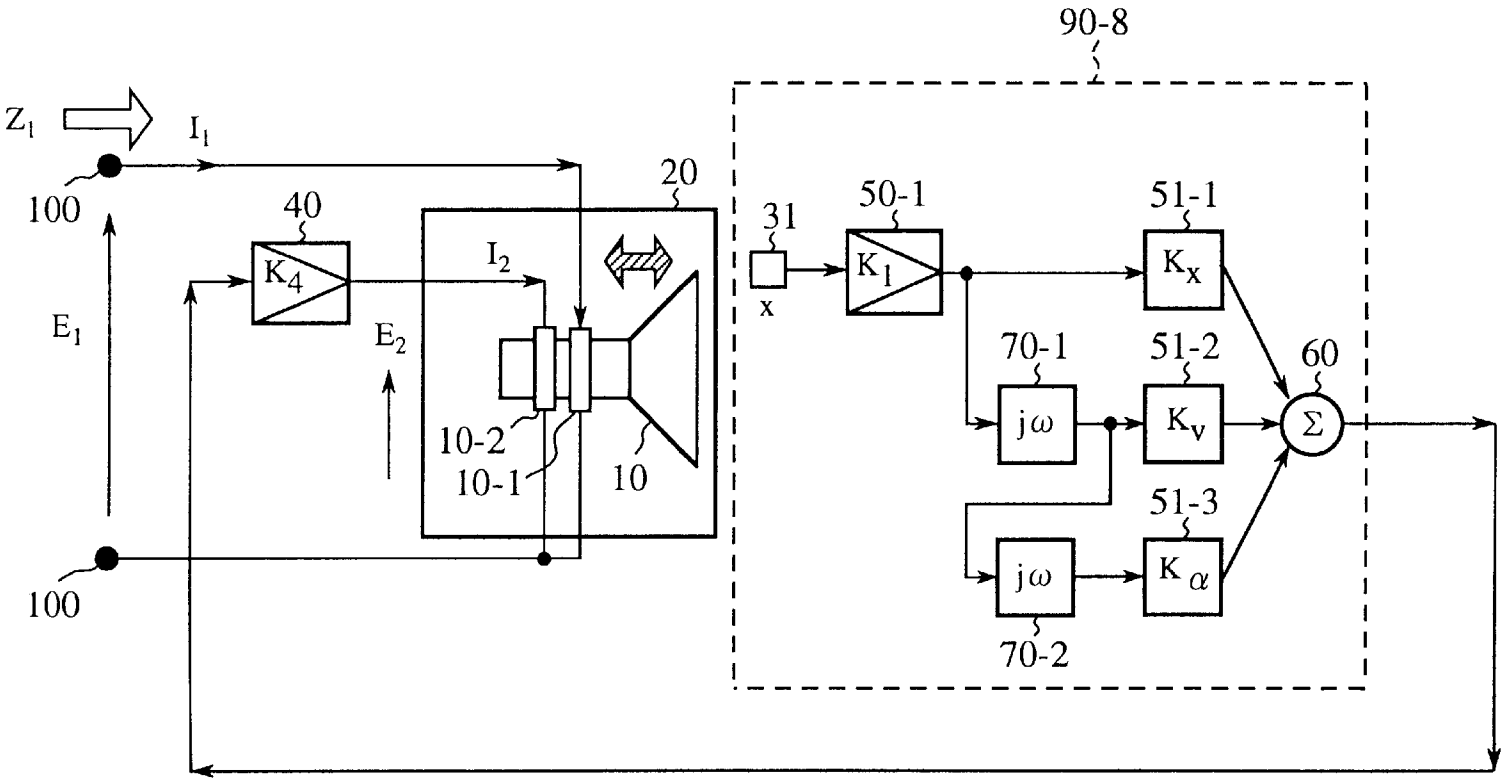
FIG. 29 shows the construction of the MFB speaker system according to a twentieth embodiment.

FIG. 29 shows the construction of the MFB speaker system according to the twentieth embodiment. Referring to FIG. 29, numeral 70-1 indicates a differentiator for differentiating the signal indicating the vibrational displacement x from the amplifier 50-1 and generating the signal indicating the vibrational velocity v and 70-2 indicates a differentiator for further differentiating the signal indicating the vibrational velocity v from the differentiator 70-1 and generating the signal indicating the vibrational acceleration $\alpha$. Numeral 51-1 indicates a signal level adjusting means with a gain $k_x$ for adjusting the level of the signal indicating the vibrational displacement x from the amplifier 50-1, 51-2 indicates a signal level adjusting means with a gain $k_v$ for adjusting the level of the signal indicating the vibrational velocity v from the differentiator 70-1 and 51-3 indicates a signal level adjusting means with a gain $k\alpha$ for adjusting the level of the signal indicating the vibrational acceleration $\alpha$ from the differentiator 70-2. The other aspects of the construction are identical to those shown in FIG. 21 of the thirteenth embodiment except that the vibrational velocity detecting means 32, the vibrational acceleration detecting means 33 and the amplifiers 50-2, 50-3 are eliminated.

That is, in this embodiment, the vibrational velocity detecting means 31, the amplifier 50-1, the differentiators 70-1, 70-2, the signal level adjusting means 51-1, 51-2, 51-3, and the adder 60 constitute a vibration information detecting means 90-8 of the speaker unit 10.

A description will now be given of the operation.

For example, when an acoustic signal amplified using the power amplifier in the user's possession is input directly, via the input terminal 100, to the first voice coil 10-1 of the speaker unit 10 with the input voltage E1, the diaphragm of the speaker unit 10 vibrates. The vibrational information available in this construction includes the signal indicating the vibrational displacement x output from the vibrational displacement detecting means 31.

The signal indicating the vibrational displacement x is then amplified by the amplifier 50-1 to an appropriate level and diverged into two individual signals. One of the diverged vibrational displacement signals is subject to level adjustment by the signal level adjusting means 51-1 and input to the adder 60. The other vibrational displacement signal is converted into the signal indicating the vibrational velocity v by the differentiator 70-1. The signal from the differentiator 70-1 is further diverged into two individual signals so that one of the diverged signals is subject to level adjustment by the signal level adjusting means 51-2 before being input to the adder 60. The other vibrational velocity signal is converted into the signal indicating vibrational acceleration $\alpha$ by being further differentiated by the differentiator 70-2 and is subject to level adjustment by the signal level adjusting means 51-3 before being input to the adder 60.

The signal indicating the vibrational displacement x, the signal indicating the vibrational velocity v and the signal indicating the vibrational acceleration $\alpha$ are added by the adder 60 and output therefrom. That is, the signal proportional to the vibrational displacement x, the signal proportional to the vibrational velocity v and the signal proportional to the vibrational acceleration $\alpha$ are added and output from the vibration information detecting means 90-8 as a sum signal. After being amplified by the power amplifier 40, the sum signal is supplied to the second voice coil 10-2 with a positive or negative polarity with respect to the first voice coil 10-1.

When the signal is supplied with a positive polarity, a positive feedback is set up so that the input voltage $E_2$ proportional to the vibrational displacement x, vibrational velocity v and vibrational acceleration $\alpha$ is supplied to the second voice coil 10-2. From the perspective of the first voice coil 10-1, this is equivalent to an increase of the equivalent mechanical compliance and a decrease of the equivalent mechanical resistance and equivalent mechanical mass in the mechanical equivalent circuit of the entire system.

When the signal is supplied with a negative polarity, a negative feedback is set up so that the input voltage $E_2$ proportional to the vibrational displacement x, vibrational velocity v and vibrational acceleration $\alpha$ is supplied to the second voice coil 10-2 with a negative polarity. From the perspective of the first voice coil 10-1, this is equivalent to a decrease of the equivalent compliance and an increase of the equivalent mechanical resistance and equivalent mechanical mass in the mechanical equivalent circuit of the entire system.

The mechanical equivalent circuit of the MFB speaker system of FIG. 29 and the operation thereof are generally the same as disclosed in FIG. 22 except that the gain $k_1$ of the amplifier is replaced by the product of $k_1$ and $k_x$, the gain $K_2$ is replaced by the product of $k_1$ and $k_v$ and the gain $K_3$ is replaced by the product of $k_1$ and $k\alpha$ in FIG. 22.

The negative equivalent mechanical compliance $C_{NG}$ changes with a change in the amplifier 50-1 for amplifying the signal indicating the vibrational displacement x and in the signal level adjusting means 51-1. Consequentially, the negative equivalent mechanical resistance $R_{NG}$ changes with a change in the amplifier 50-2 for amplifying the signal indicating the vibrational velocity v and in the signal level adjusting means 51-2, and the equivalent mechanical mass $M_{NG}$ changes with a change in the amplifier 50-3 for amplifying the signal indicating the vibrational acceleration $\alpha$ and in the signal level adjusting means 51-3.

That is, when the gain is adjusted so as to increase the feedback to the second voice coil 10-2, the negative equivalent mechanical compliance v is decreased, as demonstrated by the expression (6), and the negative mechanical resistance $R_{NG}$ and the negative equivalent mechanical mass $M_{NG}$ are increased, as demonstrated by the expression's (7) and (8) above. Consequently, the equivalent mechanical compliance is increased, and the equivalent mechanical resistance and equivalent mechanical mass are decreased from the perspective of the entire speaker system. When the positive feedback is used, the feedback rate is adjusted in the mechanical equivalent circuit shown in FIG. 22 so that none of the entire equivalent mechanical compliance, equivalent mechanical resistance and equivalent mechanical mass becomes negative, thus preventing oscillation of the MFB speaker system.

If the feedback to the second voice coil 10-2 is increased, the lowest resonance frequency $f_o$ drops assuming that the equivalent mechanical mass $M_0$ remains constant, as in the thirteenth embodiment. $Q_0$ varies with the feedback rate of the signal indicating the vibrational displacement x, the signal indicating the vibrational velocity v and the signal indicating the vibrational acceleration $\alpha$.

In the negative feedback, the mechanical equivalent circuit and the operation thereof are generally the same as disclosed in FIG. 22 except that the gain $k_1$ of the amplifier is replaced by the product of $k_1$ and $k_x$, the gain $K_2$ is replaced by the product of $k_1$ and $k_v$, and the gain $K_3$ is replaced by the product of $k_1$ and $k\alpha$. In the negative feedback, the negative equivalent mechanical compliance $C_{NG}$, the negative equivalent mechanical resistance $R_{NG}$ and the negative mechanical mass $M_{NG}$ change to a positive value, and the speaker system operates as a combination of the related-art displacement MFB system, velocity MFB system and acceleration MFB system.

Thus, according to the twentieth embodiment, the speaker unit 10 of the double voice coil type having the first and second voice coils 10-1 and 10-2 is used, the sum signal composed of the signal indicating the vibrational displacement x, the signal indicating the vibrational velocity v obtained by differentiating the signal indicating the vibrational displacement x and the signal indicating the vibrational acceleration $\alpha$ is amplified by the power amplifier 40 and is input to the second voice coil 10-2, while the acoustic signal is amplified by an external power amplifier and input directly to the first voice coil 10-1. Therefore, the user can use a power amplifier in his or her possession or use an amplifier of his or her own choice.

Embodiment 21

Figure 30:
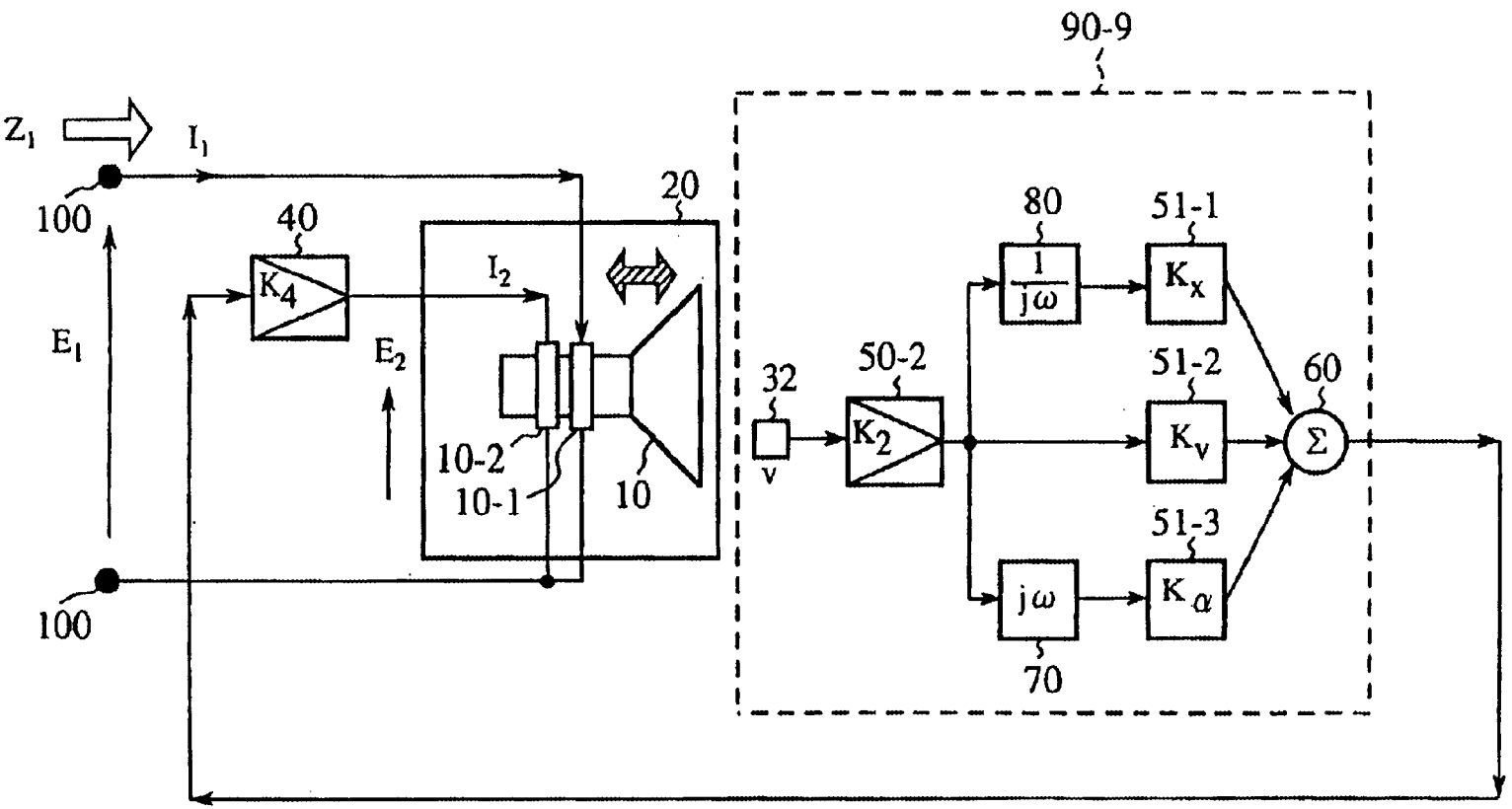
FIG. 30 shows the construction of the MFB speaker system according to a twenty-first embodiment.

FIG. 30 shows the construction of the MFB speaker system according to the twenty-first embodiment.

Referring to FIG. 30, numeral 70 indicates a differentiator for differentiating the signal indicating the vibrational velocity v from the amplifier 50-2 and generating the signal indicating the vibrational acceleration $\alpha$ and 80 indicates an integrator for integrating the signal indicating the vibrational velocity v from the amplifier 50-2 and generating the signal indicating the vibrational displacement x.

Numeral 51-1 indicates a signal level adjusting means with a gain $k_x$ for adjusting the level of the signal indicating the vibrational displacement x from the integrator 80, 51-2 indicates a signal level adjusting means with a gain $k_v$ for adjusting the level of the signal indicating the vibrational velocity v from the amplifier 50-2 and 51-3 indicates a signal level adjusting means with a gain $k\alpha$ for adjusting the level of the signal indicating the vibrational acceleration $\alpha$ from the differentiator 70. The other aspects of the construction are identical to those shown in FIG. 21 of the thirteenth embodiment except that the vibrational displacement detecting means 31, the vibrational acceleration detecting means 33 and the amplifiers 50-1, 50-3 are eliminated.

That is, in this embodiment, the vibrational velocity detecting means 32, the amplifier 50-2, the differentiator 70, the integrator 80, the signal level adjusting means 51-1, 51-2, 51-3 and the adder 60 constitute a vibration information detecting means 90-9.

A description will now be given of the operation.

For example, when an acoustic signal amplified using the power amplifier in the user's possession is input directly, via the input terminal 100, to the first voice coil 10-1 of the speaker unit 10 with the input voltage $E_1$, the diaphragm of the speaker unit 10 vibrates. The vibrational information available in this construction includes the signal indicating the vibrational velocity v output from the vibrational velocity detecting means 32.

The signal indicating the vibrational velocity v is then amplified by the amplifier 50-2 to an appropriate level and diverged into three individual signals. The first of the diverged vibrational displacement signals is subject to level adjustment by the signal level adjusting means 51-2 and input to the adder 60. The second vibrational velocity signal is converted into the signal indicating the vibrational displacement x by being integrated by the integrator 80, subject to level adjustment by the signal level adjusting means 51-1 before being input to the adder 60. The third vibrational velocity signal is converted into the signal indicating the vibrational acceleration $\alpha$ by being differentiated by the differentiator 70, subject to level adjustment by the signal level adjusting means 51-3 before being input to the adder 60.

The signal indicating the vibrational displacement x, the signal indicating the vibrational velocity v and the signal indicating the vibrational acceleration $\alpha$ are added by the adder 60 and output therefrom. That is, the signal proportional to the vibrational displacement x, the signal proportional to the vibrational velocity v and the signal proportional to the vibrational acceleration $\alpha$ are added and output from the vibration information detecting means 90-9 as a sum signal. After being amplified by the power amplifier 40, the sum signal is supplied to the second voice coil 10-2 with a positive or negative polarity with respect to the first voice coil 10-1.

When the signal is supplied with a positive polarity, a positive feedback is set up so that the input voltage $E_2$ proportional to the vibrational displacement x, vibrational velocity v and vibrational acceleration $\alpha$ is supplied to the second voice coil 10-2. From the perspective of the first voice coil 10-1, this is equivalent to an increase of the equivalent mechanical compliance and a decrease of the equivalent mechanical resistance and equivalent mechanical mass in the mechanical equivalent circuit of the entire system.

When the signal is supplied with a negative polarity, a negative feedback is set up so that the input voltage $E_2$ proportional to the vibrational displacement x, vibrational velocity v and vibrational acceleration $\alpha$ is supplied to the second voice coil 10-2 with a negative polarity. From the perspective of the first voice coil 10-1, this is equivalent to a decrease of the equivalent compliance and an increase of the equivalent mechanical resistance and equivalent mechanical mass in the mechanical equivalent circuit of the entire system.

The mechanical equivalent circuit of the MFB speaker system of FIG. 30 and the operation thereof are generally the same as disclosed in FIG. 22 except that the gain $k_1$ of the amplifier is replaced by the product of $K_2$ and $k_x$, the gain $K_2$ is replaced by the product of $K_2$ and $k_v$ and the gain $K_3$ is replaced by the product of $K_2$ and $k\alpha$ in FIG. 22.

The negative equivalent mechanical compliance $C_{NG}$ changes with a change in the amplifier 50-1 for amplifying the signal indicating the vibrational displacement x and in the signal level adjusting means 51-1 and the negative equivalent mechanical resistance $R_{NG}$ changes with a change in the amplifier 50-2 for amplifying the signal indicating the vibrational velocity v and in the signal level adjusting means 51-2. Consequently, the equivalent mechanical mass $M_{NG}$ changes with a change in the amplifier 50-3 for amplifying the signal indicating the vibrational acceleration $\alpha$ and in the signal level adjusting means 51-3.

That is, when the gain is adjusted so as to increase the feedback to the second voice coil 10-2, the negative equivalent mechanical compliance $C_{NG}$ is decreased, as demonstrated by the expression (6), and the negative mechanical resistance $R_{NG}$ and the negative equivalent mechanical mass $M_{NG}$ are increased, as demonstrated by the expression's (7) and (8) above. Consequently, the equivalent mechanical compliance is increased, and the equivalent mechanical resistance and equivalent mechanical mass are decreased from the perspective of the entire speaker system. When the positive feedback is used, the feedback rate is adjusted in the mechanical equivalent circuit shown in FIG. 22 so that none of the entire equivalent mechanical compliance, equivalent mechanical resistance and equivalent mechanical mass becomes negative, thus preventing oscillation of the MFB speaker system.

If the feedback to the second voice coil 10-2 is increased, the lowest resonance frequency $f_0$ drops assuming that the equivalent mechanical mass $M_0$ remains constant, as in the thirteenth embodiment. $Q_0$ varies with the feedback rate of the signal indicating the vibrational displacement x, the signal indicating the vibrational velocity v and the signal indicating the vibrational acceleration $\alpha$.

In the negative feedback, the mechanical equivalent circuit and the operation thereof are generally the same as disclosed in FIG. 22 except that the gain $k_1$ of the amplifier is replaced by the product of $K_2$ and $k_x$, the gain $K_2$ is replaced by the product of $K_2$ and $k_v$, and the gain $K_3$ is replaced by the product of $K_2$ and $k\alpha$. In the negative feedback, the negative equivalent mechanical compliance $C_{NG}$, the negative equivalent mechanical resistance $R_{NG}$ and the negative mechanical mass $M_{NG}$ change to a positive value, and the speaker system operates as a combination of the related-art displacement MFB system, velocity MFB system and acceleration MFB system.

Thus, according to the twenty-first embodiment, the speaker unit 10 of the double voice coil type having the first and second voice coils 10-1 and 10-2 is used, the sum signal composed of the signal indicating the vibrational displacement x obtained by integrating the signal indicating the vibrational velocity v, the signal indicating the vibrational velocity v and the signal indicating the vibrational acceleration $\alpha$ obtained by differentiating the signal indicating the vibrational velocity v is amplified by the power amplifier 40 and is input to the second voice coil 10-2, while the acoustic signal is amplified by an external power amplifier and input directly to the first voice coil 10-1. Therefore, the user can use a power amplifier in his or her possession or use an amplifier of his or her own choice.

Embodiment 22

Figure 31:
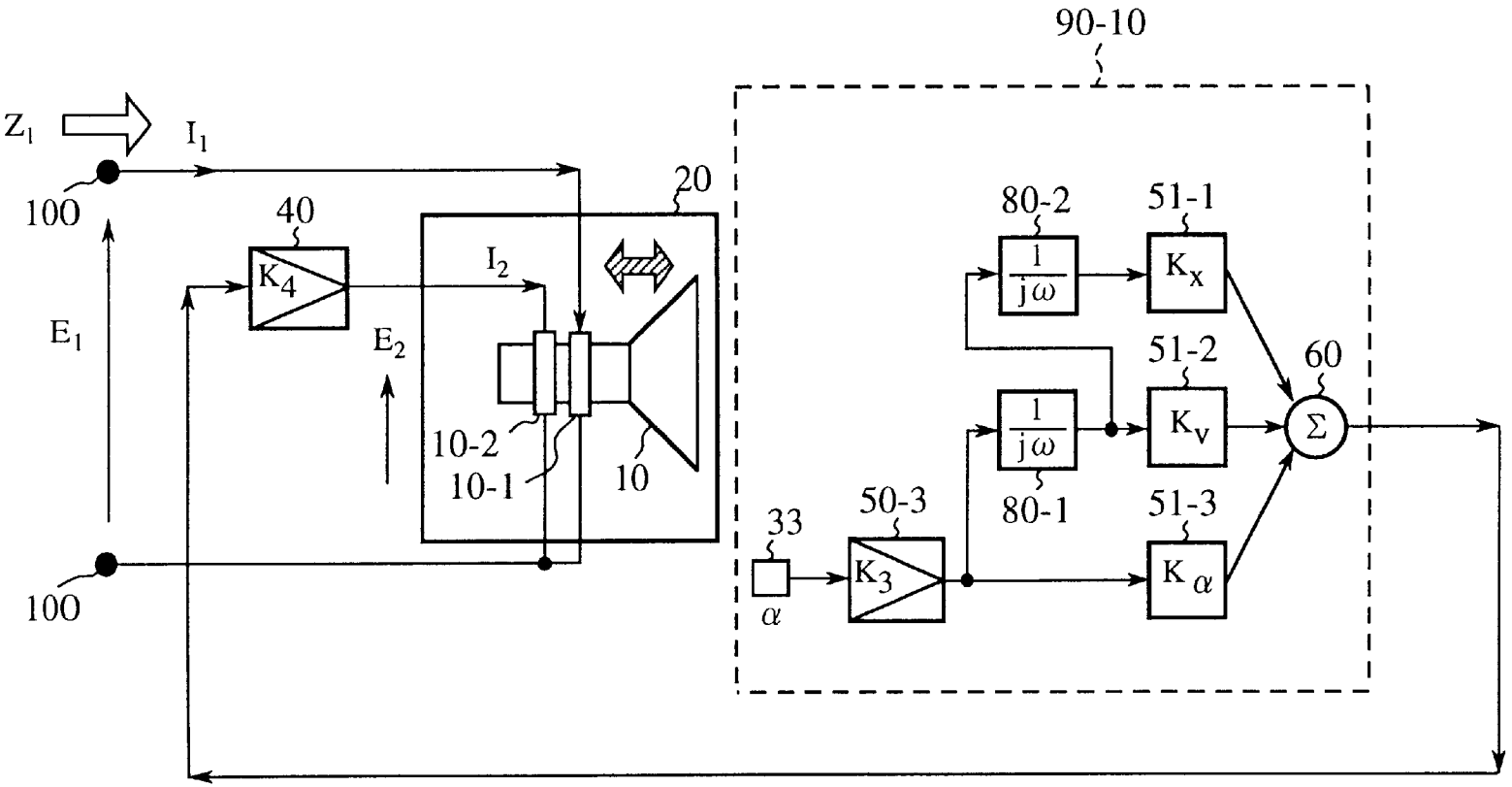
FIG. 31 shows the construction of the MFB speaker system according to a twenty-second embodiment.

FIG. 31 shows the construction of the MFB speaker system according to the twenty-second embodiment. Referring to FIG. 31, numeral 80-1 indicates an integrator for integrating the signal indicating the vibrational acceleration $\alpha$ from the amplifier 50-3 and generating the signal indicating the vibrational velocity v and 80-2 indicates an integrator for further integrating the signal indicating the vibrational velocity v from the integrator 80-1 and generating the signal indicating the vibrational displacement x. Numeral 51-1 indicates a signal level adjusting means with a gain $k_x$ for adjusting the level of the signal indicating the vibrational displacement x from the integrator 80-2, 51-2 indicates a signal level adjusting means with a gain $k_v$ for adjusting the level of the signal indicating the vibrational velocity v from the integrator 80-1 and 51-3 indicates a signal level adjusting means with a gain $k\alpha$ for adjusting the level of the signal indicating the vibrational acceleration $\alpha$ from the amplifier 50-3. The other aspects of the construction are identical to those shown in FIG. 21 of the thirteenth embodiment except that the vibrational displacement detecting means 31, the vibrational velocity detecting means 32 and the amplifiers 50-1, 50-2 are eliminated.

A description will now be given of the operation.

For example, when an acoustic signal amplified using the power amplifier in the user's possession is input directly, via the input terminal 100, to the first voice coil 10-1 of the speaker unit 10 with the input voltage $E_1$, the diaphragm of the speaker unit 10 vibrates. The vibrational information available in this construction includes the signal indicating the vibrational acceleration $\alpha$ output from the vibrational velocity detecting means 33.

The signal indicating the vibrational acceleration $\alpha$ is amplified by the amplifier 50-3 to an appropriate level and diverged into two individual signals. One of the diverged vibrational acceleration signals is subject to level adjustment by the signal level adjusting means 51-3 before being input to the adder 60. The diverged vibrational acceleration signal is converted into the signal indicating the vibrational velocity v by being integrated by the integrator 80-1. The signal from the integrator 80-1 is further diverged into two individual signals. One of the vibrational velocity signals from the integrator 80-1 is subject to level adjustment by the signal level adjusting means 51-2 before being input to the adder 60. The other vibrational velocity signal from the integrator 80-1 is converted into the signal indicating the vibrational displacement x by being further integrated by the integrator 80-2 and is subject to level adjustment by the signal level adjusting means 51-1 before being input to the adder 60.

The signal indicating the vibrational displacement x, the signal indicating the vibrational velocity v and the signal indicating the vibrational acceleration $\alpha$ are added by the adder 60 and output therefrom. That is, the signal proportional to the vibrational displacement x, the signal proportional to the vibrational velocity v and the signal proportional to the vibrational acceleration $\alpha$ are added and output from the vibration information detecting means 90-9 as a sum signal. After being amplified by the power amplifier 40, the sum signal is supplied to the second voice coil 10-2 with a positive or negative polarity with respect to the first voice coil 10-1.

When the signal is supplied with a positive polarity, a positive feedback is set up so that the input voltage $E_2$ proportional to the vibrational displacement x, vibrational velocity v and vibrational acceleration $\alpha$ is supplied to the second voice coil 10-2. From the perspective of the first voice coil 10-1, this is equivalent to an increase of the equivalent mechanical compliance and a decrease of the equivalent mechanical resistance and equivalent mechanical mass in the mechanical equivalent circuit of the entire system.

When the signal is supplied with a negative polarity, a negative feedback is set up so that the input voltage $E_2$ proportional to the vibrational displacement x, vibrational velocity v and vibrational acceleration $\alpha$ is supplied to the second voice coil 10-2 with a negative polarity. From the perspective of the first voice coil 10-1, this is equivalent to a decrease of the equivalent compliance and an increase of the equivalent mechanical resistance and equivalent mechanical mass in the mechanical equivalent circuit of the entire system.

The mechanical equivalent circuit of the MFB speaker system of FIG. 31 and the operation. thereof are generally the same as disclosed in FIG. 22 except that the gain $k_1$ of the amplifier is replaced by the product of $K_3$ and $k_x$, the gain $K_2$ is replaced by the product of $K_3$ and $k_v$ and the gain $K_3$ is replaced by the product of $K_3$ and $k\alpha$ in FIG. 22.

The negative equivalent mechanical compliance $C_{NG}$ changes with a change in the amplifier 50-1 for amplifying the signal indicating the vibrational displacement x and in the signal level adjusting means 51-1. Consequently, the negative equivalent mechanical resistance $R_{NG}$ changes with a change in the amplifier 50-2 for amplifying the signal indicating the vibrational velocity v and in the signal level adjusting means 51-2 and the equivalent mechanical mass $M_{NG}$ changes with a change in the amplifier 50-3 for amplifying the signal indicating the vibrational acceleration $\alpha$ and in the signal level adjusting means 51-3.

That is, when the gain is adjusted so as to increase the feedback to the second voice coil 10-2, the negative equivalent mechanical compliance $C_{NG}$ is decreased, as demonstrated by the expression (6), and the negative mechanical resistance $R_{NG}$ and the negative equivalent mechanical mass $M_{NG}$ are increased, as demonstrated by the expression's (7) and (8) above. Consequently, the equivalent mechanical compliance is increased, and the equivalent mechanical resistance and equivalent mechanical mass are decreased from the perspective of the entire speaker system. When the positive feedback is used, the feedback rate is adjusted in the mechanical equivalent circuit shown in FIG. 22 so that none of the entire equivalent mechanical compliance, equivalent mechanical resistance and equivalent mechanical mass becomes negative, thus preventing oscillation of the MFB speaker system.

If the feedback to the second voice coil 10-2 is increased, the lowest resonance frequency $f_0$ drops assuming that the equivalent mechanical mass $M_0$ remains constant, as in the thirteenth embodiment. $Q_0$ varies with the feedback rate of the signal indicating the vibrational displacement x, the signal indicating the vibrational velocity v and the signal indicating the vibrational acceleration $\alpha$.

In the negative feedback, the mechanical equivalent circuit and the operation thereof are generally the same as disclosed in FIG. 22 except that the gain k, of the amplifier is replaced by the product of $K_3$ and $k_x$, the gain $K_2$ is replaced by the product of $K_3$ and $k_v$, and the gain $K_3$ is replaced by the product of $K_3$ and $k\alpha$. In the negative feedback, the negative equivalent mechanical compliance $C_{NG}$, the negative equivalent mechanical resistance $R_{NG}$ and the negative mechanical mass $M_{NG}$ change to a positive value, and the speaker system operates as a combination of the related-art displacement MFB system, velocity MFB system and acceleration MFB system.

Thus, according to the twenty-second embodiment, the speaker unit 10 of the double voice coil type having the first and second voice coils 10-1 and 10-2 is used, the sum signal composed of the signal indicating the vibrational displacement x obtained by integrating the signal indicating the vibrational acceleration $\alpha$ twice, the signal indicating the vibrational velocity v obtained by integrating the signal indicating the vibrational acceleration $\alpha$, and the signal indicating the vibrational acceleration $\alpha$ obtained by differentiating the signal indicating the vibrational velocity v is amplified by the power amplifier 40 and is input to the second voice coil 10-2, while the acoustic signal is amplified by an external power amplifier and input directly to the first voice coil 10-1. Therefore, the user can use a power amplifier in his or her possession or use an amplifier of his or her own choice.

The present invention is not limited to the above-described embodiments, and variations and modifications may be made without departing from the scope of the present invention.

What is claimed is:

1. A motional feedback (MFB) speaker system, comprising:

a speaker having a diaphragm, a first voice coil and a second voice coil, said first voice coil receiving an electrical sound signal representing audible sound information and causing said diaphragm to vibrate in response to said electric signal to reproduce said audible sound information;

a vibrational detector for detecting a vibrational parameter of said diaphragm, and developing an electrical vibration signal corresponding to said detected vibrational parameter; and an amplifier for receiving said electrical vibration signal, amplifying said electrical vibration signal only, and outputting the amplified electrical vibration signal to said second voice coil with one of either a positive or a negative polarity with respect to said electrical sound signal, the primary speaker driving function being separated from said amplifier.

2. The MFB speaker system as set forth in claim 1, wherein said vibrational parameter is a vibrational velocity of said diaphragm.

3. The MFB speaker system as set forth in claim 1, wherein said vibrational parameter is a vibrational acceleration of said diaphragm.

4. The MFB speaker system as set forth in claim 1, wherein said vibrational parameter is a vibrational displacement of said diaphragm.

5. The MFB speaker system as set forth in claim 1, wherein said vibrational detector detects a vibrational displacement of said diaphragm and a vibrational velocity of said diaphragm, and said electrical vibration signal corresponds to a sum of said detected vibrational displacement and said detected vibrational velocity.

6. The MFB speaker system as set forth in claim 5, wherein said vibrational velocity of said diaphragm is detected by differentiating a signal corresponding to said vibrational displacement.

7. The MFB speaker system as set forth in claim 5, wherein said vibrational displacement of said diaphragm is detected by integrating a signal corresponding to said vibrational velocity.

8. The MFB speaker system as set forth in claim 1, wherein said vibrational detector detects a vibrational displacement of said diaphragm and a vibrational acceleration of said diaphragm, and said electrical vibration signal corresponds to a sum of said detected vibrational displacement and said detected vibrational acceleration.

9. The MFB speaker system as set forth in claim 8, wherein said vibrational acceleration of said diaphragm is detected by differentiating a signal corresponding to said vibrational displacement.

10. The MFB speaker system as set forth in claim 8, wherein said vibrational displacement of said diaphragm is detected by integrating a signal corresponding to said vibrational acceleration.

11. The MFB speaker system as set forth in claim 1, wherein said vibrational detector detects a vibrational velocity of said diaphragm and a vibrational acceleration of said diaphragm, and said electrical vibration signal corresponds to a sum of said detected vibrational velocity and said detected vibrational acceleration.

12. The MFB speaker system as set forth in claim 11, wherein said vibrational acceleration of said diaphragm is detected by differentiating a signal corresponding to said vibrational velocity.

13. The MFB speaker system as set forth in claim 11, wherein said vibrational velocity of said diaphragm is detected by integrating a signal corresponding to said vibrational acceleration.

14. The MFB speaker system as set forth in claim 1, wherein said vibrational detector detects a vibrational velocity of said diaphragm and a vibrational acceleration of said diaphragm, and said electrical vibration signal corresponds to a sum of said detected vibrational velocity and said detected vibrational acceleration.

15. The MFB speaker system as set forth in claim 14, wherein said vibrational velocity of said diaphragm is detected by differentiating a signal corresponding to said vibrational displacement.

16. The MFB speaker system as set forth in claim 14, wherein said vibrational velocity of said diaphragm is detected by integrating a signal corresponding to said vibrational acceleration.

17. The MFB speaker system as set forth in claim 14, wherein said vibrational acceleration of said diaphragm is detected by differentiating a signal corresponding to said vibrational velocity.

18. The MFB speaker system as set forth in claim 14, wherein said vibrational acceleration of said diaphragm is detected by differentiating a signal corresponding to said vibrational displacement.

19. The MFB speaker system as set forth in claim 14, wherein said vibrational displacement of said diaphragm is detected by integrating a signal corresponding to said vibrational velocity.

20. The MFB speaker system as set forth in claim 14, wherein said vibrational displacement of said diaphragm is detected by integrating a signal corresponding to said vibrational acceleration.

21. The MFB speaker system as set forth in claim 14, wherein said vibrational velocity of said diaphragm is detected by differentiating a signal corresponding to said vibrational displacement to produce a velocity signal, and said vibrational acceleration is detected by differentiating said produced velocity signal.

22. The MFB speaker system as set forth in claim 14, wherein said vibrational displacement of said diaphragm is detected by integrating a signal corresponding to said vibrational velocity, and said vibrational acceleration is detected by differentiating said signal corresponding to said vibrational velocity.

23. The MFB speaker system as set forth in claim 14, wherein said vibrational velocity of said diaphragm is detected by integrating a signal corresponding to said vibrational acceleration to produce a velocity signal, and said vibrational displacement is detected by integrating said produced velocity signal.

24. The MFB speaker system as set forth in claim 2, wherein said vibrational detector adjusts the level of said electrical vibration signal.

25. The MFB speaker system as set forth in claim 3, wherein said vibrational detector adjusts the level of said electrical vibration signal.

26. The MFB speaker system as set forth in claim 4, wherein said vibrational detector adjusts the level of said electrical vibration signal.

* * * * *